US008670917B2

(12) United States Patent
Aoki et al.

(10) Patent No.: US 8,670,917 B2
(45) Date of Patent: Mar. 11, 2014

(54) AIR-FUEL-RATIO IMBALANCE DETERMINATION APPARATUS FOR INTERNAL COMBUSTION ENGINE

(75) Inventors: Keiichiro Aoki, Shizuoka-ken (JP); Yasushi Iwazaki, Ebina (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 119 days.

(21) Appl. No.: 13/500,543

(22) PCT Filed: Oct. 6, 2009

(86) PCT No.: PCT/JP2009/067686
§ 371 (c)(1),
(2), (4) Date: Apr. 5, 2012

(87) PCT Pub. No.: WO2011/042994
PCT Pub. Date: Apr. 14, 2011

(65) Prior Publication Data
US 2012/0209498 A1 Aug. 16, 2012

(51) Int. Cl.
*F02D 41/26* (2006.01)

(52) U.S. Cl.
USPC ..... 701/104; 123/673; 701/103; 701/109; 204/424; 73/114.72

(58) Field of Classification Search
USPC ..... 701/103, 104, 107, 109; 204/421–429; 73/23.32, 114.72; 123/690, 198 D, 630
See application file for complete search history.

(56) References Cited

U.S. PATENT DOCUMENTS 4,712,419 A * 12/1987 Ikai et al. ..... 73/114.72
6,340,419 B1 1/2002 Nakae et al.

(Continued)

FOREIGN PATENT DOCUMENTS

JP 4116237 A 4/1992
JP 7063090 A 3/1995

(Continued)

OTHER PUBLICATIONS

Ramamoorthy, 2003, Oxygen sensors: Materials, methods, designs and applications, Kluwer Academic Publishers, Journal of Materials Science, pp. 4271-4282.*

*Primary Examiner* — Stephen K Cronin
*Assistant Examiner* — Carl Staubach
(74) *Attorney, Agent, or Firm* — Gifford, Krass, Sprinkle, Anderson & Citkowski, P.C.

(57) ABSTRACT

An inter-cylinder air-fuel-ratio imbalance determination apparatus includes an air-fuel-ratio sensor in an exhaust passage of an engine. The air-fuel-ratio sensor functions as a limiting-current-type wide range air-fuel-ratio sensor when a voltage is applied, and functions as a concentration-cell-type oxygen concentration sensor when no voltage is applied. The determination apparatus causes the air-fuel-ratio sensor to function as the limiting-current-type wide range air-fuel-ratio sensor, and executes air-fuel ratio feedback control on the basis of the output value of the air-fuel-ratio sensor. When an imbalance determination parameter is obtained, the determination apparatus causes the air-fuel-ratio sensor to function as the concentration-cell-type oxygen concentration sensor, and obtains, as the imbalance determination parameter, a value corresponding to the differentiated value of the output value of the air-fuel-ratio sensor. The determination apparatus determines an inter-cylinder air-fuel-ratio imbalance state, when the absolute value of the imbalance determination parameter is greater than an imbalance determination threshold value.

14 Claims, 21 Drawing Sheets

(56) References Cited

U.S. PATENT DOCUMENTS

| | | | | |
|---|---|---|---|---|
| 6,481,427 | B1 * | 11/2002 | Javaherian | 123/673 |
| 6,877,311 | B2 | 4/2005 | Uchida | |
| 7,027,910 | B1 * | 4/2006 | Javaherian et al. | 701/111 |
| 7,152,594 | B2 | 12/2006 | Anilovich et al. | |
| 7,497,210 | B2 * | 3/2009 | Okamoto | 123/673 |
| 7,926,330 | B2 * | 4/2011 | Huang et al. | 73/114.38 |
| 8,012,323 | B2 * | 9/2011 | Singh et al. | 204/424 |
| 8,047,064 | B2 | 11/2011 | Iwazaki et al. | |
| 8,377,275 | B2 * | 2/2013 | Ieda et al. | 204/426 |
| 2010/0191444 | A1 | 7/2010 | Aoki | |

FOREIGN PATENT DOCUMENTS

| | | | |
|---|---|---|---|
| JP | 9203337 | A | 8/1997 |
| JP | 11072473 | A | 3/1999 |
| JP | 2000065782 | A | 3/2000 |
| JP | 2000-220492 | A | 8/2000 |
| JP | 2000-292407 | A | 10/2000 |
| JP | 2004-028029 | A | 1/2004 |
| JP | 2004069547 | A | 3/2004 |
| JP | 2004-176615 | A | 6/2004 |
| JP | 2007-056723 | A | 3/2007 |
| JP | 2008051003 | A | 3/2008 |
| JP | 2009-013967 | A | 1/2009 |
| JP | 2009-097474 | A | 5/2009 |
| JP | 2009-127595 | A | 6/2009 |
| JP | 2009-127597 | A | 6/2009 |
| JP | 2009-191665 | A | 8/2009 |
| JP | 2009-209747 | A | 9/2009 |
| JP | 2009203881 | A | 9/2009 |

* cited by examiner

AIR-FUEL-RATIO IMBALANCE DETERMINATION APPARATUS FOR INTERNAL COMBUSTION ENGINE

TECHNICAL FIELD

The present invention relates to an "inter-cylinder air-fuel-ratio imbalance determination apparatus for an internal combustion engine", which is applied to a multi-cylinder internal combustion engine, and which can determine (monitor/detect) that the degree of imbalance among the air-fuel ratios of air-fuel mixtures supplied to cylinders (inter-cylinder air-fuel-ratio imbalance; inter-cylinder air-fuel-ratio variation; inter-cylinder air-fuel-ratio non-uniformity) has increased excessively.

BACKGROUND ART

Conventionally, there has been widely known an air-fuel ratio control apparatus which includes a three-way catalyst disposed in an exhaust passage of an internal combustion engine, and an upstream air-fuel-ratio sensor and a downstream air-fuel-ratio sensor disposed in the exhaust passage so as to be located upstream and downstream, respectively, of the three-way catalyst. This air-fuel ratio control apparatus calculates an air-fuel ratio feedback quantity on the basis of the outputs of the upstream and downstream air-fuel-ratio sensors such that the air-fuel ratio of the air-fuel mixture supplied to the engine (air-fuel ratio of the engine) coincides with the stoichiometric air-fuel ratio, and feedback-controls the air-fuel ratio of the engine on the basis of the air-fuel ratio feedback quantity. Furthermore, there has been also widely known an air-fuel ratio control apparatus which calculates an air-fuel ratio feedback quantity on the basis of the output of the upstream air-fuel-ratio sensor only, and feedback-controls the air-fuel ratio of the engine on the basis of the air-fuel ratio feedback quantity. The air-fuel ratio feedback quantity used in each of those air-fuel ratio control apparatuses is a control quantity commonly used for all of the cylinders.

Incidentally, in general, an electronic-fuel-injection-type internal combustion engine has at least one fuel injection valve (fuel injector) at each of the cylinders or at each of intake ports communicating with the respective cylinders. Accordingly, when the characteristic/property of the fuel injection valve of a certain cylinder changes to inject fuel in a quantity excessively larger than an instructed fuel injection quantity, only the air-fuel ratio of an air-fuel mixture supplied to that certain cylinder (the air-fuel ratio of the certain cylinder) greatly changes toward the rich side. That is, the degree of air-fuel ratio non-uniformity among the cylinders (inter-cylinder air-fuel ratio variation; inter-cylinder air-fuel ratio imbalance) increases. In other words, there arises an imbalance among "cylinder-by-cylinder air-fuel ratios (the air-fuel ratios of the cylinders)", each of which is the air-fuel ratio of the air-fuel mixture supplied to each of the cylinders.

In such a case, the average of the air-fuel ratios of the air-fuel mixtures supplied to the entire engine becomes an air-fuel ratio in the rich side in relation to (with respect to) the stoichiometric air-fuel ratio. Accordingly, by the air-fuel ratio feedback quantity commonly used for all of the cylinders, the air-fuel ratio of the above-mentioned certain cylinder is changed toward the lean side so as to approach the stoichiometric air-fuel ratio, and, at the same time, the air-fuel ratios of the remaining cylinders are changed toward the lean side so as to deviate from the stoichiometric air-fuel ratio. As a result, the average of the air-fuel ratios of the air-fuel mixtures supplied to the entire engine becomes substantially equal to the stoichiometric air-fuel ratio.

However, since the air-fuel ratio of the certain cylinder is still in the rich side in relation to the stoichiometric air-fuel ratio and the air-fuel ratios of the remaining cylinders are in the lean side in relation to the stoichiometric air-fuel ratio, combustion of the air-fuel mixture in each of the cylinders fail to become complete combustion. As a result, the amount of emissions (the amount of unburned combustibles and the amount of nitrogen oxides) discharged from each of the cylinders increases. Therefore, even when the average of the air-fuel ratios of the air-fuel mixtures supplied to the cylinders of the engine is equal to the stoichiometric air-fuel ratio, the increased emissions cannot be completely removed by the three-way catalyst. Consequently, the amount of emissions may increase.

Accordingly, in order to prevent emissions from increasing, it is important to detect a state in which the degree of air-fuel ratio non-uniformity among the cylinders becomes excessively large (generation of an inter-cylinder air-fuel-ratio imbalance state) and take some measures against the imbalance state. It should be noted that, inter-cylinder air-fuel-ratio imbalance also occurs, for example, in the case where the characteristic of the fuel injection valve of the certain cylinder changes to inject fuel in a quantity excessively smaller than the instructed fuel injection quantity.

One of such conventional apparatuses for determining whether or not an inter-cylinder air-fuel-ratio imbalance state has occurred is configured so as to obtain a trace/trajectory length of an output value (output signal) of an air-fuel-ratio sensor (the above-mentioned upstream air-fuel-ratio sensor) disposed at an exhaust merging/aggregated region into which exhaust gases from a plurality of cylinders of an engine merge, compare the trace length with a "reference value which changes in accordance with the rotational speed of the engine," and determine whether or not an inter-cylinder air-fuel-ratio imbalance state has occurred on the basis of the result of the comparison (see, for example, U.S. Pat. No. 7,152,594).

It should be noted that, in the present specification, the expression "inter-cylinder air-fuel-ratio imbalance state (excessive inter-cylinder air-fuel-ratio imbalance state)" means a state in which the difference between the cylinder-by-cylinder air-fuel ratios is equal to or greater than an allowable value; in other words, it means an inter-cylinder air-fuel-ratio imbalance state in which the amount of unburned combustibles and/or nitrogen oxides exceeds a prescribed value. The determination as to whether or not an "inter-cylinder air-fuel-ratio imbalance state" has occurred will be simply referred to as "inter-cylinder air-fuel-ratio imbalance determination" or "imbalance determination." Moreover, a cylinder supplied with an air-fuel mixture whose air-fuel ratio deviates from the air-fuel ratio of air-fuel mixtures supplied to the remaining cylinders (for example, an air-fuel ratio approximately equal to the stoichiometric air-fuel ratio) will also be referred to as an "imbalanced cylinder." The air-fuel ratio of the air-fuel mixture supplied to such an imbalanced cylinder will also be referred to as the air-fuel ratio of the imbalanced cylinder." The remaining cylinders (cylinders other than the imbalanced cylinder) will also be referred to as "normal cylinders" or "balanced cylinders." The air-fuel ratio of air-fuel mixtures supplied to such normal cylinders will also be referred as the "air-fuel ratio of the normal cylinders" or the "air-fuel ratio of the balanced cylinders."

In addition, a parameter (e.g., the trace length of the output value of the above-mentioned air-fuel-ratio sensor), whose absolute value increases (monotonously) as the difference between the cylinder-by-cylinder air-fuel ratios (the difference between the air-fuel ratio of the imbalanced cylinder and those of the normal cylinders) becomes large, and which is compared with a threshold value for imbalance determination when imbalance determination is performed will also be referred to as an "imbalance determination parameter." This imbalance determination parameter is obtained on the basis of the output value of an air-fuel-ratio sensor.

SUMMARY OF THE INVENTION

As shown in FIG. 1, a well known air-fuel-ratio sensor includes at least an air-fuel-ratio detection element (671) formed of a solid electrolyte layer, an exhaust-gas-side electrode layer (672), an atmosphere-side electrode layer (673), and a diffusion resistance layer (674). The exhaust-gas-side electrode layer is formed on one of surfaces of the air-fuel-ratio detection element. The exhaust-gas-side electrode layer is covered with the diffusion resistance layer. Exhaust gas within an exhaust passage reaches the diffusion resistance layer. The atmosphere-side electrode layer is formed on the other/opposite surface of the air-fuel-ratio detection element. The atmosphere-side electrode layer is exposed to an atmosphere chamber (676) to which atmospheric air is introduced.

A voltage (Vp) is applied between the exhaust-gas-side electrode layer and the atmosphere-side electrode layer so as to generate a limiting current which changes in accordance with the air-fuel ratio of the exhaust gas. In general, this voltage is applied such that the potential of the atmosphere-side electrode layer becomes higher than that of the exhaust-gas-side electrode layer.

As shown in section (B) of FIG. 1, when an excessive amount of oxygen is contained in the exhaust gas reaching the exhaust-gas-side electrode layer through the diffusion resistance layer (that is, when the air-fuel ratio of the exhaust gas reaching the exhaust-gas-side electrode layer is leaner than the stoichiometric air-fuel ratio), the oxygen is led in the form of oxygen ions from the exhaust-gas-side electrode layer to the atmosphere-side electrode layer owing to the application of the above-mentioned voltage and the oxygen pump characteristic of the solid electrolyte layer.

In contrast, as shown in section (C) of FIG. 1, when excessive unburned combustibles are contained in the exhaust gas reaching the exhaust-gas-side electrode layer through the diffusion resistance layer (that is, the air-fuel ratio of the exhaust gas reaching the exhaust-gas-side electrode layer is richer than the stoichiometric air-fuel ratio), oxygen within the atmosphere chamber is led in the form of oxygen ions from the atmosphere-side electrode layer to the exhaust-gas-side electrode layer owing to the oxygen cell characteristic of the solid electrolyte layer, whereby the oxygen reacts with the unburned combustibles at the exhaust-gas-side electrode layer.

Because of the presence of the diffusion resistance layer, the moving amount of such oxygen ions is limited to a value corresponding to the air-fuel ratio of the exhaust gas reaching the diffusion resistance layer. In other words, a current generated as a result of movement of oxygen ions has a magnitude corresponding to the air-fuel ratio of the exhaust gas (that is, limiting current Ip) (see FIG. 2).

That is, when the above-mentioned voltage is applied between the exhaust-gas-side electrode layer and the atmosphere-side electrode layer, the air-fuel-ratio sensor functions as a limiting-current-type wide range air-fuel-ratio sensor, and outputs an "output value Vabyfs corresponding to the limiting current," which becomes larger as the "air-fuel ratio of exhaust gas to be detected" becomes larger. This output value Vabyfs is converted into a detected air-fuel ratio abyfs on the basis of a previously obtained "relationship between the output value Vabyfs and the air-fuel ratio (see a solid line C1 of FIG. 3)."

Meanwhile, the imbalance determination parameter is not limited to the trace length of "the output value Vabyfs of the air-fuel-ratio sensor or the detected air-fuel ratio abyfs," and may be any value which reflects a fluctuation of the air-fuel ratio of exhaust gas flowing through a region where the air-fuel-ratio sensor is disposed. This point will be described further.

Exhaust gases from a plurality of cylinders successively reach the air-fuel-ratio sensor in the order of ignition (accordingly, in the order of exhaust). In a case where no inter-cylinder air-fuel-ratio imbalance state has been occurring, the air-fuel ratios of the exhaust gases discharged from a plurality of the cylinders are approximately equal to one another. Accordingly, in the case where no inter-cylinder air-fuel-ratio imbalance state has been occurring, as shown in section (A) of FIG. 4, the waveform of the output value Vabyfs of the air-fuel-ratio sensor (in section (A) of FIG. 4, the waveform of the detected air-fuel ratio abyfs) is generally flat.

In contrast, in a case where there has been occurring an inter-cylinder air-fuel-ratio imbalance state in which only the air-fuel ratio of a specific cylinder (for example, the first cylinder) has deviated toward the rich side from the stoichiometric air-fuel ratio (specific-cylinder rich-side-deviated imbalance state), the air-fuel ratio of exhaust gas from the specific cylinder greatly differs from those of exhaust gases from the cylinders other than the specific cylinder (the remaining cylinders).

Accordingly, as shown in section (B) of FIG. 4, the waveform of the output value Vabyfs of the air-fuel-ratio sensor (in section (B) of FIG. 4, the waveform of the detected air-fuel ratio abyfs) in the case where the specific-cylinder rich-side-deviated imbalance state has been occurring greatly fluctuates. Specifically, in a case of a four-cylinder, four-cycle engine, the waveform of the output value Vabyfs of the air-fuel-ratio sensor greatly fluctuates every time the engine rotates by an amount corresponding to a crank angle of 720° (a crank angle required for all of the cylinders, each of which discharges exhaust gas reaching a single air-fuel-ratio sensor, to complete their single-time combustion strokes). It should be noted that, in the present specification, a "period corresponding to the crank angle required for all of the cylinders, each of which discharges exhaust gas reaching a single air-fuel-ratio sensor, to complete their single-time combustion strokes" will also be referred to as a "unit combustion cycle period."

More specifically, in the example shown in section (B) of FIG. 4, the detected air-fuel ratio abyfs continuously changes in such a manner that it takes/reaches a value in the rich side in relation to the stoichiometric air-fuel ratio when the exhaust gas from the first cylinder reaches the exhaust-gas-side electrode layer of the air-fuel-ratio sensor, and converges to the stoichiometric air-fuel ratio or a value slightly leaner than the stoichiometric air-fuel ratio when the exhaust gases from the remaining cylinders reach the exhaust-gas-side electrode layer. The reason why the detected air-fuel ratio abyfs converges to a value slightly deviated from the stoichiometric air-fuel ratio toward the lean side when the exhaust gases from the remaining cylinders reach the air-fuel-ratio detection element is that the above-described air-fuel ratio feedback control is performed.

Similarly, in a case where there has been occurring an inter-cylinder air-fuel-ratio imbalance state in which only the air-fuel ratio of a specific cylinder (for example, the first cylinder) has deviated toward the lean side from the stoichiometric air-fuel ratio (specific-cylinder lean-side-deviated imbalance state), as shown in section (C) of FIG. 4, the output value Vabyfs of the air-fuel-ratio sensor (in section (C) of FIG. 4, the detected air-fuel ratio abyfs) greatly fluctuates every time the engine rotates by an amount corresponding to the crank angle of 720°.

As is understood from the above, when an inter-cylinder air-fuel-ratio imbalance state which should be detected occurs, the output value Vabyfs of the air-fuel-ratio sensor and the detected air-fuel ratio abyfs greatly fluctuate is such a manner that the period of the fluctuation coincides with the unit combustion cycle period. Furthermore, as the deviation of the air-fuel ratio of the imbalanced cylinder from those of the normal cylinders becomes greater, the amplitudes of the output value Vabyfs of the air-fuel-ratio sensor and the detected air-fuel ratio abyfs becomes greater. Accordingly, the imbalance determination parameter can be a value which reflects such a fluctuation of "the output value Vabyfs of the air-fuel-ratio sensor or the detected air-fuel ratio abyfs," and thus, is not limited to the trace length of "the output value Vabyfs of the air-fuel-ratio sensor or the detected air-fuel ratio abyfs."

That is, the imbalance determination parameter may be a parameter, whose absolute value increases as the difference between the cylinder-by-cylinder air-fuel ratios (the air-fuel ratios of the air-fuel mixtures supplied to a plurality of the cylinders) becomes larger, and which is obtained on the basis of the output value Vabyfs of the air-fuel-ratio sensor.

Examples of such an imbalance determination parameter include a value which changes in accordance with a value (differential value) obtained by differentiating, with respect to time, the output value Vabyfs of the air-fuel-ratio sensor or the detected air-fuel ratio abyfs (a change amount per unit time in the output value Vabyfs of the air-fuel-ratio sensor or the detected air-fuel ratio abyfs; see angles $\alpha$1 to $\alpha$5 in FIG. 4); a value which changes in accordance with a value (second-order differential value) obtained by differentiating twice, with respect to time, the output value Vabyfs of the air-fuel-ratio sensor or the detected air-fuel ratio abyfs (a change amount per unit time of the change amount per unit time in the output value Vabyfs of the air-fuel-ratio sensor or the detected air-fuel ratio abyfs); a value which changes in accordance with a difference between the maximum value and the minimum value of the output value Vabyfs of the air-fuel-ratio sensor or the detected air-fuel ratio abyfs within the unit combustion cycle period; and the like.

The inter-cylinder air-fuel-ratio imbalance determination apparatus can determine whether or not an inter-cylinder air-fuel-ratio imbalance state has occurred, by determining whether or not the absolute value of the imbalance determination parameter is greater than a predetermined threshold (an imbalance determination threshold).

However, the present inventors have obtained knowledge that the air-fuel-ratio sensor may fail to have a good responsiveness, for example, in a case where the engine is being operated in a certain operation state, and, in such a case, the above-mentioned imbalance determination parameter fails to represent the degree of the inter-cylinder air-fuel-ratio imbalance state (the difference between the cylinder-by-cylinder air-fuel ratios; the difference between the air-fuel ratio of the imbalanced cylinder and those of the normal cylinders) with sufficient accuracy, and thus, the inter-cylinder air-fuel-ratio imbalance determination cannot be performed accurately.

More specifically, for example, in a case where the quantity of air taken into the engine per unit time (intake air flow rate) is small or a case where the load of the engine is small, the accuracy of the imbalance determination parameter may become unsatisfactory. This point will be described further.

FIG. 5 is a graph showing the responsiveness of the air-fuel-ratio sensor with respect to the intake air flow rate Ga. The responsiveness of the air-fuel-ratio sensor shown in FIG. 5 is represented by a time measured as follows, for example. That is, at a certain point in time, the air-fuel ratio of exhaust gas existing in the vicinity of the air-fuel-ratio sensor is changed from a first air-fuel ratio (e.g., 14), which is richer than the stoichiometric air-fuel ratio, to a second air-fuel ratio (e.g., 15), which is leaner than the stoichiometric air-fuel ratio; and the time is measured, the time being between the certain point in time and a point in time at which the detected air-fuel ratio abyfs changes to a third air-fuel ratio (e.g., $14.63=14+0.63\cdot(15-14)$) which is between the first air-fuel ratio and the second air-fuel ratio. This measured time is also referred to as a "response time t." Accordingly, the responsiveness of the air-fuel-ratio sensor is better (the responsiveness of the air-fuel-ratio sensor is higher) as the response time t becomes shorter.

As is understood from FIG. 5, the responsiveness of the air-fuel-ratio sensor becomes better/higher, as the intake air flow rate Ga becomes greater. This tendency is also observed when the air-fuel ratio of exhaust gas existing in the vicinity of the air-fuel-ratio sensor is changed from the second air-fuel ratio to the first air-fuel ratio. Similarly, it was empirically confirmed that the responsiveness of the air-fuel-ratio sensor becomes better, as the load of the engine (e.g., a value corresponding to the quantity of air taken into a single cylinder during a single intake stroke) becomes larger.

Presumably, such a tendency occurs because the speed of the reaction between oxygen and unburned combustibles at the exhaust-gas-side electrode layer becomes higher as the intake air flow rate Ga (that is, the flow rate of exhaust gas reaching the air-fuel-ratio sensor) becomes larger; and/or the time required for reversal of the direction of oxygen ions passing through the solid electrolyte becomes shorter as the intake air flow rate Ga becomes greater.

Further, in a case where the air-fuel-ratio sensor has a protective cover as described later, the velocity of the exhaust gas within the protective cover becomes higher, as the intake air flow rate Ga, which represents the flow velocity of exhaust gas flowing in the vicinity of the protective cover of the air-fuel-ratio sensor, becomes larger. Accordingly, the responsiveness of the air-fuel-ratio sensor in relation to the air-fuel ratio of exhaust gas in a region where the air-fuel-ratio sensor is disposed increases, as the intake air flow rate Ga is larger.

Accordingly, for example, in a case where the intake air flow rate Ga or the engine load is relatively large, since the responsiveness of the air-fuel-ratio sensor is satisfactory, the imbalance determination parameter obtained on the basis of the output value Vabyfs of the air-fuel-ratio sensor can relatively accurately represent the degree of the inter-cylinder air-fuel-ratio imbalance state.

However, for example, in a case where the intake air flow rate Ga or the engine load is small, since the responsiveness of the air-fuel-ratio sensor is not satisfactory, the output value Vabyfs of the air-fuel-ratio sensor fails to sufficiently follow a fluctuation of the air-fuel ratio of exhaust gas. Accordingly, it becomes difficult for the imbalance determination parameter obtained on the basis of the output value Vabyfs to accurately represent the degree of the inter-cylinder air-fuel-ratio imbalance state.

In addition, in a case where the difference between the air-fuel ratio of the imbalanced cylinder and those of the normal cylinders is relatively small (in particular, in a case where their air-fuel ratios are very close to the stoichiometric air-fuel ratio), it becomes more difficult for the imbalance determination parameter obtained on the basis of the output value Vabyfs of the air-fuel-ratio sensor to accurately represent the degree of the inter-cylinder air-fuel-ratio imbalance state. This is because, as is understood from the relation between the output value Vabyfs and the air-fuel ratio, shown within a broken-line circle indicated by an arrow Yz of FIG. 3, when the air-fuel ratio of exhaust gas to be detected is very close to the stoichiometric air-fuel ratio, the ratio of a change in the output value Vabyfs to an actual change in the air-fuel ratio becomes smaller due to the above-described reaction delay at the exhaust-gas-side electrode layer or the delay time required for reversal of the direction of limiting current.

Moreover, the responsiveness of the air-fuel-ratio sensor changes sensitively in accordance with the temperature of the air-fuel-ratio detection element. Accordingly, when the temperature of the air-fuel-ratio detection element becomes slightly lower than a target temperature, the responsiveness of the air-fuel-ratio sensor drops relatively greatly. In such a situation as well, it becomes difficult for the imbalance determination parameter to accurately represent the degree of the inter-cylinder air-fuel-ratio imbalance state.

As is understood from the above, if inter-cylinder air-fuel-ratio imbalance determination is performed by making use of the imbalance determination parameter obtained on the basis of the output value Vabyfs of the air-fuel-ratio sensor, the inter-cylinder air-fuel-ratio imbalance determination apparatus may fail to determine that an inter-cylinder air-fuel-ratio imbalance state has occurred even when an inter-cylinder air-fuel-ratio imbalance state to be detected has actually occurred.

In view of the above, one of objects of the present invention is to provide an inter-cylinder air-fuel-ratio imbalance determination apparatus which can obtain an imbalance determination parameter, which accurately represents the degree of an inter-cylinder air-fuel-ratio imbalance state, by ingeniously making use of a solid electrolyte layer provided in an air-fuel-ratio detection element of an air-fuel-ratio sensor, to thereby accurately perform inter-cylinder air-fuel-ratio imbalance determination.

An inter-cylinder air-fuel-ratio imbalance determination apparatus according to the present invention (hereinafter also referred to as a "determination apparatus of the present invention") is applied to a multi-cylinder internal combustion engine having a plurality of cylinders.

The determination apparatus of the present invention includes the above-described air-fuel-ratio sensor. This air-fuel-ratio sensor is disposed in an exhaust merging region of an exhaust passage of the engine into which exhaust gases discharged from at least two (preferably, three or more) or more of the cylinders among a plurality of the cylinders merge. Alternatively, this air-fuel-ratio sensor is disposed in the exhaust passage at a location downstream of the exhaust merging region.

The air-fuel-ratio sensor includes an air-fuel-ratio detection element having a solid electrolyte layer, an exhaust-gas-side electrode layer, a diffusion resistance layer, and an atmosphere-side electrode layer. The exhaust-gas-side electrode layer is formed on one surface of the solid electrolyte layer. The diffusion resistance layer is formed so as to cover the exhaust-gas-side electrode layer. Exhaust gas discharged from the engine reaches the diffusion resistance layer. The exhaust gas passes through the diffusion resistance layer and reaches the exhaust-gas-side electrode layer. The atmosphere-side electrode layer is formed on the opposite surface of the solid electrolyte layer so as to face (be opposed to) the exhaust-gas-side electrode layer. The atmosphere-side electrode layer is exposed to an atmosphere chamber. That is, the atmosphere-side electrode layer is in contact with atmospheric air.

The air-fuel-ratio sensor may include a protective cover for accommodating the air-fuel-ratio detection element. This protective cover has an inflow hole through which the exhaust gas flowing through the exhaust passage is introduced into the interior of the protective cover, and an outflow hole through which the exhaust gas introduced into the interior of the protective cover is discharged to the exhaust passage.

As described above, when a voltage is applied between the exhaust-gas-side electrode layer and the atmosphere-side electrode layer, the air-fuel-ratio sensor functions as a known limiting-current-type wide range air-fuel-ratio sensor, and outputs, as a limiting-current-type output value Vabyfs (the above-described output value Vabyfs), a value corresponding to a limiting current flowing through the air-fuel-ratio detection element (in actuality, the solid electrolyte layer). As indicated by the solid line C1 of FIG. 3, the limiting-current-type output value Vabyfs becomes greater, as the air-fuel ratio of the exhaust gas reaching the exhaust-gas-side electrode layer is greater (leaner).

Moreover, when no voltage is applied between the exhaust-gas-side electrode layer and the atmosphere-side electrode layer, the air-fuel-ratio sensor functions as a known concentration-cell-type oxygen concentration sensor, and outputs, as a concentration-cell-type output value VO2, an electromotive force generated by the air-fuel-ratio detection element (in actuality, the solid electrolyte layer).

That is, since the air-fuel-ratio sensor includes the solid electrolyte layer, when no voltage is applied between the exhaust-gas-side electrode layer and the atmosphere-side electrode layer, the air-fuel-ratio sensor functions as an oxygen concentration cell, and generates an electromotive force on the basis of the difference in oxygen concentration (oxygen partial pressure) between the exhaust-gas-side electrode layer and the atmosphere-side electrode layer. As is well known, the electromotive force (the concentration-cell-type output value VO2) at that time changes in accordance with the Nernst equation, as indicated by a broken line C2 in FIG. 3.

That is, the concentration-cell-type output value VO2 becomes a "maximum output value max (e.g., about 0.9 V)" when the air-fuel ratio of the exhaust gas reaching the exhaust-gas-side electrode layer is richer than the stoichiometric air-fuel ratio, becomes a "minimum output value min (e.g., about 0.1 V) smaller than the maximum output value max" when the air-fuel ratio of the exhaust gas reaching the exhaust-gas-side electrode layer is leaner than the stoichiometric air-fuel ratio, and becomes a "voltage Vst (intermediate voltage Vst; e.g., about 0.5 V) which is approximately the middle between the maximum output value max and the minimum output value min" when the air-fuel ratio of the exhaust gas reaching the exhaust-gas-side electrode layer is the stoichiometric air-fuel ratio. This voltage Vst is a value corresponding to the stoichiometric air-fuel ratio (a value indicated by the air-fuel-ratio sensor in a case where exhaust gas whose air-fuel-ratio is equal to the stoichiometric air-fuel ratio continuously reaches the air-fuel-ratio sensor to which the above-mentioned voltage is not applied.)

Furthermore, this concentration-cell-type output value VO2 sharply changes from the maximum output value max to the minimum output value min when the air-fuel ratio of the exhaust gas reaching the exhaust-gas-side electrode layer changes from an "air-fuel ratio slightly richer than the stoichiometric air-fuel ratio" to an "air-fuel ratio slightly leaner than the stoichiometric air-fuel ratio." Similarly, the concentration-cell-type output value VO2 sharply changes from the minimum output value min to the maximum output value max when the air-fuel ratio of the exhaust gas reaching the exhaust-gas-side electrode layer changes from an "air-fuel ratio slightly leaner than the stoichiometric air-fuel ratio" to an "air-fuel ratio slightly richer than the stoichiometric air-fuel ratio." In other words, in a case where the air-fuel ratio of exhaust gas to be detected changes in a region in the vicinity of the stoichiometric air-fuel ratio, the concentration-cell-type output value VO2 greatly changes with respect to a change in the air-fuel ratio of the exhaust gas to be detected, and thus, the concentration-cell-type output value VO2 has a considerably good responsiveness for the change in the air-fuel ratio of the exhaust gas to be detected, as compared with a case where the air-fuel ratio of exhaust gas to be detected changes in a region remote from the stoichiometric air-fuel ratio.

In addition, the determination apparatus of the present invention includes a plurality of fuel injection valves (fuel injectors), voltage application means, wide range feedback control means, imbalance determination parameter obtaining means, and imbalance determination means.

A plurality of the fuel injection valves are disposed in such a manner that each of the injection valves corresponds to each of the above-mentioned at least two or more of the cylinders. Each of the fuel injection valves injects fuel contained in an air-fuel mixture supplied to the combustion chamber of the corresponding cylinder. That is, one or more fuel injection valves are provided for each cylinder. Each fuel injection valve injects fuel to a cylinder corresponding to that fuel injection valve.

The voltage application means realizes, in accordance with an instruction, either one of a voltage applied state in which the above-mentioned voltage is applied between the exhaust-gas-side electrode layer and the atmosphere-side electrode layer and a voltage application stopped state in which the application of the above-mentioned voltage is stopped.

The wide range feedback control means sends to the voltage application means an instruction for realizing the voltage applied state, and obtains the limiting-current-type output value Vabyfs. That is, the wide range feedback control means obtains the output value of the air-fuel-ratio sensor, while it causes the air-fuel-ratio sensor to function as the above-mentioned limiting-current-type wide range air-fuel-ratio sensor.

Further, the wide range feedback control means executes/performs control (that is, wide range feedback control) for adjusting the quantities of fuel injected from a plurality of the fuel injection valves on the basis of the difference between a predetermined target air-fuel ratio abyfr and an air-fuel ratio represented by the obtained limiting-current-type output value Vabyfs (detected air-fuel ratio abyfs) in such a manner that the air-fuel ratio represented by the limiting-current-type output value Vabyfs coincides with the target air-fuel ratio abyfr. Examples of the control include PI control (proportional-integral control) and PID control (proportional-integral-differential control).

The imbalance determination parameter obtaining means sends to the voltage application means an instruction for realizing the voltage application stopped state in place of the instruction for realizing the voltage applied state, and obtains the concentration-cell-type output value VO2. That is, the imbalance determination parameter obtaining means obtains the output value of the air-fuel-ratio sensor, while it causes the air-fuel-ratio sensor to function as the above-mentioned concentration-cell-type oxygen concentration sensor.

Furthermore, the imbalance determination parameter obtaining means obtains an imbalance determination parameter on the basis of the obtained concentration-cell-type output value VO2. The absolute value of the imbalance determination parameter becomes larger, as the difference between the air-fuel ratios of the air-fuel mixtures supplied to the at least two or more of the cylinders (that is, the difference between the cylinder-by-cylinder air-fuel ratios) is larger. The imbalance determination parameter obtained on the basis of the concentration-cell-type output value VO2 will also be referred to as a "concentration-cell-type parameter."

In this case, the imbalance determination parameter obtaining means may send the instruction for realizing the voltage application stopped state in such a manner that the voltage application stopped state is continuously established over a period during which the concentration-cell-type output value VO2 and the concentration-cell-type parameter are obtained. Alternatively, the imbalance determination parameter obtaining means may repeatedly (intermittently or periodically) send the instruction for realizing the voltage application stopped state in such a manner that the voltage applied state and the voltage application stopped state do not overlap each other, in terms of time, in the period during which the concentration-cell-type output value VO2 and the concentration-cell-type parameter are obtained.

As in the case of the above-described imbalance determination parameter obtained on the basis of the limiting-current-type output value Vabyfs (the output value Vabyfs), the concentration-cell-type parameter may be a value which changes in accordance with a value (differential value) obtained by differentiating, with respect to time, the concentration-cell-type output value VO2 (a change amount per unit time in the concentration-cell-type output value VO2), a value which changes in accordance with a value (second-order differential value) obtained by differentiating twice, with respect to time, the concentration-cell-type output value VO2 (a change amount per unit time of the change amount per unit time in the concentration-cell-type output value VO2), a trace length thereof, or the like. That is, the concentration-cell-type parameter may be any parameter which is calculated on the basis of the concentration-cell-type output value VO2 and whose absolute value increases/becomes larger as the degree of fluctuation of the exhaust gas reaching the air-fuel-ratio sensor becomes larger.

The imbalance determination means determines that a state in which the difference between the cylinder-by-cylinder air-fuel ratios is equal to or greater than an allowable value (that is, an inter-cylinder air-fuel-ratio imbalance state to be detected) has occurred, when the absolute value of the obtained concentration-cell-type parameter is greater than a predetermined concentration-cell-type-corresponding imbalance determination threshold. When the concentration-cell-type parameter is a positive value, the concentration-cell-type parameter and the concentration-cell-type-corresponding imbalance determination threshold may be directly compared with each other. When the concentration-cell-type parameter is a negative value, the absolute value of the concentration-cell-type parameter and a positive concentration-cell-type-corresponding imbalance determination threshold may be compared with each other, or the concentration-cell-type parameter and a negative concentration-cell-type-corresponding imbalance determination threshold may be compared with each other. That is, the imbalance determination means is not necessarily required to obtain the absolute value of the concentration-cell-type parameter.

As described above, in the case where the air-fuel ratio of the exhaust gas reaching the exhaust-gas-side electrode layer changes in a region near the stoichiometric air-fuel ratio, the concentration-cell-type output value VO2 changes considerably greatly and quickly in response to the change in the air-fuel ratio of the exhaust gas (that is, responsiveness is good). Furthermore, when an inter-cylinder air-fuel-ratio imbalance state occurs, in general, the air-fuel ratio of the exhaust gas fluctuates across the stoichiometric air-fuel ratio. Accordingly, even when the difference between the air-fuel ratio of the imbalanced cylinder and those of the normal cylinders (the degree of imbalance) is relatively small, the concentration-cell-type output value VO2 changes greatly in accordance with the slight fluctuation of the air-fuel ratio of the exhaust gas, as compared with the limiting-current-type output value Vabyfs.

As a result, as compared with the limiting-current-type parameter obtained on the basis of the current-type output value Vabyfs, which is indicated by a solid line CAF of FIG. 6, the concentration-cell-type parameter obtained on the basis of the concentration-cell-type output value VO2, which is indicated by a broken line Cλ of FIG. 6, increases more greatly as the degree of the inter-cylinder air-fuel-ratio imbalance increases, even when the intake air flow rate Ga is relatively small (for example, the intake air flow rate Ga is equal to Ga1 shown in FIG. 5) and the degree of imbalance is equal to or less than a relatively small value IMB1. In other words, the concentration-cell-type parameter is a value which accurately represents the degree of the inter-cylinder air-fuel-ratio imbalance state. Accordingly, the determination apparatus of the present invention can accurately detect (determine) occurrence of an inter-cylinder air-fuel-ratio imbalance state to be detected (in particular, a state in which the difference between the cylinder-by-cylinder air-fuel ratios is not remarkable but is equal to or greater than the allowable value).

Meanwhile, as described above, in the period during which the concentration-cell-type output value VO2 and the concentration-cell-type parameter are obtained, the voltage applied state and the voltage application stopped state may be established in such a manner that they do not overlap each other in terms of time. This makes it possible to obtain simultaneously (in a time sharing manner) the "limiting-current-type output value Vabyfs for executing/performing the wide range feedback control" and the concentration-cell-type output value VO2 for obtaining the "concentration-cell-type parameter, which is the imbalance determination parameter."

However, in such a aspect, the voltage applied state and the voltage application stopped state are repeated frequently. Therefore, the load (computation load) of the control apparatus may become excessive. Further, immediately after the switching of the voltage application state (that is, immediately after the switching from the voltage applied state to the voltage application stopped state, and immediately after the switching from the voltage application stopped state to the voltage applied state), noise may be superimposed on the concentration-cell-type output value VO2 and the limiting-current-type output value Vabyfs. Therefore, there is a possibility that these values cannot be obtained until the noise attenuates, which may result in delay in various types of controls, or may require a circuit modification to cope with such delay.

A possible measure for avoiding such a problem is simultaneous execution of feedback control of the air-fuel ratio on the basis of the concentration-cell-type output value VO2 (concentration-cell-type feedback control described later) in the period during which the concentration-cell-type output value VO2 and the concentration-cell-type parameter are obtained. This can reduce the frequency of switching between the voltage applied state and the voltage application stopped state by the voltage application means, to thereby solve the problem of computation load and/or the problem caused by noise.

On the other hand, the limiting-current-type output value Vabyfs changes continuously and gradually as the air-fuel ratio of the exhaust gas changes. Accordingly, in the wide range feedback control, the fuel injection quantity can be controlled accurately through PI control, PID control, or the like, which is performed on the basis of the difference between the target air-fuel ratio abyfr and the air-fuel ratio represented by the limiting-current-type output value Vabyfs. That is, the air-fuel ratio feedback control can be performed in accordance with the degree of separation of the actual air-fuel ratio from the stoichiometric air-fuel ratio to have the air-fuel ratio of the engine quickly approach the stoichiometric air-fuel ratio.

In contrast, the concentration-cell-type output value VO2 sharply changes in the vicinity of the stoichiometric air-fuel ratio. Accordingly, in the concentration-cell-type feedback control, the degree of separation of the actual air-fuel ratio from the stoichiometric air-fuel ratio cannot be known, and the feedback control of the air-fuel ratio is performed on the basis of only the result of determination as to whether the actual air-fuel ratio is richer or leaner than the stoichiometric air-fuel ratio.

As is clear from the above-description, the wide range feedback control can control the air-fuel ratio of the engine more accurately than does the concentration-cell-type feedback control. Accordingly, from the view point of reducing emissions, it is advantageous to perform the wide range feedback control as much as possible and not to perform the concentration-cell-type feedback control.

In view of the above, one aspect of the present invention is configured in such a manner that, when it can obtain the concentration-cell-type output value VO2, it can perform air-fuel ratio feedback control using the concentration-cell-type output value VO2 (that is, the concentration-cell-type feedback control). Further, in this aspect, when it can obtain the limiting-current-type output value Vabyfs, it obtains the imbalance determination parameter (the limiting-current-type parameter) based on the limiting-current-type output value Vabyfs, and executes the imbalance determination on the basis of the limiting-current-type parameter. Further, in this aspect, in the case where the air-fuel-ratio sensor functions as the limiting-current-type wide range air-fuel-ratio sensor and its responsiveness is determined to be insufficient, the voltage application stopped state is established so as to obtain the concentration-cell-type output value VO2, and obtainment of the concentration-cell-type parameter and the concentration-cell-type feedback control are performed on the basis of the concentration-cell-type output value VO2.

More specifically, the above-mentioned imbalance determination parameter obtaining means is configured so as to obtain the limiting-current-type output value Vabyfs when the instruction for realizing the voltage applied state is sent to the voltage application means, and obtain, on the basis of the obtained limiting-current-type output value Vabyfs, an imbalance determination parameter (that is, the limiting-current-type parameter), whose absolute value becomes larger as the difference between the cylinder-by-cylinder air-fuel ratios becomes larger, and which is different from the concentration-cell-type parameter.

The above-mentioned imbalance determination means is configured so as to determine that the inter-cylinder air-fuel-ratio imbalance state has occurred when the absolute value of the obtained limiting-current-type parameter is greater than a predetermined limiting-current-type-corresponding imbalance determination threshold.

In addition, the above-mentioned imbalance determination parameter obtaining means is configured so as to include concentration-cell-type feedback control means for executing concentration-cell-type feedback control. The concentration-cell-type feedback control means is configured in such a manner that, when the engine enters a certain operation state in which the air-fuel-ratio sensor functioning as the limiting-current-type wide range air-fuel-ratio sensor cannot have a responsiveness equal to or higher than a predetermined threshold level (the responsiveness becomes lower than a predetermined threshold level), (1) it obtains the concentration-cell-type output value VO2 and the concentration-cell-type parameter by sending (preferably, continuously sending) the instruction for realizing the voltage application stopped state to the voltage application means in place of the instruction for realizing the voltage applied state; and (2) it performs the concentration-cell-type feedback control so as to adjust the quantities of fuel injected from a plurality of the fuel injection valves such that the obtained concentration-cell-type output value VO2 coincides with a target value Vst corresponding to the stoichiometric air-fuel ratio.

The above-described wide range feedback control means is configured so as to stop the wide range feedback control when the concentration-cell-type feedback control is performed.

By virtue of the above-described configuration, in the case where the limiting-current-type parameter obtained on the basis of the limiting-current-type output value Vabyfs allows to clearly determine that the inter-cylinder air-fuel-ratio imbalance state has occurred, the determination that the inter-cylinder air-fuel-ratio imbalance state has occurred can be made in an early stage without obtaining the concentration-cell-type output value VO2 and the concentration-cell-type parameter based on the concentration-cell-type output value VO2.

Moreover, in the case where the engine enters a certain operation state in which the air-fuel-ratio sensor functioning as the limiting-current-type wide range air-fuel-ratio sensor cannot have a responsiveness equal to or higher than the predetermined threshold level (that is, it is presumed that the limiting-current-type output value Vabyfs fails to sufficiently reflect the fluctuation in the air-fuel ratio of the exhaust gas), the voltage application stopped state is realized, the concentration-cell-type output value VO2 is obtained, and the obtainment of the concentration-cell-type parameter and the concentration-cell-type feedback control are performed on the basis of the concentration-cell-type output value VO2.

Accordingly, in the period during which the concentration-cell-type output value VO2 for obtaining the concentration-cell-type parameter is obtained, the air-fuel ratio of the air-fuel mixture supplied to the engine is controlled by the feedback control based on the concentration-cell-type output value VO2. Therefore, it becomes possible to continue the voltage application stopped state, while executing the air-fuel ratio feedback control of the engine. As a result, the computation load of the control apparatus can be reduced, or generation of a control delay can be avoided.

Moreover, the wide range feedback control is executed when the engine is not in the certain operation state, and the concentration-cell-type feedback control is executed when the engine enters the certain operation state. Thus, the frequency of execution of the concentration-cell-type feedback control can be reduced. Accordingly, it is possible to perform accurate inter-cylinder air-fuel-ratio imbalance determination while mitigating deterioration of emission.

More specifically, the certain operation state refers to an operation state in which the intake air flow rate (the quantity of air taken into the engine per unit time) is equal to or less than a predetermined threshold air flow rate, or an operation state in which the load (e.g., load ratio or air filling ratio) of the engine, which is a value corresponding to the quantity of air taken by a single cylinder of the engine in each intake stroke, is equal to or lower than a predetermined threshold load.

In another aspect of the determination apparatus of the present invention, the above-mentioned imbalance determination parameter obtaining means is configured so as to obtain the limiting-current-type output value Vabyfs when the instruction for realizing the voltage applied state is sent to the voltage application means, and obtain, on the basis of the obtained limiting-current-type output value Vabyfs, the imbalance determination parameter (that is, the limiting-current-type parameter) whose absolute value increases as the difference between the cylinder-by-cylinder air-fuel ratios becomes larger, and which is different from the concentration-cell-type parameter.

Furthermore, this imbalance determination parameter obtaining means is configured in such a manner that, when the absolute value of the obtained limiting-current-type parameter is smaller than a predetermined limiting-current-type-corresponding imbalance determination threshold, the imbalance determination parameter obtaining means obtains the concentration-cell-type output value VO2 and the concentration-cell-type parameter by sending (preferably, continuously sending) the instruction for realizing the voltage application stopped state to the voltage application means in place of the instruction for realizing the voltage applied state. In this case, the "condition that the absolute value of the obtained limiting-current-type parameter is smaller than the predetermined limiting-current-type-corresponding imbalance determination threshold" may preferably be a "condition that the absolute value of the obtained limiting-current-type parameter is further smaller than a threshold value (an upper-side threshold value) which is smaller than the predetermined limiting-current-type-corresponding imbalance determination threshold."

In addition, the above-mentioned imbalance determination parameter obtaining means includes concentration-cell-type feedback control means for executing concentration-cell-type feedback control, which is adapted to adjust the quantities of fuel injected from the plurality of fuel injection valves such that the obtained concentration-cell-type output value VO2 coincides with a target value Vst corresponding to the stoichiometric air-fuel ratio.

In this case, the above-described wide range feedback control means is configured so as to stop the wide range feedback control when the concentration-cell-type feedback control is executed.

Moreover, the above-described imbalance determination means is configured so as to determine that the inter-cylinder air-fuel-ratio imbalance state has occurred when the absolute value of the obtained limiting-current-type parameter is greater than the limiting-current-type-corresponding imbalance determination threshold.

That is, in this aspect, in the case where the absolute value of the obtained limiting-current-type parameter is smaller than the predetermined limiting-current-type-corresponding imbalance determination threshold; in other words, in the case where the inter-cylinder air-fuel-ratio imbalance state is not determined to have occurred by means of the imbalance determination based on the limiting-current-type parameter, the voltage application stopped state is realized, and the concentration-cell-type output value VO2 and the concentration-cell-type parameter are obtained.

In a case where the inter-cylinder air-fuel-ratio imbalance state is determined to have occurred by means of the imbalance determination based on the limiting-current-type parameter, execution of the inter-cylinder air-fuel-ratio imbalance determination based on the concentration-cell-type parameter is no longer required. Therefore, according to the above-described aspect, the frequency of execution of the concentration-cell-type feedback control can be reduced. Accordingly, it is possible to perform accurate inter-cylinder air-fuel-ratio imbalance determination while preventing emissions from increasing.

Furthermore, in the period during which the concentration-cell-type output value VO2 for obtaining the concentration-cell-type parameter is obtained, the air-fuel ratio of the engine is controlled by the feedback control based on the concentration-cell-type output value VO2. Therefore, it becomes possible to continue the voltage application stopped state, while executing the air-fuel ratio feedback control of the engine. As a result, the computation load of the control apparatus can be reduced, or generation of control delay can be avoided.

In another aspect of the determination apparatus of the present invention, the above-mentioned imbalance determination parameter obtaining means is configured in such a manner that, when a predetermined concentration-cell-type parameter obtaining condition for obtaining the concentration-cell-type parameter is satisfied, the imbalance determination parameter obtaining means periodically sends the instruction for realizing the voltage application stopped state to the voltage application means, and obtains the concentration-cell-type output value VO2 and the concentration-cell-type parameter when the instruction for realizing the voltage application stopped state is sent to the voltage application means; and the above-mentioned wide range feedback control means is configured in such a manner that, when the concentration-cell-type parameter obtaining condition is satisfied, the wide range feedback control means periodically sends the instruction for realizing the voltage applied state to the voltage application means such that that instruction does not overlap, in terms of time, with the instruction for realizing the voltage application stopped state sent from the imbalance determination parameter obtaining means, and obtains the limiting-current-type output value Vabyfs when the instruction for realizing the voltage applied state is sent to the voltage application means.

According to this aspect, when the predetermined concentration-cell-type parameter obtaining condition for obtaining the concentration-cell-type parameter is satisfied, the air-fuel-ratio sensor is caused to function as the limiting-current-type wide range air-fuel-ratio sensor and the concentration-cell-type oxygen concentration sensor alternately. As a result, it becomes possible to continue the wide range feedback control based on the limiting-current-type output value Vabyfs, while obtaining the concentration-cell-type parameter based on the concentration-cell-type output value VO2 and performing the inter-cylinder air-fuel-ratio imbalance determination based on the concentration-cell-type parameter. This aspect is suitable for a case where the capacity of the control apparatus (in actuality, its CPU) is high, and enables performance of accurate inter-cylinder air-fuel-ratio imbalance determination while maintaining low emission.

Alternatively, in another aspect of the determination apparatus of the present invention, the above-mentioned imbalance determination parameter obtaining means is configured in such a manner that, when a predetermined concentration-cell-type parameter obtaining condition for obtaining the concentration-cell-type parameter is satisfied, the imbalance determination parameter obtaining means "continuously" sends the instruction for realizing the voltage application stopped state to the voltage application means, and obtains the concentration-cell-type output value VO2 and the concentration-cell-type parameter; and the imbalance determination parameter obtaining means includes concentration-cell-type feedback control means for executing concentration-cell-type feedback control, which is adapted to adjust the quantities of fuel injected from a plurality of the fuel injection valves such that the obtained concentration-cell-type output value VO2 coincides with a target value Vst corresponding to the stoichiometric air-fuel ratio.

In this case, the above-described wide range feedback control means is configured so as to stop the wide range feedback control when the concentration-cell-type feedback control is executed.

By virtue of the above-described configuration, when the concentration-cell-type parameter obtaining condition is satisfied, the voltage application stopped state can be continued. Therefore, the computation load of the control apparatus can be reduced, and accurate inter-cylinder air-fuel-ratio imbalance determination can be performed. Further, even in the period during which the concentration-cell-type parameter is obtained, the air-fuel ratio feedback control (concentration-cell-type feedback control) can be performed.

It should be noted that, the above-described "predetermined concentration-cell-type parameter obtaining condition for obtaining the concentration-cell-type parameter" may be a condition which is satisfied when execution of the inter-cylinder air-fuel-ratio imbalance determination is requested and the air-fuel ratio of the engine does not fluctuate due to factors other than the inter-cylinder air-fuel-ratio imbalance state. Furthermore, this concentration-cell-type parameter obtaining condition may be a condition which is satisfied when the engine enters the above-described certain operation state, or a condition which is satisfied when the absolute value of the limiting-current-type parameter is smaller than the limiting-current-type-corresponding imbalance determination threshold.

In these aspects, in a case where the instruction for realizing the voltage application stopped state is sent to the voltage application means or a case where the instruction for realizing the voltage applied state is sent to the voltage application means, in order to obtain the admittance of the air-fuel-ratio detection element used for estimating the temperature of the air-fuel-ratio detection element, an instruction for superimposing a "voltage having a rectangular waveform or a sinusoidal waveform" on the instructions for realizing those states may be periodically superimposed.

MODE FOR CARRYING OUT THE INVENTION

An inter-cylinder air-fuel-ratio imbalance determination apparatus (hereinafter may be simply referred to as a "determination apparatus") for an internal combustion engine according to each of embodiments of the present invention will be described with reference to the drawings. This determination apparatus is a portion of an air-fuel-ratio control apparatus for controlling the air-fuel ratio of gas mixture supplied to the internal combustion engine (the air-fuel ratio of the engine), and also serves as a fuel injection quantity control apparatus for controlling the amount of fuel injection.

First Embodiment

Configuration

Figure 7:
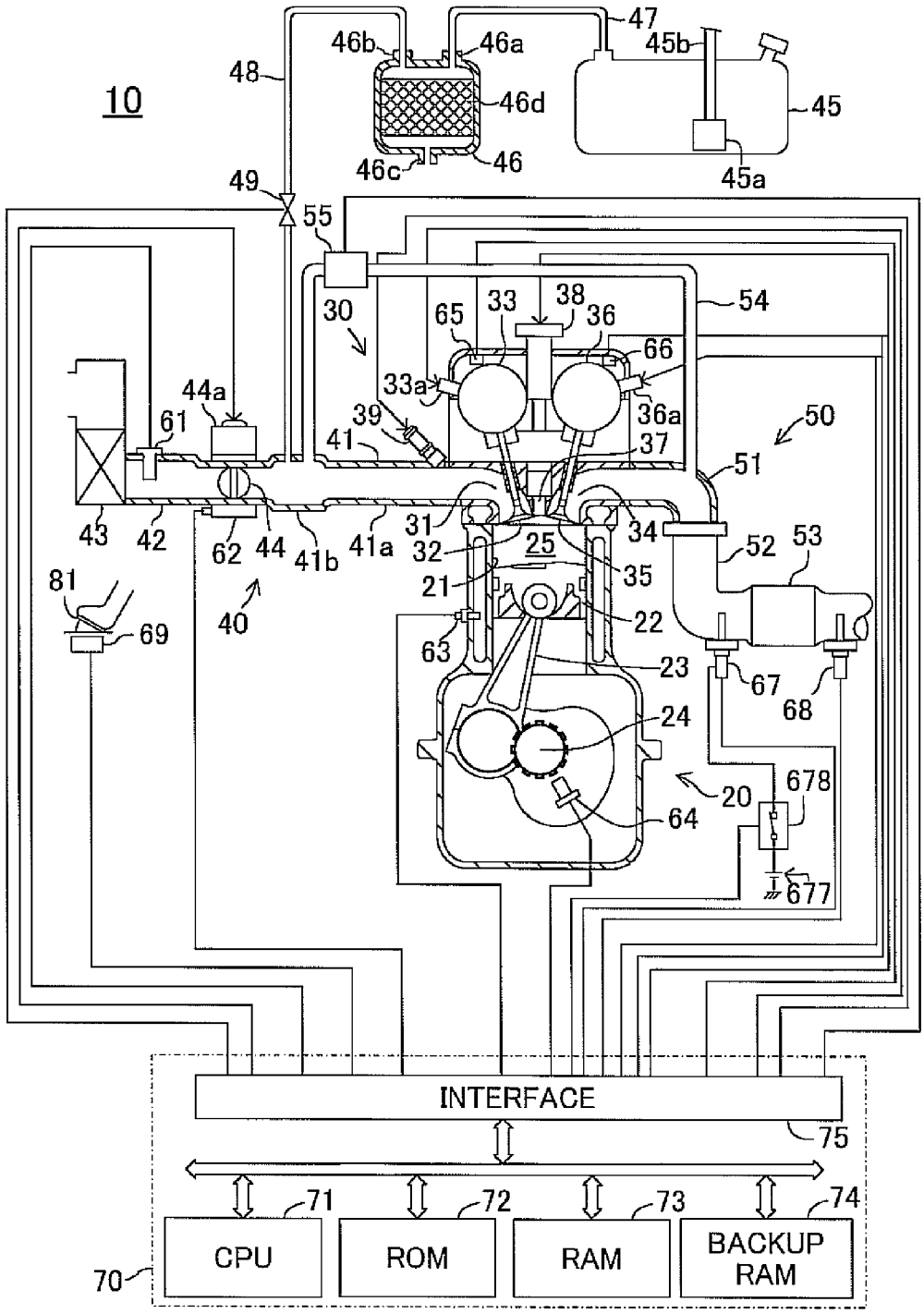
FIG. 7 is a diagram schematically showing the configuration of an internal combustion engine to which the inter-cylinder air-fuel-ratio imbalance determination apparatus according to each of the embodiments of the present invention is applied.

FIG. 7 schematically shows the configuration of a system configured such that a determination apparatus according to a first embodiment (hereinafter also referred to as the "first determination apparatus") is applied to a spark-ignition multi-cylinder (straight 4-cylinder) four-cycle internal combustion engine 10. Although FIG. 7 shows the cross section of a specific cylinder only, the remaining cylinders have the same configuration.

This internal combustion engine 10 includes a cylinder block section 20 including a cylinder block, a cylinder block lower-case, an oil pan, etc.; a cylinder head section 30 fixedly provided on the cylinder block section 20; an intake system 40 for supplying gasoline gas mixture to the cylinder block section 20; and an exhaust system 50 for discharging exhaust gas from the cylinder block section 20 to the exterior of the engine.

The cylinder block section 20 includes cylinders 21, pistons 22, connecting rods 23, and a crankshaft 24. Each of the pistons 22 reciprocates within the corresponding cylinder 21. The reciprocating motion of the piston 22 is transmitted to the crankshaft 24 via the respective connecting rod 23, whereby the crankshaft 24 is rotated. The wall surface of the cylinder 21 and the top surface of the piston 22 form a combustion chamber 25 in cooperation with the lower surface of the cylinder head section 30.

The cylinder head section 30 includes an intake port 31 communicating with the combustion chamber 25; an intake valve 32 for opening and closing the intake port 31; a variable intake timing control apparatus 33 which includes an intake camshaft for driving the intake valve 32 and which continuously changes the phase angle of the intake camshaft; an actuator **33*a* of the variable intake timing control apparatus 33; an exhaust port 34 communicating with the combustion chamber 25; an exhaust valve 35 for opening and closing the exhaust port 34; a variable exhaust timing control apparatus 36 which includes an exhaust camshaft for driving the exhaust valve 35 and which continuously changes the phase angle of the exhaust camshaft; an actuator 36*a* of the variable exhaust timing control apparatus 36; a spark plug 37; an igniter 38 including an ignition coil for generating a high voltage to be applied to the spark plug 37; and a fuel injection valve (fuel injection means; fuel supply means) 39 for injecting fuel into the intake port 31**.

The fuel injection valves (fuel injector) 39 are disposed such that a single fuel injection valve is provided for each combustion chamber 25. The fuel injection valve 39 is provided at the intake portion 31. When the fuel injection valve 39 is normal, in response to an injection instruction signal, the fuel injection valve 39 injects "fuel of a quantity corresponding to an instructed fuel injection quantity contained in the injection instruction signal" into the corresponding intake port 31. As described above, each of a plurality of the cylinders has the fuel injection valve 39 which supplies fuel thereto independently of other cylinders.

The intake system 40 includes an intake manifold 41, an intake pipe 42, an air filter 43, and a throttle valve 44. The intake manifold 41 is composed of a plurality of branch portions 41*a* and a surge tank 41*b*. One end of each branch portion 41*a* is connected to the corresponding intake port 31. The other end of each branch portion 41*a* is connected to the surge tank 41*b*. One end of the intake pipe 42 is connected to the surge tank 41*b*. The air filter 43 is provided at the other end portion of the intake pipe 42. The throttle valve 44 is provided within the intake pipe 42 and adapted to change the opening cross sectional area of the intake passage. The throttle valve 44 is rotated within the intake pipe 42 by a throttle valve actuator 44*a* (a portion of throttle valve drive means) composed of a DC motor.

Furthermore, the internal combustion engine 10 includes a fuel tank 45 for storing liquid gasoline fuel; a canister 46 for absorbing fuel evaporated in the fuel tank 45; a vapor collection pipe 47 for introducing gas containing the evaporated fuel from the fuel tank 45 to the canister 46; a purge flow pipe 48 for introducing the evaporated fuel desorbed from the canister 46 to the surge tank 41*b* as a "evaporated fuel gas"; and a purge control valve 49 disposed in the purge flow pipe 48. The fuel stored in the fuel tank 45 is supplied to the fuel injection valve 39 via a fuel pump 45*a*, a fuel supply pipe 45*b*, etc. The vapor collection pipe 47 and the purge flow pipe 48 constitute a purge passage (a purge passage portion) for supplying the evaporated fuel gas to a merging portion of the intake manifold 41 (an intake passage common among the cylinders) where the plurality of branch portions 41*a* of the intake manifold 41 merge together.

The purge control valve 49 is designed to adjust its opening (open period) in accordance with a drive signal representing a duty ratio DPG (instruction signal), to thereby change the channel cross sectional area of the purge flow pipe 48. The purge control valve 49 is configured such that, when the duty ratio DPG is "0," the purge control valve 49 completely closes the purge flow pipe 48. That is, the purge control valve 49 is disposed in the purge passage, and is configured to change the opening in accordance with the instruction signal.

The canister 46 is a known charcoal canister. The canister 46 includes a housing having a tank port 46*a* connected to the vapor collection pipe 47, a purge port 46*b* connected to the purge flow pipe 48, and an atmosphere port 46*c* exposed to the atmosphere. The canister 46 includes an absorbent 46*d* accommodated in the housing so as to absorb the evaporated fuel.

In periods during which the purge control valve 49 is completely closed, the canister 46 absorbs the evaporated fuel generated within the fuel tank 45. In periods during which the purge control valve 49 is opened, the canister 46 releases the absorbed evaporated fuel, as evaporated fuel gas, to the surge tank 41*b* (intake passage downstream of the throttle valve 44) via the purge flow pipe 48. Thus, the evaporated fuel gas is supplied to each combustion chamber 25 via the intake passage of the engine 10. That is, when the purge control valve 49 is opened, purge of evaporated fuel gas (simply referred to as evaporation purge) is performed.

The exhaust system 50 includes an exhaust manifold 51, an exhaust pipe 52, an upstream catalyst 53, and an unillustrated downstream catalyst. The exhaust manifold 51 has a plurality of branch portions, which are connected at their first ends to the exhaust ports 34 of the cylinders. The exhaust pipe 52 is connected to the second ends of the branch portions of the exhaust manifold 51; i.e., a merging portion (exhaust merging portion) of the exhaust manifold 51 where all the branch portions merge together. The upstream catalyst 53 is disposed in the exhaust pipe 52, and the downstream catalyst is disposed in the exhaust pipe 52 to be located downstream of the upstream catalyst 53. The exhaust ports 34, the exhaust manifold 51, and the exhaust pipe 52 constitute an exhaust passage.

Each of the upstream catalyst 53 and the downstream catalyst is a so-called three-way catalyst unit (exhaust purifying catalyst) carrying an active component formed of a noble metal such as platinum. Each of the catalysts has a function of oxidizing unburned combustibles such as HC, CO, and $H_2$ and reducing nitrogen oxides (NOx) when the air-fuel ratio of gas flowing into each catalyst is the stoichiometric air-fuel ratio. This function is also called a "catalytic function." Furthermore, each catalyst has an oxygen storage function of occluding (storing) oxygen. This oxygen storage function enables removal of the unburned combustibles and the nitrogen oxides even when the air-fuel ratio deviates from the stoichiometric air-fuel ratio. This oxygen storage function is realized by ceria ($CeO_2$) carried by the catalyst.

Moreover, the engine 10 includes an exhaust recirculation system. The exhaust recirculation system includes an exhaust recirculation pipe 54, which constitutes an external EGR passage, and an EGR valve 55.

One end of the exhaust recirculation pipe 54 is connected to the merge portion of the exhaust manifold 51. The other end of the exhaust recirculation pipe 54 is connected to the surge tank 41*b*.

The EGR valve 55 is disposed in the exhaust recirculation pipe 54. The EGR valve 55 contains a DC motor as a drive source. The EGR valve 55 is designed to change its opening in accordance with a duty ratio DEGR (instruction signal for the DC motor), to thereby change the channel cross sectional area of the exhaust recirculation pipe 54.

Meanwhile, this system includes a hot-wire air flowmeter 61, a throttle position sensor 62, a water temperature sensor 63, a crank position sensor 64, an intake-cam position sensor 65, an exhaust-cam position sensor 66, an upstream air-fuel-ratio sensor 67, a downstream air-fuel-ratio sensor 68, and an accelerator opening sensor 69.

The air flowmeter 61 outputs a signal representing the mass flow rate (intake air flow rate) Ga of intake air flowing through the intake pipe 42. That is, the intake air flow rate Ga represents the amount of air taken into the engine 10 per unit time.

The throttle position sensor 62 detects the opening of the throttle valve 44 (throttle valve opening), and outputs a signal representing the detected throttle valve opening TA.

The water temperature sensor 63 detects the temperature of cooling water of the internal combustion engine 10, and outputs a signal representing the detected cooling water temperature THW.

The crank position sensor 64 outputs a signal including a narrow pulse generated every time the crankshaft 24 rotates 10° and a wide pulse generated every time the crankshaft 24 rotates 360°. This signal is converted to an engine rotational speed NE by an electric controller 70, which will be described later.

The intake-cam position sensor 65 outputs a single pulse when the intake camshaft rotates 90 degrees from a predetermined angle, when the intake camshaft rotates 90 degrees after that, and when the intake camshaft further rotates 180 degrees after that. On the basis of the signals from the crank position sensor 64 and the intake-cam position sensor 65, the electric controller 70, which will be described later, obtains the absolute crank angle CA, while using, as a reference, the compression top dead center of a reference cylinder (e.g., the first cylinder). This absolute crank angle CA is set to a "0° crank angle" at the compression top dead center of the reference cylinder, increases up to a 720° crank angle in accordance with the rotational angle of the crank angle, and is again set to the "0° crank angle" at that point in time.

The exhaust-cam position sensor 66 outputs a single pulse when the exhaust camshaft rotates 90 degrees from a predetermined angle, when the exhaust camshaft rotates 90 degrees after that, and when the exhaust camshaft further rotates 180 degrees after that.

Figure 8:
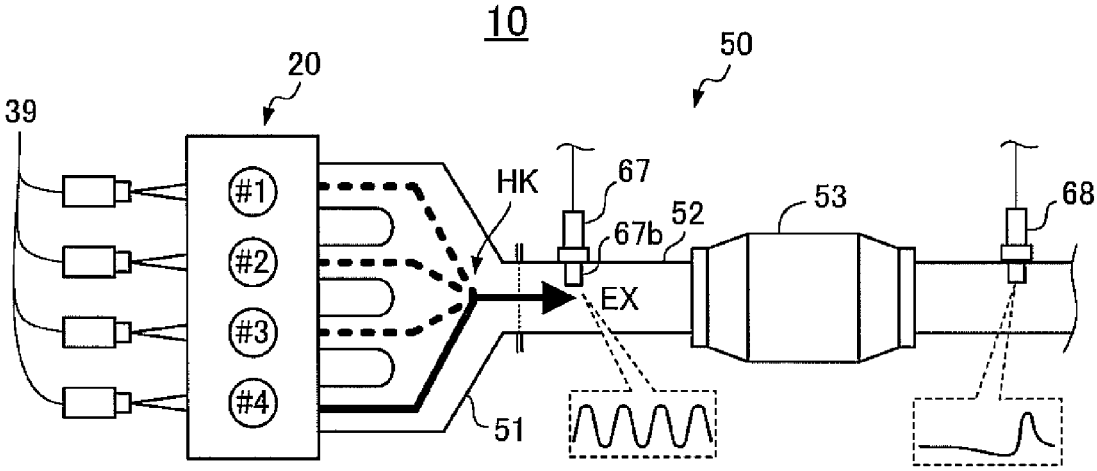
FIG. 8 is a schematic plan view of the engine shown in FIG. 7.

As is also shown in FIG. 8, which is a schematic view of the engine 10, the upstream air-fuel-ratio sensor 67 is disposed on "either one of the exhaust manifold 51 and the exhaust pipe 52 (that is, the exhaust passage)" to be located at a position between the upstream catalyst 53 and the merging portion (exhaust merging portion HK) of the exhaust manifold 51. In the present specification and claims, when the term "air-fuel-ratio sensor" is used solely, it refers to the upstream air-fuel-ratio sensor 67. The air-fuel-ratio sensor 67 is a "limiting-current-type wide range air-fuel-ratio sensor including a diffusion resistance layer" disclosed in, for example, Japanese Patent Application Laid-Open (kokai) Nos. H11-72473, 2000-65782, and 2004-69547.

Figure 9:
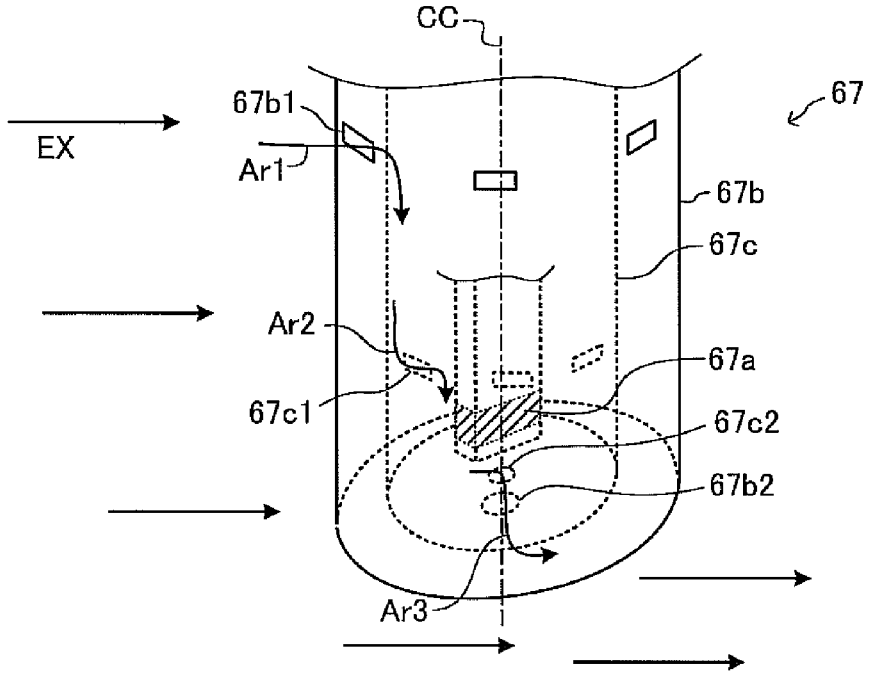
FIG. 9 is a partial schematic perspective view (through-view) of an air-fuel-ratio sensor (upstream air-fuel-ratio sensor) shown in FIGS. 7 and 8.
Figure 10:
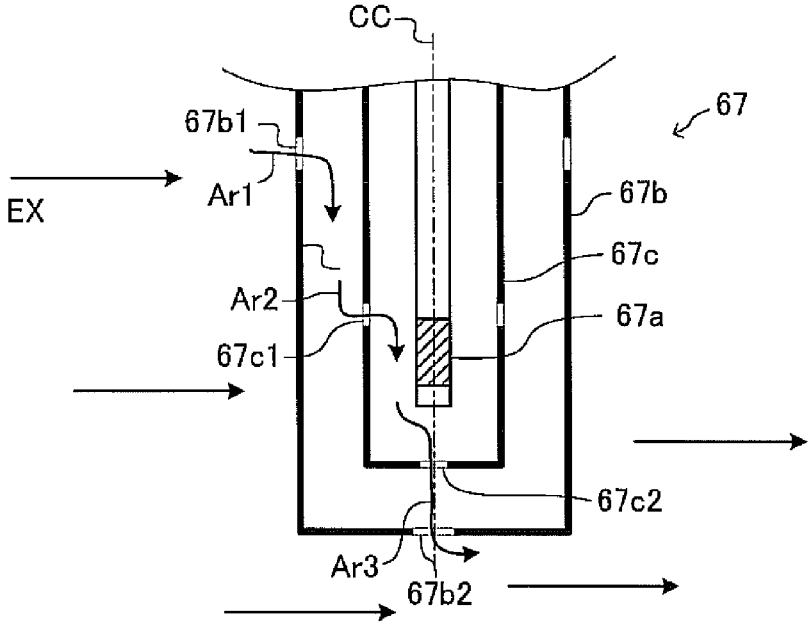
FIG. 10 is a partial sectional view of the air-fuel-ratio sensor shown in FIGS. 7 and 8.

As shown in FIGS. 9 and 10, the air-fuel-ratio sensor 67 includes an air-fuel-ratio detection element 67*a*, an outer protective cover 67*b*, and an inner protective cover 67*c*.

The outer protective cover 67*b* is a hollow cylinder formed of metal. The outer protective cover 67*b* accommodates the inner protective cover 67*c* so as to cover it. The outer protective cover 67*b* has a plurality of inflow holes 67*b*1 formed in its peripheral wall. The inflow holes 67*b*1 are through holes for allowing the exhaust gas EX (the exhaust gas which is present outside the outer protective cover 67*b*) flowing through the exhaust passage to flow into the space inside the outer protective cover 67*b*. Further, the outer protective cover 67*b* has an outflow hole 67*b*2 formed in its bottom wall so as to allow the exhaust gas to flow from the space inside the outer protective cover 67*b* to the outside (exhaust passage).

The inner protective cover 67*c* formed of metal is a hollow cylinder whose diameter is smaller than that of the outer protective cover 67*b*. The inner protective cover 67*c* accommodates an air-fuel-ratio detection element 67*a* so as to cover it. The inner protective cover 67*c* has a plurality of inflow holes 67*c*1 in its peripheral wall. The inflow holes 67*c*1 are through holes for allowing the exhaust gas—which has flowed into the "space between the outer protective cover 67*b* and the inner protective cover 67*c*" through the inflow holes 67*b*1 of the outer protective cover 67*b*—to flow into the space inside the inner protective cover 67*c*. In addition, the inner protective cover 67*c* has an outflow hole 67*c*2 formed in its bottom wall so as to allow the exhaust gas to flow from the space inside the inner protective cover 67*c* to the outside.

The air-fuel-ratio sensor 67 is disposed in the exhaust passage in such a manner that the bottom walls of the protective covers (67*b* and 67*c*) are parallel to the flow of the exhaust gas EX and the central axis CC of the protective covers (67*b* and 67*c*) is perpendicular to the flow of the exhaust gas EX. This allows the exhaust gas EX—which has reached the inflow holes 67*b*1 of the outer protective cover 67*b*—to be sucked into the space inside the outer protective cover 67*b* and then into the space inside the inner protective cover 67*c*, due to the flow of the exhaust gas EX in the exhaust passage, which flows near the outflow hole 67*b*2 of the outer protective cover 67*b*.

Thus, as indicated by the arrow Ar1 shown in FIG. 9 and FIG. 10, the exhaust gas EX flowing through the exhaust passage flows into the space between the outer protective cover 67*b* and the inner protective cover 67*c* through the inflow holes 67*b*1 of the outer protective cover 67*b*. Subsequently, as indicated by the arrow Ar2, the exhaust gas flows into the "the space inside the inner protective cover 67*c*" through the "inflow holes 67*c*1 of the inner protective cover 67*c*," and then reaches the air-fuel-ratio detection element 67*a*. Thereafter, as indicated by the arrow Ar3, the exhaust gas flows out to the exhaust passage through the "outflow hole 67*c*2 of the inner protective cover 67*c* and the outflow hole 67*b*2 of the outer protective cover 67*b*."

Accordingly, the flow rates of the exhaust gas within the "outer protective cover 67*b* and the inner protective cover 67*c*" changes in accordance with the flow rate of the exhaust gas EX flowing near the outflow hole 67*b*2 of the outer protective cover 67*b* (i.e., an intake air flow rate Ga representing the intake air quantity per unit time).

In other words, the "exhaust gas which has reached an inflow hole 67*b*1 at a certain point in time" reaches the air-fuel-ratio detection element 67*a* later than that point. The delay in arrival of the exhaust gas EX increases as the intake air flow rate Ga representing the flow velocity of the exhaust gas EX decreases.

Figure 1:
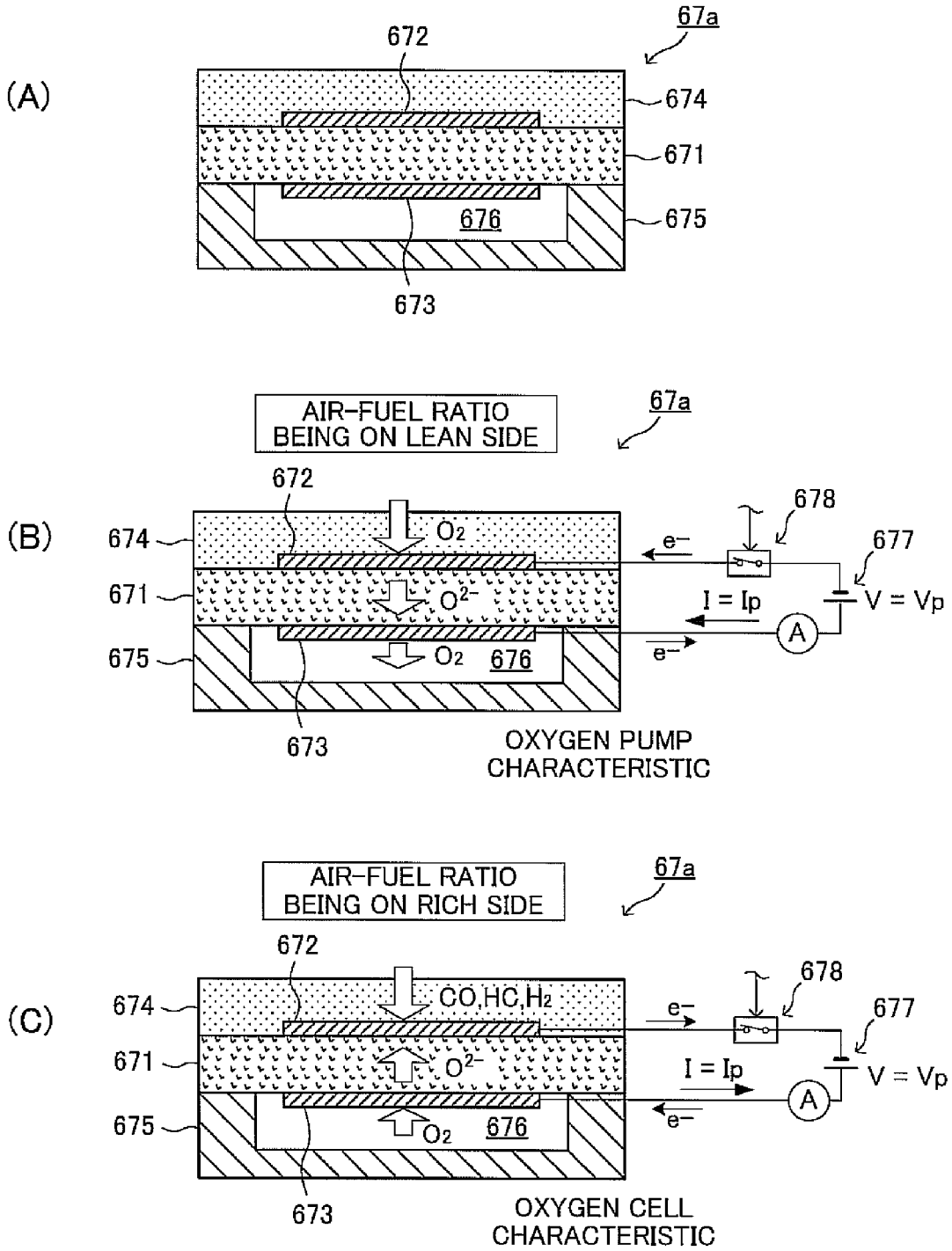
FIG. 1 Sections (A) to (C) of FIG. 1 are schematic sectional views of an air-fuel-ratio detection element provided in an air-fuel-ratio sensor used by an inter-cylinder air-fuel-ratio imbalance determination apparatus according to each of embodiments of the present invention.

As shown in FIG. 1 (A) to (c), the air-fuel-ratio detection element 67*a* includes a solid electrolyte layer 671, an exhaust-gas-side electrode layer 672, an atmosphere-side electrode layer 673, a diffusion resistance layer 674, and a partition 675.

The solid electrolyte layer 671 is formed of an oxygen-ion-conductive sintered oxide. In this embodiment, the solid electrolyte layer 671 is a "stabilized zirconia element" which is a solid solution of ZrO2 (zirconia) and CaO (stabilizer). The solid electrolyte layer 671 exhibits an "oxygen cell property" and an "oxygen pump property," which are well known, when its temperature is equal to or higher the activation temperature thereof.

The exhaust-gas-side electrode layer 672 is formed of a noble metal having a high catalytic activity, such as platinum (Pt). The exhaust-gas-side electrode layer 672 is formed on a first surface of the solid electrolyte layer 671. The exhaust-gas-side electrode layer 672 is formed through chemical plating, etc. so as to exhibit a sufficient degree of permeability (that is, it is formed into a porous layer). The exhaust-gas-side electrode layer 672 generates an equilibrated gas through the reaction between oxygen and unburned substances contained in the exhaust gas which has reached the exhaust-gas-side electrode layer 672.

The atmosphere-side electrode layer 673 is formed of a noble metal having a high catalytic activity, such as platinum (Pt). The atmosphere-side electrode layer 673 is formed on a second surface of the solid electrolyte layer 671 in such a manner it faces the exhaust-gas-side electrode layer 672 across the solid electrolyte layer 671. The atmosphere-side electrode layer 673 is formed through chemical plating, etc. so as to exhibit adequate permeability (that is, it is formed into a porous layer).

The diffusion resistance layer (diffusion-controlling layer) 674 is formed of a porous ceramic material (heat-resistant inorganic material). The diffusion resistance layer 674 is formed through, for example, plasma spraying in such a manner that it covers the outer surface of the exhaust-gas-side electrode layer 672.

The partition block 675 is formed of dense and gas-non-permeable alumina ceramic. The partition 675 is configured so as to form an "atmospheric chamber 676" which accommodates the atmosphere-side electrode layer 673. Air is introduced into the atmospheric chamber 676.

A power supply 677 is connected "between the exhaust-gas-side electrode layer 672 and the atmosphere-side electrode layer 673" of the air-fuel-ratio sensor 67 via a changeover switch (voltage application changeover means)

678. The power supply 677 applies a voltage V (=Vp) so that the atmosphere-side electrode layer 673 is held at a high potential and the exhaust-gas-side electrode layer 672 is held at a low potential. The changeover switch 678 is designed to open or close in response to an instruction sent from the electric controller 70 shown in FIG. 7.

Namely, the power supply 677 and the changeover switch 678 constitute voltage application means which, in response to an instruction, creates either of the two states; a "voltage applied state" in which a voltage Vp is applied between the exhaust-gas-side electrode layer 672 and the atmosphere-side electrode layer 673; and a "voltage application stopped state" in which application of the voltage Vp between the exhaust-gas-side electrode layer 672 and the atmosphere-side electrode layer 673 is stopped.

The air-fuel-ratio sensor 67 having the above-mentioned structure functions as a limiting-current-type wide range air-fuel-ratio sensor when it is in the voltage applied state created by the closing of the changeover switch 678, and outputs a value corresponding to the limiting current flowing through the air-fuel-ratio detection element 67*a* (solid electrolyte layer 671).

Figure 2:
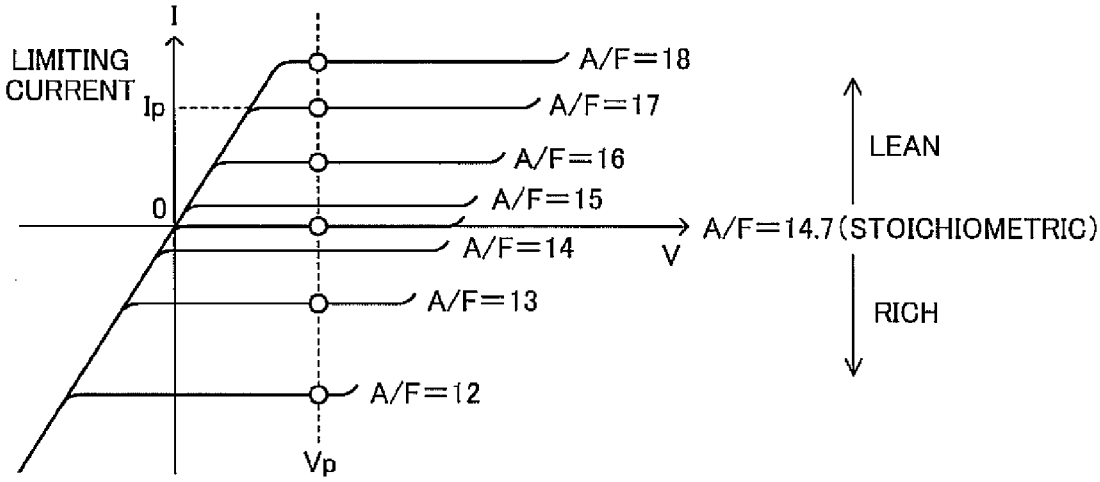
FIG. 2 is a graph showing the relation between the air-fuel ratio of exhaust gas and the limiting current of an air-fuel-ratio sensor.

More specifically, as shown in FIG. 1 (B), if the air-fuel ratio of the exhaust gas is on the lean side in relation to the stoichiometric air-fuel ratio, the air-fuel-ratio detection element 67*a* ionizes the excessive oxygen (the oxygen in the equilibrated gas) contained in the "exhaust gas that has reached the exhaust-gas-side electrode layer 672 through the diffusion resistance layer 674," and leads the ionized oxygen to the atmosphere-side electrode layer 673. As a result, a current I flows from the positive terminal of the power supply 677, through the solid electrolyte layer 671, to the negative terminal of the power supply 677. As shown in FIG. 2, if the voltage V is set to a voltage higher than the predetermined voltage Vp, the magnitude of the current I becomes a constant value which is proportional to the concentration of the excessive oxygen contained in the exhaust gas which has reached the exhaust-gas-side electrode layer 672 (the oxygen partial pressure of the equilibrated gas; namely, the air-fuel ratio of the exhaust gas). The air-fuel-ratio sensor 67 converts this current (i.e., limiting current Ip) to a voltage value, and outputs it as an output value Vabyfs.

In contract, as shown in FIG. 1 (C), if the air-fuel ratio of the exhaust gas is on the rich side in relation to the stoichiometric air-fuel ratio, the air-fuel-ratio detection element 67*a* ionizes the oxygen in the atmospheric chamber 676 and leads the ionized oxygen to the exhaust-gas-side electrode layer 672 so as to oxidize the excessive unburned substances (HC, CO, $H_2$, etc. in the equilibrated gas) contained in the exhaust gas which has reached the exhaust-gas-side electrode layer 672 through the diffusion resistance layer 674. As a result, a current I flows from the negative terminal of the power supply 677, through the solid electrolyte layer 671, to the positive terminal of the power supply 677. As shown in FIG. 2, if the voltage V is set to the predetermined voltage Vp, the magnitude of this current I also becomes a constant value which is proportional to the concentration of the excessive unburned substances which have reached the exhaust-gas-side electrode layer 672 (i.e., the air-fuel ratio of the exhaust gas). The air-fuel-ratio sensor 67 converts this current (i.e., limiting current Ip) to a voltage value, and outputs it as an output value Vabyfs.

Figure 3:
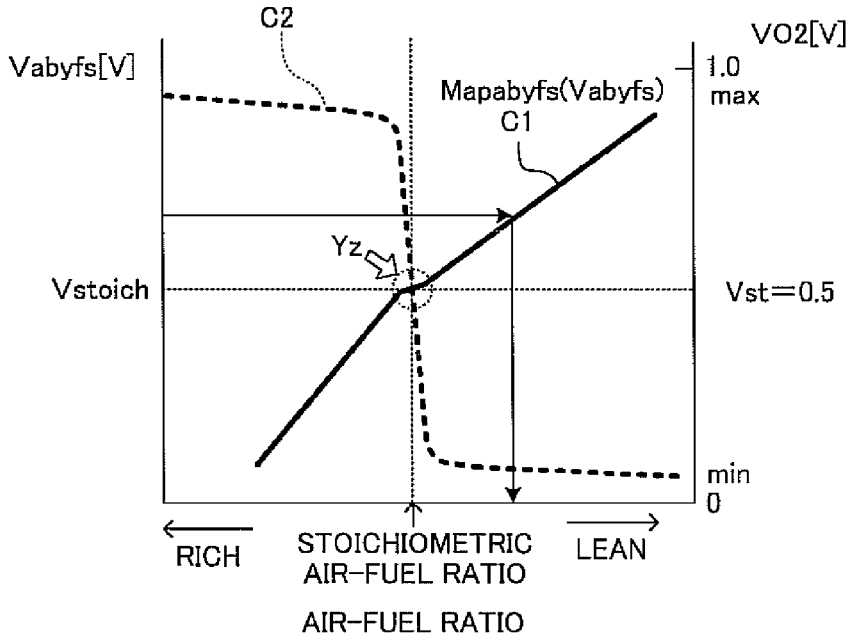
FIG. 3 is a graph showing the relation between the air-fuel ratio of exhaust gas and the output value (limiting-current-type output value and concentration-cell-type output value) of the air-fuel-ratio sensor.

Accordingly, as indicated by the solid line C1 in FIG. 3 (air-fuel ratio conversion table Mapabyfs), the air-fuel-ratio detection element 67*a* outputs, as an "air-fuel-ratio sensor output," the output value Vabyfs corresponding to the air-fuel ratio of the gas which flows over the position where the air-fuel-ratio sensor 67 is disposed and reaches the air-fuel-ratio detection element 67*a* through the inflow holes 67*b*1 of the outer protective cover 67*b* and the inflow holes 67*c*1 of the inner protective cover 67*c*. This output value Vabyfs is referred to as the "limiting-current-type output value Vabyfs" for the sake of convenience.

The higher the air-fuel ratio of the gas reaching the air-fuel-ratio detection element 67*a* (the greater the degree of shift of the air-fuel ratio toward the lean side), the greater the limiting-current-type output value Vabyfs. In other words, the limiting-current-type output value Vabyfs is substantially proportionate to the air-fuel ratio of the exhaust gas reaching the air-fuel-ratio detection element 67*a*. The limiting-current-type output value Vabyfs coincides with a stoichiometric air-fuel-ratio equivalent value Vstoich when the air-fuel ratio of the gas reaching the air-fuel-ratio detection element 67*a* is the stoichiometric air-fuel ratio.

As shown in the dashed circle indicated by the arrow Yz in FIG. 3, when the air-fuel ratio of the gas reaching the air-fuel-ratio detection element 67*a* is in the vicinity of the stoichiometric air-fuel ratio, the amount of change in the limiting-current-type output value Vabyfs per unit amount of change in the air-fuel ratio of the gas reaching the air-fuel-ratio detection element 67*a* differs greatly from the stoichiometric air-fuel ratio. Presumably, the reason is that, when the air-fuel ratio of the gas reaching the air-fuel-ratio detection element 67*a* is in the vicinity of the stoichiometric air-fuel ratio, the air-fuel-ratio detection element 67*a* is in a transition state in which the direction of the flow of the oxygen ion in the solid electrolyte layer changes.

The electric controller 70 stores the air-fuel ratio conversion table Mapabyfs indicated by the solid line C1 in FIG. 3, and applies the limiting-current-type output value Vabyfs to the air-fuel ratio conversion table Mapabyfs to obtain an actual upstream-side air-fuel ratio abyfs (limiting-current-type detected air-fuel ratio abyfs).

Moreover, when the voltage V (=Vp) is not applied between the exhaust-gas-side electrode layer 672 and the atmosphere-side electrode layer 673, the air-fuel-ratio sensor 67 functions as a "well-known concentration-cell-type oxygen concentration sensor (electromotive-force-type $O_2$ sensor)," and outputs, as a concentration-cell-type output value VO2, the electromotive force generated by the air-fuel-ratio detection element 67*a* (actually, the solid electrolyte layer 671).

That is, the air-fuel-ratio sensor 67 includes the solid electrolyte layer 671. Therefore, when the voltage V (=Vp) is not applied between the exhaust-gas-side electrode layer 672 and the atmosphere-side electrode layer 673, the air-fuel-ratio sensor 67 generates an electromotive force corresponding to the difference in oxygen concentration between the exhaust-gas-side electrode layer 672 and the atmosphere-side electrode layer 673, and outputs the generated electromotive force as a "concentration-cell-type output value VO2." As is well known, this concentration-cell-type output value VO2 changes in accordance with the Nernst equation as indicated by the broken line C2 in FIG. 3.

More specifically, the concentration-cell-type output value VO2 becomes a "maximum output value max (e.g., about 0.9 V)" when the air-fuel ratio of the exhaust gas reaching the exhaust-gas-side electrode layer 672 is on the rich side in relation to the stoichiometric air-fuel ratio. The concentration-cell-type output value VO2 becomes a "minimum output value min (e.g., about 0.1 V) which is less than the maximum output value max" when the air-fuel ratio of the exhaust gas reaching the exhaust-gas-side electrode layer 672 is on the lean side in relation to the stoichiometric air-fuel ratio. The concentration-cell-type output value VO2 becomes a "value (voltage value) Vst (midpoint voltage Vst, e.g., about 0.5 V) which is approximately the midpoint value between the maximum output value max and the minimum output value min" when the air-fuel ratio of the exhaust gas reaching the exhaust-gas-side electrode layer 672 is the stoichiometric air-fuel ratio. This voltage Vst corresponds to the stoichiometric air-fuel ratio (a voltage which is output from the air-fuel-ratio sensor 67 when exhaust gas whose air-fuel ratio is equal to the stoichiometric air-fuel ratio is continuously reaching the air-fuel-ratio sensor 67, to which the voltage V is not applied).

Furthermore, this concentration-cell-type output value VO2 changes suddenly from the maximum output value max to the minimum output value min when the air-fuel ratio of the exhaust gas reaching the exhaust-gas-side electrode layer 672 changes from an "air-fuel ratio which slightly deviates toward the rich side from the stoichiometric air-fuel ratio" to an "air-fuel ratio which slightly deviates toward the lean side from the stoichiometric air-fuel ratio." Similarly, the concentration-cell-type output value VO2 changes suddenly from the minimum output value min to the maximum output value max when the air-fuel ratio of the exhaust gas reaching the exhaust-gas-side electrode layer 672 changes from an "air-fuel ratio which slightly deviates toward the lean side from the stoichiometric air-fuel ratio" to an "air-fuel ratio which slightly deviate toward the rich side from the stoichiometric air-fuel ratio."

As mentioned above, when the air-fuel ratio of the exhaust gas reaching the exhaust-gas-side electrode layer 672 changes in a region in the vicinity of the stoichiometric air-fuel ratio, the concentration-cell-type output value VO2 changes quite greatly with high responsiveness as compared with the case where the air-fuel ratio of the exhaust gas reaching the exhaust-gas-side electrode layer 672 changes in a region away from the stoichiometric air-fuel ratio.

Figure 11:
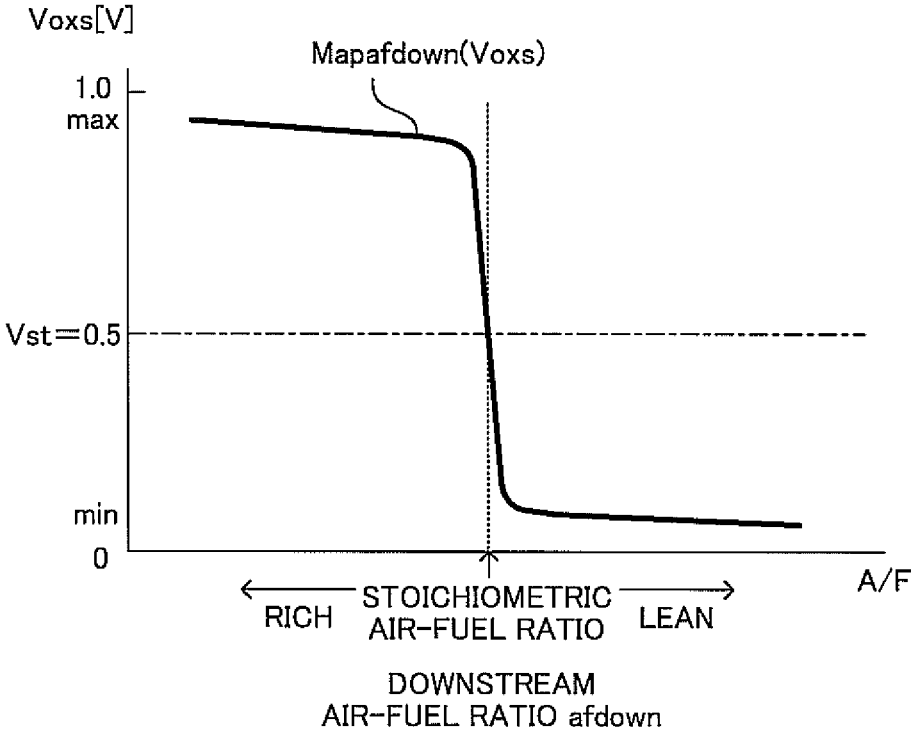
FIG. 11 is a graph showing the relation between the air-fuel ratio of exhaust gas and the output value of the downstream air-fuel-ratio sensor shown in FIGS. 7 and 8.

Referring back to FIG. 7, the downstream-side air-fuel-ratio sensor 68 is disposed in the exhaust pipe 52, specifically downstream of an upstream catalyst 53 and upstream of a downstream catalyst not illustrated in FIG. 7 (i.e., in the exhaust passage between the upstream catalyst 53 and the downstream catalyst). The downstream-side air-fuel-ratio sensor 68 is a concentration-cell-type oxygen concentration sensor mentioned above. The downstream-side air-fuel-ratio sensor 68 is designed to generate an output value Voxs corresponding to the air-fuel ratio of a gas to be detected; i.e., the gas which flows through a portion of the exhaust passage where the downstream-side air-fuel-ratio sensor 68 is disposed (that is, the air-fuel ratio of the gas which flows out of the upstream catalyst 53 and flows into the downstream catalyst; namely, the time average of the air-fuel ratio of the air-fuel mixture supplied to the engine). As shown in FIG. 11, this output value Voxs changes just like the concentration-cell-type output value VO2.

The accelerator opening sensor 69 shown in FIG. 7 is designed to output a signal which indicates the operation amount Accp of the accelerator pedal 81 operated by the driver (accelerator pedal operation amount Accp). The accelerator pedal operation amount Accp increases as the driver presses the accelerator pedal 81 deeper (accelerator pedal operation amount).

The electric controller 70 is a well-known microcomputer which includes a CPU 71; a ROM 72 in which a program executed by the CPU 71, tables (maps and/or functions), constants, etc. are stored in advance; a RAM 73 in which the CPU 71 temporarily stores data as needed; a backup RAM 74; and an interface 75 which includes an AD converter, etc. These components are mutually connected via a bus.

The backup RAM 74 is constantly powered from the onboard battery irrespective of the position (one of OFF position, START position, ON position, etc.) of the ignition key (not illustrated in FIG. 7) of the vehicle equipped with the engine 10. When powered from the battery, the backup RAM 74 stores data (data is written) in response to an instruction from the CPU 71, and retains (stores) the data so that it can be read out.

The interface 75 is connected to sensors 61 to 69 so as to send signals from these sensors to the CPU 71. In addition, the interface 75 is designed to send drive signals (instruction signals) to an actuator 33*a* of a variable intake timing controller 33, an actuator 36*a* of a variable exhaust timing controller 36, igniters 38 of individual cylinders, fuel injection valves 39 provided for individual cylinders, a throttle valve actuator 44*a*, a purge control valve 49, an EGR value 55, a changeover switch 678, etc. in response to instructions from the CPU 71.

The electric controller 70 is designed to send an instruction signal to the throttle valve actuator 44*a* so that the throttle valve opening TA increases as the obtained accelerator pedal operation amount Accp increases. That is, the electric controller 70 has throttle valve drive means for changing the opening of a "throttle valve 44 disposed in the intake passage of the engine 10" in accordance with the acceleration operation amount (accelerator pedal operation amount Accp) of the engine 10 which is changed by the driver.

(Principle of Inter-Cylinder Air-Fuel-Ratio Imbalance Determination)

Next, there will be described the principle of "inter-cylinder air-fuel-ratio imbalance determination" employed by the first determination apparatus and determination apparatuses according to other embodiments (hereinafter referred to as the "first determination apparatus, etc."). The first determination apparatus, etc. determine whether or not the difference in air-fuel ratio between an imbalanced cylinder and the remaining balanced cylinders exceeds a "limit which should not be exceeded for proper emission" (whether or not impermissible imbalance has occurred among the air-fuel ratios of the cylinders; namely, whether or not the inter-cylinder air-fuel-ratio imbalance state has occurred) using an imbalance determination parameter computed on the basis of the output value of the air-fuel-ratio sensor 67.

The first determination apparatus, etc. send out an instruction signal to the changeover switch 678 in accordance with the operation state, etc. of the engine 10 so as to produce one of the two states, "a voltage applied state in which the voltage Vp is applied and a voltage application stopped state in which application of the voltage Vp is stopped," "between the exhaust-gas-side electrode layer 672 and the atmosphere-side electrode layer 673." That is, the first determination apparatus, etc. cause the air-fuel-ratio sensor 67 to function as a limiting-current-type wide range air-fuel-ratio sensor at a certain point and to function as a concentration-cell-type oxygen concentration sensor at another point.

In addition, the first determination apparatus, etc. obtain the output value of the air-fuel-ratio sensor 67 placed in the voltage applied state as a limiting-current-type output value Vabyfs, and obtains the "limiting-current-type parameter which is an imbalance determination parameter" on the basis of the limiting-current-type output value Vabyfs. Furthermore, the first determination apparatus, etc. obtain the output value of the air-fuel-ratio sensor 67 placed in the voltage application stopped state as a concentration-cell-type output value VO2, and obtains the "concentration-cell-type parameter which is an imbalance determination parameter" on the basis of the concentration-cell-type output value VO2. Note that the first determination apparatus, etc. may perform imbalance determination on the basis of the concentration-cell-type parameter only without obtaining the limiting-current-type parameter.

In addition, when the limiting-current-type parameter has been obtained successfully, the first determination apparatus, etc. determine that "the inter-cylinder air-fuel-ratio imbalance state has occurred" if the limiting-current-type parameter (the absolute value of the limiting-current-type parameter) is larger than the limiting-current-type-corresponding imbalance determination threshold.

In addition, when the concentration-cell-type parameter has been obtained successfully, the first determination apparatus, etc. determine that "the inter-cylinder air-fuel-ratio imbalance state has occurred" if the concentration-cell-type parameter (the absolute value of the concentration-cell-type parameter) is larger than the concentration-cell-type-corresponding imbalance determination threshold.

The method for obtaining the limiting-current-type parameter from the limiting-current-type output value Vabyfs is the same as the method for obtaining the concentration-cell-type parameter from the concentration-cell-type output value VO2. Therefore, hereafter there will be described only the method for obtaining the limiting-current-type parameter.

The first determination apparatus, etc. obtain the "amount of change per unit time (predetermined sampling interval ts)" of the limiting-current-type output value Vabyfs. If the unit time is very short, e.g., about 4 ms, the "amount of change per unit time of the limiting-current-type output value Vabyfs" can also be said as a time differentiated value d(Vabyfs)/dt of the limiting-current-type output value Vabyfs. Accordingly, hereinafter, the "amount of change per unit time of the limiting-current-type output value Vabyfs" will simply be referred to be as a "differentiated value d(Vabyfs)/dt of the limiting-current-type output value Vabyfs" or more simply a "differentiated value d(Vabyfs)/dt."

Exhaust gases from individual cylinders reach the air-fuel-ratio sensor 67 in the order of ignition (namely, in the order of exhaust). If the inter-cylinder air-fuel-ratio imbalance state has not been produced, the air-fuel ratios of the exhaust gases which are emitted from the respective cylinders and reach the air-fuel-ratio sensor 67 are almost the same. Accordingly, when the inter-cylinder air-fuel-ratio imbalance state has not been produced, the limiting-current-type output value Vabyfs changes, for example, as indicated by the broken line C1 in FIG. 12 (B). That is, when the inter-cylinder air-fuel-ratio imbalance state has not been produced, the waveform of the limiting-current-type output value Vabyfs is nearly flat. Hence, as can be understood from the broken line C3 in FIG. 12 (C), when the inter-cylinder air-fuel-ratio imbalance state has not been produced, the absolute value of the differentiated value d(Vabyfs)/dt of the limiting-current-type output value Vabyfs is small.

Meanwhile, when the properties of a "fuel injection valve 39 which injects fuel into a specific cylinder (e.g., the first cylinder)" has changed so that "fuel is injected in a quantity greater than the instructed fuel injection quantity," and consequently there has occurred the "inter-cylinder air-fuel-ratio imbalance state (specific-cylinder rich-side-deviated imbalance state)" in which only the air-fuel ratio of the specific cylinder is greatly shifted to the rich side from the stoichiometric air-fuel ratio, a great difference is produced between the air-fuel ratio of the specific cylinder (the air-fuel ratio of the imbalanced cylinder) and the air-fuel ratios of the remaining cylinders (air-fuel ratios of the balanced cylinders).

Figure 12:
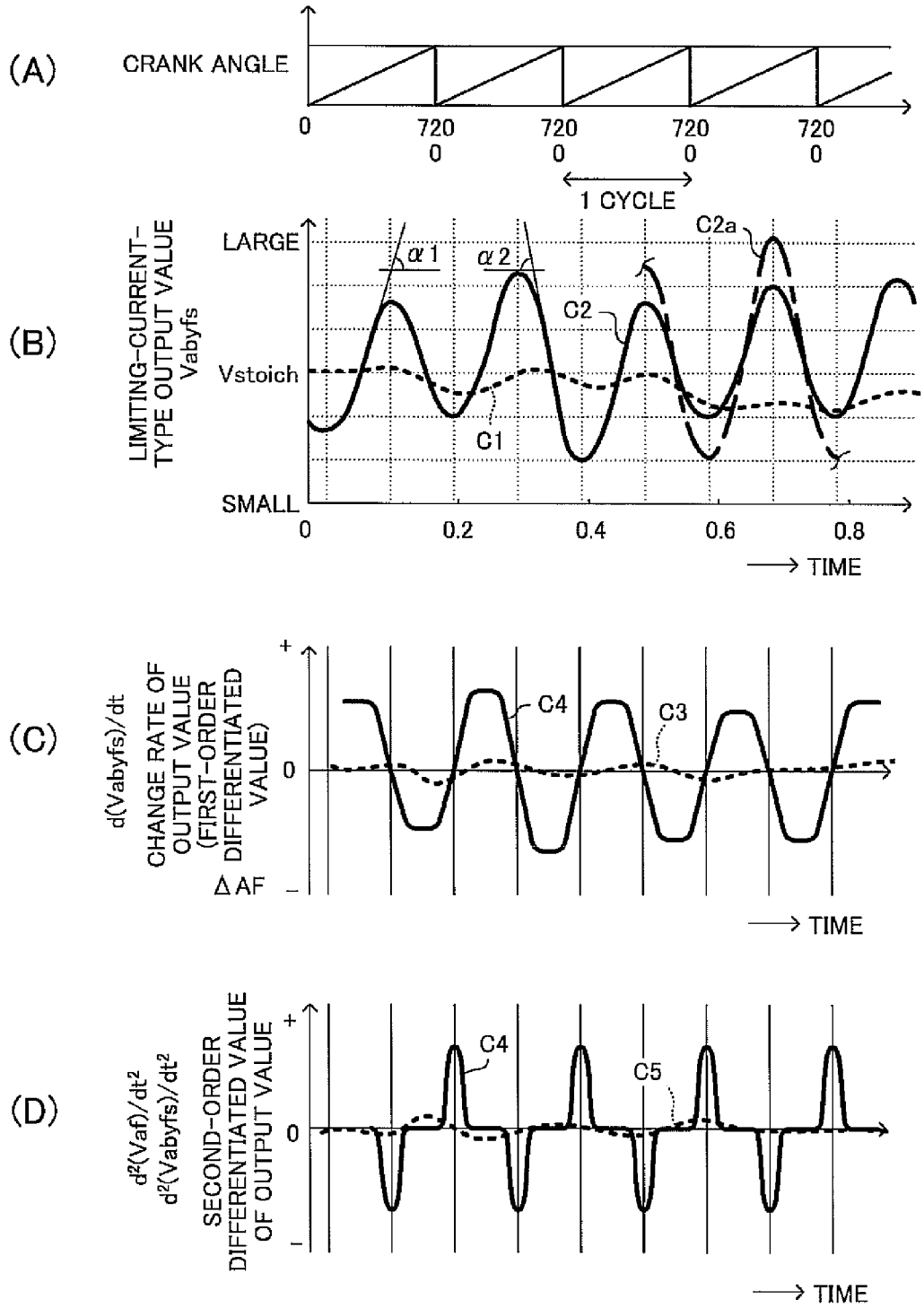
FIG. 12 is a set of time charts showing changes in values associated with imbalance determination parameters for the case where an inter-cylinder air-fuel-ratio imbalance state has occurred and the case where an inter-cylinder air-fuel-ratio imbalance state has not occurred.

Hence, when the specific-cylinder rich-side-deviated imbalance state has occurred, the limiting-current-type output value Vabyfs changes greatly as indicated by the solid line C2 in FIG. 12 (B). Specifically, for example, in the case where the engine is of a four-cylinder four-cycle type, the limiting-current-type output value Vabyfs changes at intervals corresponding to a crank angle of 720° (a crank angle required for the engine to complete one combustion stroke in all the first to fourth cylinders, which discharge exhaust gas reaching the single air-fuel-ratio sensor 67). Therefore, as can be understood from the solid line C4 in FIG. 12 (C), when the specific cylinder rich-side imbalanced state has occurred, the absolute value of the differentiated value d(Vabyfs)/dt of the limiting-current-type output value Vabyfs becomes large.

Furthermore, the greater the degree of separation of the air-fuel ratio of the imbalanced cylinder from the air-fuel ratio of the balanced cylinders, the greater the amount of change in the limiting-current-type output value Vabyfs. For example, if the limiting-current-type output value Vabyfs changes as indicated by the solid line C2 in FIG. 12(B) when the value representing the difference in air-fuel ratio between the imbalance cylinder and the balanced cylinders is the first value, the limiting-current-type output value Vabyfs changes as indicated by the alternate long and short dash line C2*a* in FIG. 12 (B) when the value representing the difference in air-fuel ratio between the imbalance cylinder and the balanced cylinders is the "second value which is greater than the first value." Accordingly, the greater the degree of separation of the air-fuel ratio of the imbalanced cylinder from the air-fuel ratio of the balanced cylinders, the greater the absolute value of the differentiated value d(Vabyfs)/dt of the limiting-current-type output value Vabyfs.

Thus, the first determination apparatus, etc. obtain an air-fuel-ratio fluctuation index quantity AFD which changes in accordance with the "differentiated value of the limiting-current-type output value Vabyfs (or the differentiated value d(abyfs)/dt of the limiting-current-type detected air-fuel ratio abyfs which can be obtained by applying the limiting-current-type output value Vabyfs to the air-fuel ratio conversion table Mapabyfs indicated by the solid line C1 in FIG. 3)." The greater the degree of fluctuation of the limiting-current-type output value Vabyfs or the limiting-current-type detected air-fuel ratio abyfs, the greater the absolute value of the air-fuel-ratio fluctuation index quantity AFD. The air-fuel-ratio fluctuation index quantity AFD may be, for example, any one of the following values, but is not limited thereto.

(A) The differentiated value d(Vabyfs)/dt of the limiting-current-type output value Vabyfs which is obtained each time a time corresponding to each sampling interval ts lapses.

(B) The absolute value of the differentiated value d(Vabyfs)/dt which is obtained each time a time corresponding to each sampling interval ts lapses.

(C) The average of the absolute values of a plurality of differentiated values d(Vabyfs)/dt obtained at the sampling intervals ts during each unit combustion cycle period or a value obtained by averaging the above averages over a plurality of unit combustion cycle periods.

(D) The average APd of a plurality of positive differentiated values d(Vabyfs)/dt among the plurality of differentiated values d(Vabyfs)/dt obtained at the sampling intervals ts during each unit combustion cycle period, or a value AvAPd obtained by averaging the above averages APd over a plurality of unit combustion cycle periods.

(E) The average AMd of the absolute values of a plurality of negative differentiated values d(Vabyfs)/dt among the plurality of differentiated values d(Vabyfs)/dt obtained at the sampling intervals ts during each unit combustion cycle period, or a value AvAMd obtained by averaging the above averages AMd over a plurality of unit combustion cycle periods.

(F) The average APd or the average AMd whichever is larger.

(G) The value AvAPd or the value AvAMd whichever is larger.

(H) The average AMdi of a plurality of negative differentiated values d(Vabyfs)/dt among the plurality of differentiated values d(Vabyfs)/dt obtained at the sampling intervals ts during each unit combustion cycle period, or a value AvAMdi obtained by averaging the above averages AMdi over a plurality of unit combustion cycle periods.

Since the above-mentioned air-fuel-ratio fluctuation index quantity AFD is based on the "differentiated value d(Vabyfs)/dt of the limiting-current-type output value Vabyfs" or the "differentiated value d(abyfs)/dt of the limiting-current-type detected air-fuel ratio abyfs," it is also referred to as a "limiting-current-type parameter" or an "air-fuel ratio change rate indicating quantity ΔAF." Furthermore, an air-fuel-ratio fluctuation index quantity AFD based on the concentration-cell-type output value VO2 can be obtained by replacing each of the differentiated value d(Vabyfs)/dt mentioned in (A) to (H) above with the differentiated value dVO2/dt of the concentration-cell-type output value VO2.

The first determination apparatus, etc. perform inter-cylinder air-fuel-ratio imbalance determination by comparing the absolute value of the air-fuel-ratio fluctuation index quantity AFD (in this case, the limiting-current-type parameter) with the imbalance determination threshold (in this case, the limiting-current-type-corresponding imbalance determination threshold). Specifically, it is determined that "the inter-cylinder air-fuel-ratio imbalance state has occurred" when the absolute value of the air-fuel-ratio fluctuation index quantity AFD is larger than the imbalance determination threshold. However, if the air-fuel-ratio fluctuation index quantity AFD is a parameter having a positive value and the value of this parameter increases with the degree of fluctuation of the air-fuel ratio of the exhaust gas (the degree of inter-cylinder air-fuel-ratio imbalance), the air-fuel-ratio fluctuation index quantity AFD may be compared with the imbalance determination threshold directly without obtaining the absolute value of the air-fuel-ratio fluctuation index quantity AFD.

Incidentally, when the air-fuel-ratio sensor 67 is used as a limiting-current-type wide range air-fuel-ratio sensor, its responsiveness decreases (becomes worse) "as the intake air flow rate Ga and/or the engine load decreases."

Figure 5:
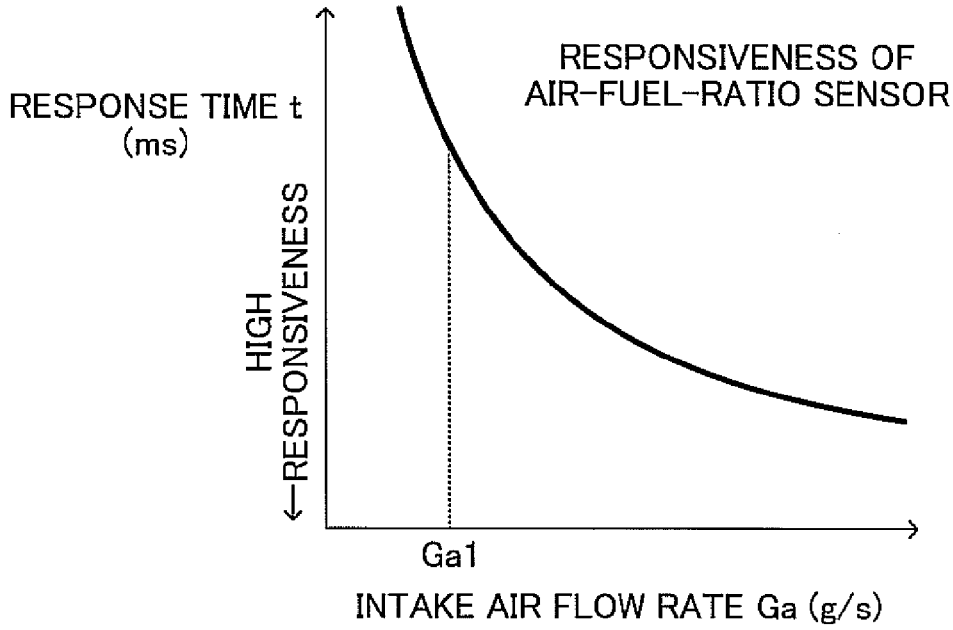
FIG. 5 is a graph showing the responsiveness of the air-fuel-ratio sensor with respect to intake air flow rate.

FIG. 5 is a graph indicating the relation between the responsiveness of the "limiting-current-type wide range air-fuel-ratio sensor (the air-fuel-ratio sensor 67 in the voltage applied state)" and the intake air flow rate Ga. In FIG. 5, responsiveness is indicated by, for example, the time t from a "specific point in time"—at which the "air-fuel ratio of the exhaust gas near the air-fuel-ratio sensor 67 which is in the voltage applied state" is changed from a "first air-fuel ratio (e.g., 14) which is on the rich side in relation to the stoichiometric air-fuel ratio" to a "second air-fuel ratio (e.g., 15) which is on the lean side in relation to the stoichiometric air-fuel ratio"—to a "subsequent point in time at which the limiting-current-type detected air-fuel ratio abyfs represented by the limiting-current-type output value Vabyfs changes to a third air-fuel ratio (e.g., 14.63 which is the air-fuel ratio obtained by adding an air-fuel ratio equivalent to 63% the difference between the first and second air-fuel ratios to the first air-fuel ratio)." This time is also called a "response time t." Therefore, the shorter the response time t, the better the responsiveness of the air-fuel-ratio sensor 67 (the responsiveness of the air-fuel-ratio sensor 67 becomes higher).

As can be understood from FIG. 5, the responsiveness of the air-fuel-ratio sensor 67 placed in the voltage applied state (namely, the responsiveness of the limiting-current-type output value Vabyfs) becomes better as the intake air flow rate Ga increases. This tendency is also shown when the air-fuel ratio of the exhaust gas which is present near the air-fuel-ratio sensor 67 is changed from the above-mentioned second air-fuel ratio to the above-mentioned first air-fuel ratio. Similarly, it has been empirically confirmed that the responsiveness of the air-fuel-ratio sensor 67 placed in the voltage applied state becomes better as the engine load (a value corresponding to the amount of air taken into one cylinder in one intake stroke) increases.

Presumably, the above phenomenon occurs because the "diffusion speed of the exhaust gas in the diffusion resistance layer 674," the "speed of reaction between unburned substances and oxygen in the exhaust-gas-side electrode layer 672," etc. "increases with the intake air flow rate Ga (i.e., the flow rate of the exhaust gas reaching the air-fuel-ratio detection element 67*a*)" and/or the "time required for reverse of the direction of movement of the oxygen ion through the solid electrolyte" "becomes shorter as the intake air flow rate Ga becomes higher."

In addition, as mentioned previously, since the air-fuel-ratio sensor 67 has protective covers (67*b* and 67*c*), the exhaust gas which has reached the inflow holes 67*b*1 of the outer protective cover 67*b* reaches the diffusion resistance layer 674 of the air-fuel-ratio detection element 67*a* after a "delay which increases as the intake air flow rate Ga decreases." This "delay in gas arrival" occurs irrespective of whether the air-fuel-ratio sensor 67 is functioning as a limiting-current-type wide range air-fuel-ratio sensor or a concentration-cell-type oxygen concentration sensor. However, since the delay in gas arrival increases as the intake air flow rate Ga decreases, it further worsens the responsiveness of the "limiting-current-type wide range air-fuel-ratio sensor (air-fuel-ratio sensor 67) whose responsiveness becomes worse as the intake air flow rate Ga decreases."

Hence, if there arises a situation in which the responsiveness of the "air-fuel-ratio sensor 67 functioning as a limiting-current-type wide range air-fuel-ratio sensor" becomes worse, for example, in a case where the engine 10 is operating in a specific operation state, the limiting-current-type output value Vabyfs fails to satisfactorily follow the change in the air-fuel ratio of the exhaust gas. As a result, the limiting-current-type parameter obtained on the basis of the limiting-current-type output value Vabyfs does not represent the degree of inter-cylinder air-fuel-ratio imbalance (the difference in air-fuel ratio between the imbalanced cylinder and the balanced cylinders) with a satisfactory degree of accuracy. This can invite a situation in which it is determined that "the inter-cylinder air-fuel-ratio imbalance state has not been produced" although it should be determined that the inter-cylinder air-fuel-ratio imbalance state has occurred, especially when the degree of inter-cylinder air-fuel-ratio imbalance is relatively small or when the air-fuel ratio of exhaust gas is changing in a region which is very close to the stoichiometric air-fuel ratio.

Meanwhile, as mentioned previously, when the air-fuel-ratio sensor 67 is functioning as a concentration-cell-type oxygen concentration sensor, the air-fuel-ratio sensor 67 outputs the concentration-cell-type output value VO2. When the air-fuel ratio of the gas changes in a region in the vicinity of the stoichiometric air-fuel ratio, the concentration-cell-type output value VO2 changes quickly and greatly with that change in the air-fuel ratio.

Hence, the first determination apparatus, etc. stop applying the voltage V to the air-fuel-ratio sensor 67 "continuously or intermittently" so as to course the air-fuel-ratio sensor 67 to function as a concentration-cell-type oxygen concentration sensor, and obtain the output value of the air-fuel-ratio sensor 67 at that time, as the concentration-cell-type output value VO2.

Furthermore, the first determination apparatus, etc. obtain a "concentration-cell-type parameter" similar to the limiting-current-type parameter on the basis of the concentration-cell-type output value VO2. That is, the first determination apparatus, etc. obtain the air-fuel-ratio fluctuation index quantity AFD which changes with the "differentiated value dVO2/dt of the concentration-cell-type output value VO2." This air-fuel-ratio fluctuation index quantity AFD can be a value obtained, for example, by replacing the "differentiated value d(Vabyfs)/dt" mentioned previously in (A) to (H) with the "differentiated value dVO2/dt of the concentration-cell-type output value VO2."

Figure 6:
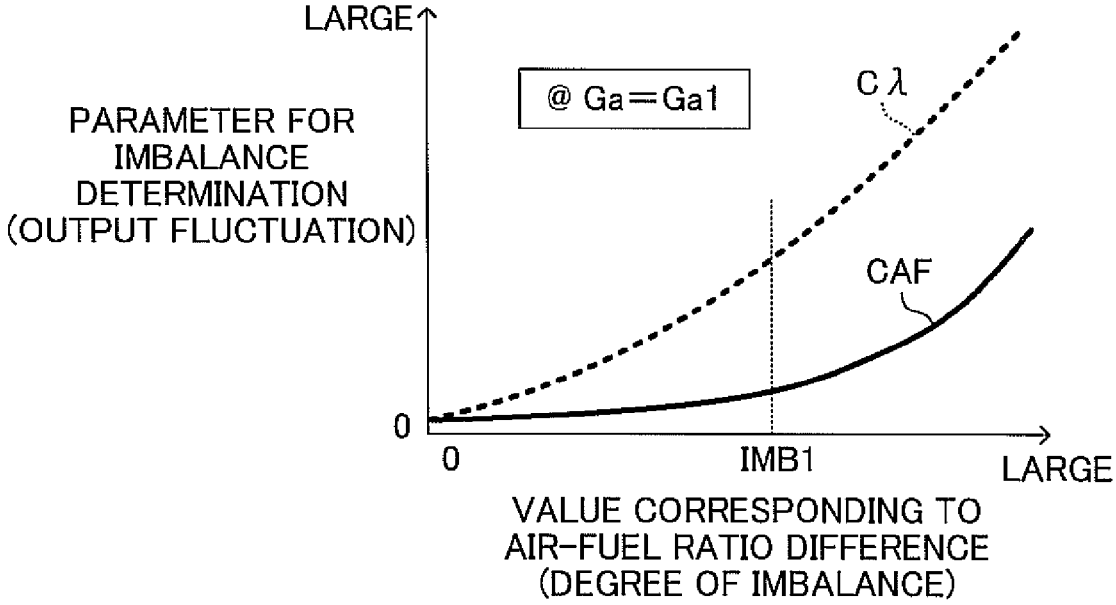
FIG. 6 is a graph showing the value of an imbalance determination parameter with respect to the degree of inter-cylinder air-fuel-ratio imbalance.

The concentration-cell-type parameter obtained in this manner changes in accordance with the degree of inter-cylinder air-fuel-ratio imbalance as indicated by the dash line Cλ in FIG. 6 even if the intake air flow rate Ga is low (e.g., approximately Ga1 in FIG. 5). In contrast, the limiting-current-type parameter changes in accordance with the degree of inter-cylinder air-fuel-ratio imbalance as indicated by the solid line CAF in FIG. 6. As evidenced by FIG. 6, the concentration-cell-type parameter represents the degree of inter-cylinder air-fuel-ratio imbalance with higher accuracy, as compared with the limiting-current-type parameter.

In addition, the first determination apparatus, etc. compare the "absolute value of the concentration-cell-type parameter used as an imbalance determination parameter" with the "concentration-cell-type-corresponding imbalance determination threshold used as an imbalance determination threshold" to perform inter-cylinder air-fuel-ratio imbalance determination. Specifically, when the absolute value of the concentration-cell-type parameter is larger than the concentration-cell-type-corresponding imbalance determination threshold, it is determined that "the inter-cylinder air-fuel-ratio imbalance state has occurred." Even in such a case, if the concentration-cell-type parameter is a parameter having a positive value and the value of this parameter increases with the degree of fluctuation of the air-fuel ratio becomes larger (the degree of inter-cylinder air-fuel-ratio imbalance becomes larger), the concentration-cell-type parameter may be compared with the concentration-cell-type-corresponding imbalance determination threshold directly without obtaining the absolute value of the concentration-cell-type parameter.

Thus, the first determination apparatus, etc. can perform imbalance determination on the basis of the "concentration-cell-type parameter" which accurately represents the degree of inter-cylinder air-fuel-ratio imbalance irrespective of the responsiveness of the air-fuel-ratio sensor 67 functioning as a limiting-current-type wide range air-fuel-ratio sensor. Accordingly, the first determination apparatus, etc. can perform imbalance determination with higher accuracy.

Furthermore, the first determination apparatus, etc. perform wide range feedback control on the basis of the limiting-current-type output value Vabyfs in periods during which the imbalance determination parameter need not be obtained. Under such wide range feedback control, the air-fuel ratio of the engine can be feedback-controlled on the basis of the difference between the air-fuel ratio of exhaust gas and a target air-fuel ratio (in most cases, the stoichiometric air-fuel ratio) because the limiting-current-type output value Vabyfs changes approximately in proportion to the air-fuel ratio of exhaust gas. Accordingly, the wide range feedback control can control the air-fuel ratio of the engine with higher accuracy, as compared with concentration-cell-type feedback control; i.e., air-fuel ratio control performed on the basis of the concentration-cell-type output value VO2. As a result, the first determination apparatus, etc. can keep emission at a favorable level.

(Actual Operation)

Next, there will be described actual operation of the first determination apparatus. The first determination apparatus obtains only a concentration-cell-type parameter without obtaining a limiting-current-type parameter, and performs imbalance determination on the basis of the obtained concentration-cell-type parameter. Furthermore, in the period during which the first determination apparatus obtains the concentration-cell-type parameter, it performs "concentration-cell-type feedback control which is air-fuel ratio feedback control based on the concentration-cell-type output value VO2." In other periods during which the first determination apparatus does not obtain the concentration-cell-type parameter, it performs "wide range feedback control which is air-fuel ratio feedback control based on a limiting-current-type output value Vabyfs."

<Fuel Injection Quantity Control>

The CPU 71 of the first determination apparatus is designed to repeatedly execute a "fuel injection control routine" shown in FIG. 13 for an arbitrary cylinder (hereinafter also referred to as a "fuel injection cylinder") each time the crank angle of this cylinder becomes the predetermined crank angle before the intake top dead center (e.g., BTDC 90° CA). Accordingly, when the predetermined timing is reached, the CPU 71 starts processing from step 1300. In step 1310, the CPU 71 determines whether or not the value of a fuel cut flag XFC (hereinafter referred to as an "F/C flag XFC") is "0."

The value of the F/C flag XFC is set at "1" from a moment a fuel cut start condition is satisfied to a moment a fuel cut recovery condition (fuel cut end condition) is satisfied. In the remaining period, it is set at "0." That is, the value of the F/C flag XFC is set to "1" when fuel cut control is required to be performed. Note that the value of the F/C flag XFC is set to "0" in an initial routine which is executed when the ignition key switch of the vehicle equipped with the engine 10 is turned from the OFF position to the ON position.

(Fuel Cut Start Condition)

The fuel cut start condition is satisfied when both of the following FC conditions 1 and 2 are satisfied:

(FC condition 1) The opening TA of the throttle valve 44 is "zero (or equal to or less than a predetermined opening TAth)."

(FC condition 2) The engine rotational speed NE is "equal to or greater than a fuel-cut-start rotational speed NEfcth."

(Fuel Cut Recovery Condition)

The fuel cut recovery condition is satisfied when at least one of the following FC recovery conditions 1 and 2 is satisfied:

(FC recovery condition 1) The throttle valve opening TA is greater than "zero (or the predetermined opening TAth)."

(FC recovery condition 2) The engine rotational speed NE is lower than the "fuel-cut-recovery rotational speed NEfcre." Note that the fuel-cut-recovery rotational speed NEfcre is a rotational speed which is lower than the fuel-cut-start rotational speed NEfcth by a predetermined rotational speed ΔN.

Assume that the value of the F/C flag XFC is "0." In this case, the CPU 71 executes steps 1320 to 1360 (which will be described below) one after another, and then proceeds to step 1395 to terminate the present routine temporarily.

Step 1320: The CPU 71 obtains an "in-cylinder intake air quantity Mc(k);" namely, the "quantity of air taken into the fuel injection cylinder" on the basis of the "intake air flow rate Ga measured using the air flow meter 61, the engine rotational speed NE obtained on the basis of the signal from the crank position sensor 64, and a lookup table MapMc." The in-cylinder intake air quantity Mc(k) in each intake stroke is stored in the RAM. The in-cylinder intake air quantity Mc(k) may be computed from a well-known air model (a model established in conformity with a physical law simulating the behavior of air in the intake passage).

Step 1330: The CPU 71 sets an upstream-side target air-fuel ratio (target air-fuel ratio) abyfr in accordance with the operation state of the engine 10. The first determination apparatus sets the upstream-side target air-fuel ratio abyfr to the stoichiometric air-fuel ratio stoich. However, in the case where active control is performed or the like case, the upstream-side target air-fuel ratio abyfr is set, in the present step 1330, to an air-fuel ratio other than the stoichiometric air-fuel ratio.

Step 1340: The CPU 71 obtains a basic fuel injection quantity Fbase by dividing the in-cylinder intake air quantity Mc(k) by the upstream-side target air-fuel ratio abyfr. Accordingly, the basic fuel injection quantity Fbase is a feed-forward quantity for the fuel injection quantity which is required for obtaining the upstream-side target air-fuel ratio abyfr.

Step 1350: The CPU 71 corrects the basic fuel injection quantity Fbase on the basis of a main feedback quantity DFi. More specifically, the CPU 71 computes an instructed fuel injection quantity (final fuel injection quantity) Fi by adding the main feedback quantity DFi to the basic fuel injection quantity Fbase. The main feedback quantity DFi will be described later.

Step 1360: The CPU 71 injects fuel, in the instructed injection quantity Fi, from the fuel injection valve 39 provided for the fuel injection cylinder.

Meanwhile, if the value of the F/C flag XFC is "1" when the CPU 71 performs the processing of step 1310, the CPU 71 makes a "No" determination in the same step 1310, and proceeds directly to step 1395 to terminate the present routine temporarily. In this case, fuel cut control is performed because the step 1360 for performing fuel injection is skipped.

<Computation of the Main Feedback Quantity>

Figure 14:
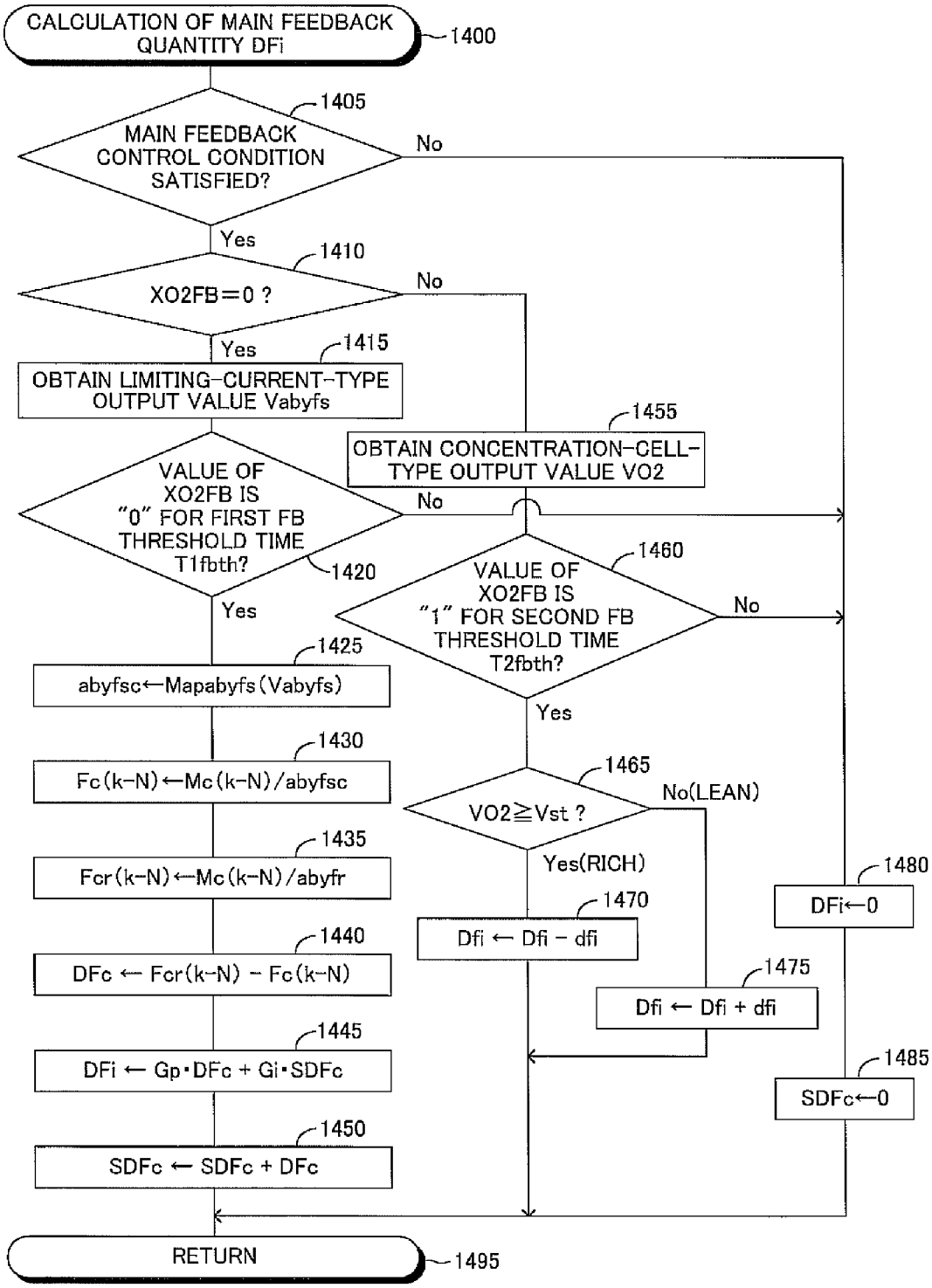
FIG. 14 is a flowchart showing another routine executed by the CPU of the first determination apparatus.

The CPU 71 repeatedly executes a "main feedback quantity computation routine" shown in the flowchart of FIG. 14 each time a predetermined time elapses. Accordingly, when the predetermined timing is reached, the CPU 71 starts processing from step 1400, and proceeds to step 1405 to determine whether or not a "main feedback control condition (upstream-side air-fuel ratio feedback control condition)" is satisfied.

The main feedback control condition is satisfied when all of the following conditions are satisfied:

(A1) The air-fuel-ratio sensor 67 has been activated.

(A2) An engine load (load factor) KL is a first threshold load KL1th or less.

(A3) Fuel cut control is not being performed (the value of the F/C flag XFC is not "1").

In the present embodiment, the load factor (load) KL representing the load of the engine 10 is obtained in accordance with the expression (1) given below. An accelerator pedal operation amount Accp may be used in stead of the load factor KL. In the expression (1), Mc is the in-cylinder intake air quantity, ρ is the density of air (unit: g/I), L is the displacement of the engine 10 (unit: I), "4" is the number of the cylinders of the engine 10.

$$KL=(Mc/(\rho\cdot L/4))\cdot 100\% \quad (1)$$

There will be continued description of the present routine on the assumption that the main feedback control condition is satisfied. In this case, the CPU 71 makes a "Yes" determination in step 1405, and proceeds to step 1410 to determine whether or not the value of an oxygen concentration sensor FB control flag XO2FB is "0".

Figure 15:
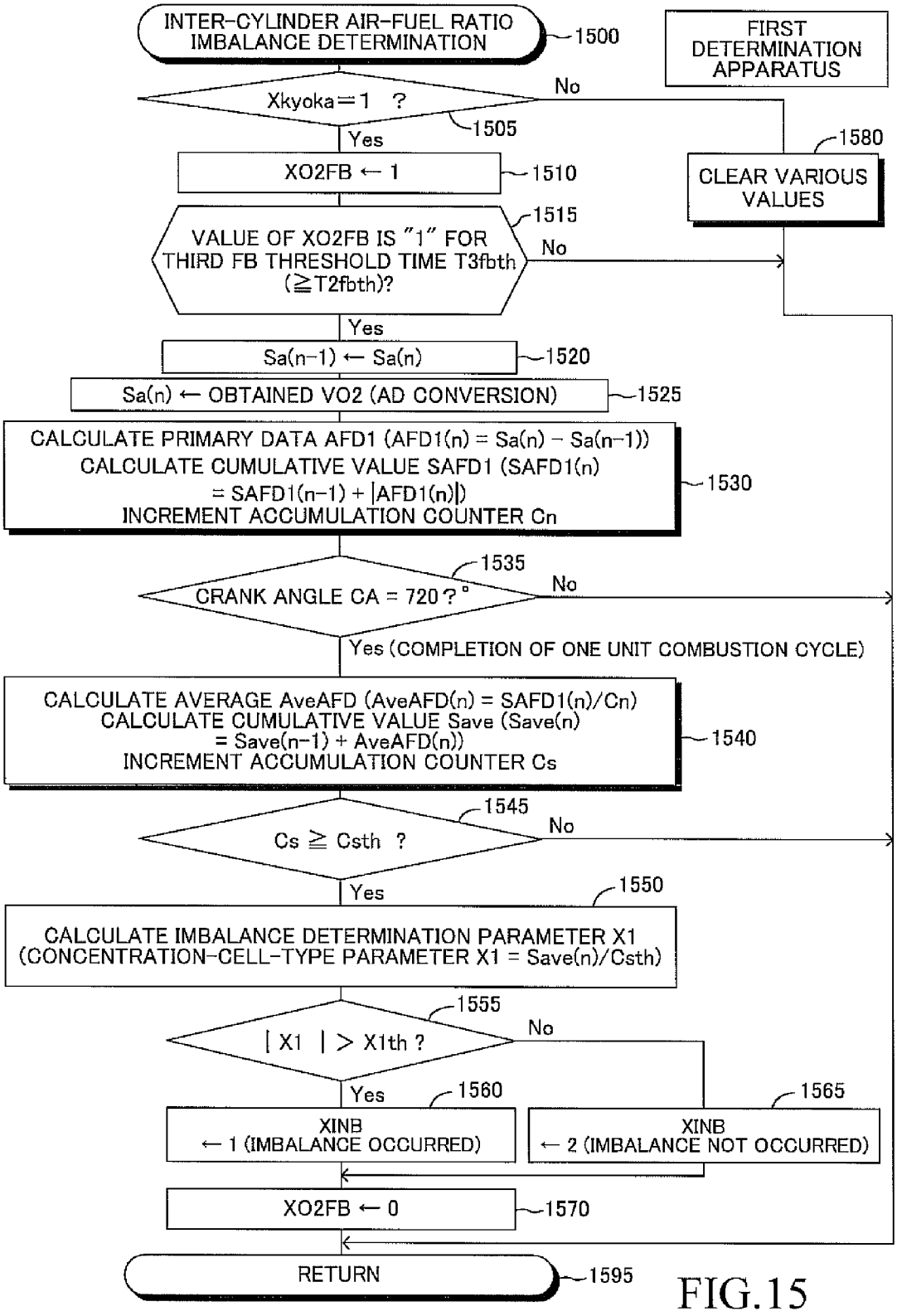
FIG. 15 is a flowchart showing another routine executed by the CPU of the first determination apparatus.

The value of this oxygen concentration sensor FB control flag XO2FB is set in a separately executed routine shown in FIG. 15. In addition, the value of the oxygen concentration sensor FB control flag XO2FB is set to "0" in the above-mentioned initial routine.

Figure 17:
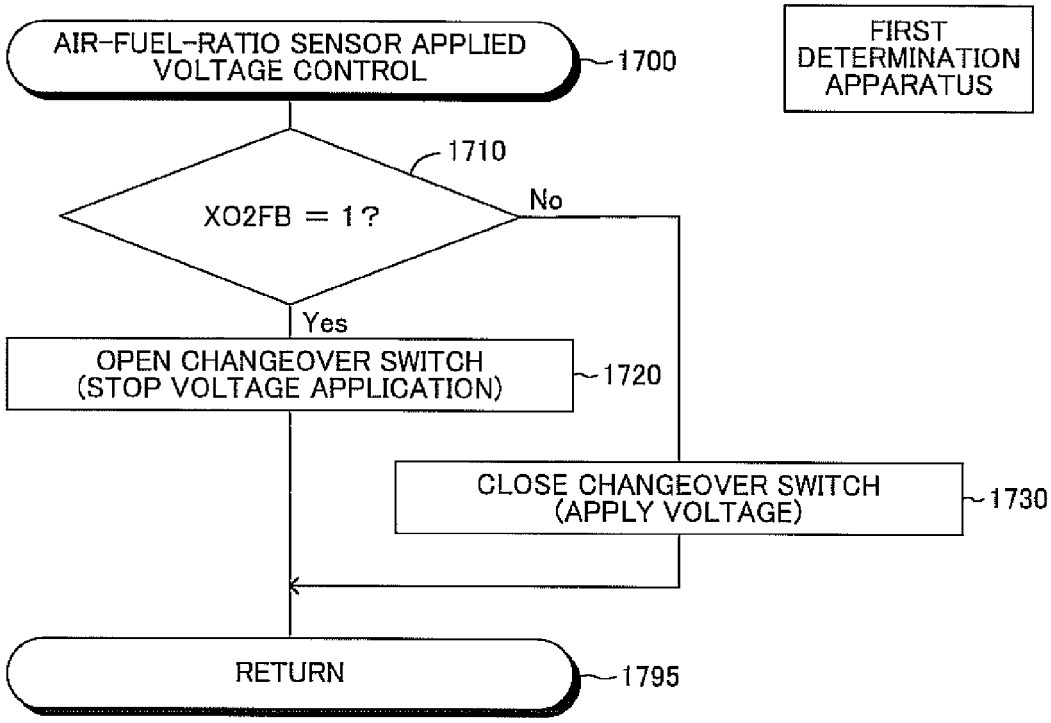
FIG. 17 is a flowchart showing another routine executed by the CPU of the first determination apparatus.

When the value of the oxygen concentration sensor FB control flag XO2FB is "0," a separately executed routine shown in FIG. 17 sends an instruction signal to the changeover switch 678 so as to close it. This produces a "voltage applied state in which the voltage Vp is applied" between the exhaust-gas-side electrode layer 672 and the atmosphere-side electrode layer 673," which causes the air-fuel-ratio sensor 67 to function as a "limiting-current-type wide range air-fuel-ratio sensor." Furthermore, in this case, main feedback control is performed on the basis of the "limiting-current-type output value Vabyfs which is the output value of the air-fuel-ratio sensor 67." This air-fuel ratio main feedback control corresponds to the above-mentioned "wide range feedback control."

In contrast, when the value of the oxygen concentration sensor FB control flag XO2FB is "1," the separately executed routine shown in FIG. 17 sends an instruction signal to the changeover switch 678 so as to open it. This produces a "voltage application stopped state in which the voltage Vp is not applied" between the "exhaust-gas-side electrode layer 672 and the atmosphere-side electrode layer 673," which causes the air-fuel-ratio sensor 67 to function as a "concentration-cell-type oxygen concentration sensor." Furthermore, in this case, main feedback control is performed on the basis of the "concentration-cell-type output value VO2 which is the output value of the air-fuel-ratio sensor 67." This air-fuel ratio main feedback control corresponds to the above-mentioned "concentration-cell-type feedback control."

Assume that the value of the oxygen concentration sensor FB control flag XO2FB is "0." In this case, the CPU 71 makes a "Yes" determination in step 1410, and proceeds to step 1415 to obtain the limiting-current-type output value Vabyfs.

Next, the CPU 71 proceeds to step 1420 to determine whether or not the period during which the value of the oxygen concentration sensor FB control flag XO2FB is held at "0" (duration T1) is longer than a first threshold time T1*fbth*. This first feedback threshold time T1*fbth* is set to a time which is required for the air-fuel-ratio sensor 67 to stably output the limiting-current-type output value Vabyfs by operating as a "wide range air-fuel-ratio sensor" after being switched from the "concentration-cell-type oxygen concentration sensor" to the wide range air-fuel-ratio sensor." Alternatively, the first feedback threshold time T1*fbth* is set to a time which is slightly longer than the required time.

At this time, if the duration T1 is shorter than the first feedback threshold time T1*fbth*, the CPU 71 makes a "No" determination in step 1420, and proceeds to step 1480 and steps subsequent thereto, which will be described later.

In contrast, if the duration T1 is equal to or longer than the first feedback threshold time T1*fbth*, the CPU 71 determines Yes" in step 1420 and executes steps 1425 to 1450 described hereunder, one after another. Thus, the main feedback quantity DFi under the "wide range feedback control" is computed. Thereafter, the CPU 71 proceeds to step 1495 to terminate the present routine temporarily. Note that step 1420 may be omitted. In this case, the CPU 71 directly proceeds from step 1415 to step 1425 and steps subsequent thereto.

Step 1425: As indicated by the expression (2) given below, the CPU 71 obtains an air-fuel ratio abyfsc for feedback control by applying the limiting-current-type output value Vabyfs to the table Mapabyfs indicated by the solid line C1 in FIG. 3.

$$abyfsc=Mapabyfs(Vabyfs) \quad (2)$$

Notably, the CPU 71 may compute a sub-feedback quantity Vafsfb on the basis of the output value Voxs of the downstream-side air-fuel-ratio sensor 68 through use of a well-known method. The sub-feedback quantity Vafsfb is a feedback quantity which is computed so as to cause the output value Voxs to coincide with a value Vst corresponding to the stoichiometric air-fuel ratio. In this case, the CPU 71 corrects the limiting-current-type output value Vabyfs using, for example, the expression (3) given below; i.e., by adding the sub-feedback quantity Vafsfb thereto, whereby a corrected limiting-current-type output value Vabyfc is obtained. Subsequently, the corrected value Vabyfc is substituted for the value Vabyfs of the expression (2), whereby the air-fuel ratio abyfsc is obtained.

$$Vabyfc=Vabyfs+Vafsfb \quad (3)$$

Step 1430: The CPU 71 obtains, through use of the expression (4) given below, an "in-cylinder fuel supply quantity Fc(k-N)" which is the "quantity of the fuel actually supplied to the combustion chamber 25 at a point in time which is N cycles before the present point." That is, the CPU 71 obtains the in-cylinder fuel supply quantity Fc(k−N) by dividing the "in-cylinder intake air quantity Mc(k−N) at a point which is N cycles (i.e., N*720° (crank angle)) before the present point" by the "above-mentioned feedback control air-fuel ratio abyfsc."

$$Fc(k-N)=Mc(k-N)/abyfsc \quad (4)$$

The reason why the in-cylinder intake air quantity Mc(k−N) at the time N strokes before the present point in time is divided by the feedback control air-fuel ratio abyfsc in order to obtain the in-cylinder fuel supply quantity Fc(k−N) is because the "exhaust gas generated as a result of combustion of air-fuel mixture in the combustion chamber 25" requires a "time corresponding to N strokes" to reach the air-fuel-ratio sensor 67.

Step 1435: The CPU 71 obtains a "target in-cylinder fuel supply quantity Fcr(k−N)" which is the "quantity of the fuel that should have been supplied to the combustion chamber 25 at a point which is N cycles before the present point" from the expression (5) given below. That is, the CPU 71 obtains the target in-cylinder fuel supply quantity Fcr(k−N) by dividing the in-cylinder intake air quantity Mc(k−N) at the time N strokes before the present point in time by the upstream-side target air-fuel ratio abyfr (stoichiometric air-fuel ratio=stoich).

$$Fcr(k-N)=Mc(k-N)/abyfr \quad (5)$$

Step 1440: The CPU 71 obtains an in-cylinder fuel supply quantity deviation DFc in accordance with the above-described expression (6) given below. That is, the CPU 71 obtains the in-cylinder fuel supply quantity deviation DFc by subtracting the in-cylinder fuel supply quantity Fc(k−N) from the target in-cylinder fuel supply quantity Fcr(k−N). The obtained in-cylinder fuel supply quantity deviation DFc is a quantity which indicates the degree of excess or deficiency of the fuel supplied to the cylinder at the time which is N strokes before the present point in time. Furthermore, as is apparent from expressions (2) to (6), the in-cylinder fuel supply quantity deviation DFc is a value corresponding to the difference between the feedback control air-fuel ratio abyfsc represented by the limiting-current-type output value Vabyfs and the target air-fuel ratio abyfr which is the stoichiometric air-fuel ratio.

$$DFc=Fcr(k-N)-Fc(k-N) \quad (6)$$

Step 1445: The CPU 71 obtains the main feedback quantity DFi in accordance with the above-described expression (7) given below. In the expression (7), Gp is a preset proportional gain, and Gi is a preset integral gain. In addition, the "value SDFc" in the expression (7) is the "integral value of the in-cylinder fuel supply quantity deviation DFc." That is, the CPU 71 obtains the "main feedback quantity DFi" by performing PI control (proportional/integral control) so as to render the "feedback-control air-fuel ratio abyfsc represented by the limiting-current-type output value Vabyfs" coincident with the "upstream-side target air-fuel ratio abyfr which is set to the stoichiometric air-fuel ratio, etc."

$$DFi=Gp\cdot DFc+Gi\cdot SDFc \quad (70$$

Step 1450: The CPU 71 obtains a new integral value SDFc of the in-cylinder fuel supply quantity deviation by adding the in-cylinder fuel supply quantity deviation DFc obtained in the above-mentioned step 1440 to the integral value SDFc of the in-cylinder fuel supply quantity deviation DFc at the present point in time.

Thus, the main feedback quantity DFi under the proportional/integral control has been obtained. The obtained main feedback quantity DFi is reflected in the instructed fuel injection quantity Fi through the processing performed in the above-mentioned step 1350 shown in FIG. 13.

On the other hand, in the decision step 1410 shown in FIG. 14, if the value of the oxygen concentration sensor FB control flag XO2FB is not "0" (i.e., it is "1"), the CPU 71 makes a "No" determination in step 1410, and then proceeds to step 1455 to obtain (read) the concentration-cell-type output value VO2 which has already been obtained in step 1525 shown in FIG. 15.

Next, the CPU 71 proceeds to step 1460 to determine whether or not the period during which the value of the oxygen concentration sensor FB control flag XO2FB is held at "1" (duration T2) is equal to or longer than a second feedback threshold time T2*fbth*. The second feedback threshold time T2*fbth* is set to a time which is required for the air-fuel-ratio sensor 67 to stably output the concentration-cell-type output value VO2 as a "concentration-cell-type oxygen concentration sensor" after it has been switched from the "limiting-current-type wide range air-fuel-ratio sensor" to the "concentration-cell-type oxygen concentration sensor." Alternatively, the second feedback threshold time T2*fbth* is set to a time which is slightly longer than the required time.

At this time, if the duration T2 is shorter than the second feedback threshold time T2*fbth*, the CPU 71 makes a "No" determination in step 1460 and then proceeds to step 1480 and steps subsequent thereto. Note that step 1460 may be omitted. In such a case, the CPU 71 proceeds directly from step 1455 to step 1465.

In contrast, if the duration T2 is equal to or longer than the second feedback threshold time T2*fbth*, the CPU 71 makes a "Yes" determination in step 1460, and then proceeds to step 1465 to determine whether or not the concentration-cell-type output value VO2 is equal to or greater than the value corresponding to the stoichiometric air-fuel ratio (stoichiometric air-fuel ratio equivalent value) Vst. That is, the CPU 71 determines whether or not the concentration-cell-type output value VO2 is a value corresponding to an air-fuel ratio which is on the rich side in relation to the stoichiometric air-fuel ratio.

At this time, if the concentration-cell-type output value VO2 is equal to or greater than the stoichiometric air-fuel ratio equivalent value Vst, the CPU 71 makes a "Yes" determination in step 1465, and then proceeds to step 1470 to decrease the main feedback quantity DFi by a predetermined value dfi. Subsequently, the CPU 71 proceeds to step 1495 to terminate the present routine temporarily.

In contrast, if the concentration-cell-type output value VO2 is less than the stoichiometric air-fuel ratio equivalent Vst when the CPU 71 performs the processing of step 1465, the CPU 71 makes a "No" determination in step 1465, and then proceeds to step 1475 to increase the main feedback quantity DFi by a prescribed value dfi. Subsequently, the CPU 71 proceeds to step 1495 to terminate the present routine temporarily.

The aforementioned steps 1465 to 1475 are necessary for performing the aforementioned "concentration-cell-type feedback control." Thus, under the concentration-cell-type feedback control, the main feedback quantity DFi is decreased by the predetermined value dfi when the air-fuel ratio of the exhaust gas reaching the air-fuel-ratio sensor 67 (air-fuel-ratio detection element 67*a*) is on the rich side in relation to the stoichiometric air-fuel ratio. Therefore, the instructed fuel injection quantity Fi is also decreased by the prescribed value dfi as a result of performance of the processing of step 1350 shown in FIG. 13. Furthermore, under the concentration-cell-type feedback control, the main feedback quantity DFi is increased by the predetermined value dfi when the air-fuel ratio of the exhaust gas reaching the air-fuel-ratio sensor 67 (air-fuel-ratio detection element 67*a*) is on the lean side in relation to the stoichiometric air-fuel ratio. Therefore, the instructed fuel injection quantity Fi is also increased by the prescribed value dfi as a result of performance of the processing of step 1350 shown in FIG. 13.

In addition, if the main feedback control condition is not satisfied when the CPU 71 performs the processing of step 1405, the CPU 71 makes a "No" determination in step 1405, and then proceeds to step 1480 to set the value of the main feedback quantity DFi to "0." Next, in step 1485, the CPU 71 sets the integral value SDFc of the in-cylinder fuel supply quantity deviation to "0." Next, the CPU 71 proceeds to step 1495 to terminate the present routine temporarily. As described above, when the main feedback control condition is not satisfied, the main feedback quantity DFi is set to "0." Accordingly, the basic fuel injection quantity Fbase is not corrected on the basis of the main feedback quantity DEL <Inter-Cylinder Air-Fuel-Ratio Imbalance Determination>

Next, there will be described processing for performing "inter-cylinder air-fuel-ratio imbalance determination." The CPU 71 is designed to execute an "inter-cylinder air-fuel-ratio imbalance determination routine" shown in the flowchart of FIG. 15 each time 4 ms (4 milliseconds=Predetermined, fixed sampling interval ts) elapses.

Therefore, when the predetermined timing is reached, the CPU 71 starts processing from step 1500, and then proceeds to step 1505 to determine whether or not the value of a determination permission flag Xkyoka is "1." The CPU 71 permits or prohibits "obtainment of an imbalance determination parameter (a concentration-cell-type parameter in the present embodiment) and execution of inter-cylinder air-fuel-ratio imbalance determination" described below on the basis of the value of the determination permission flag Xkyoka.

Figure 16:
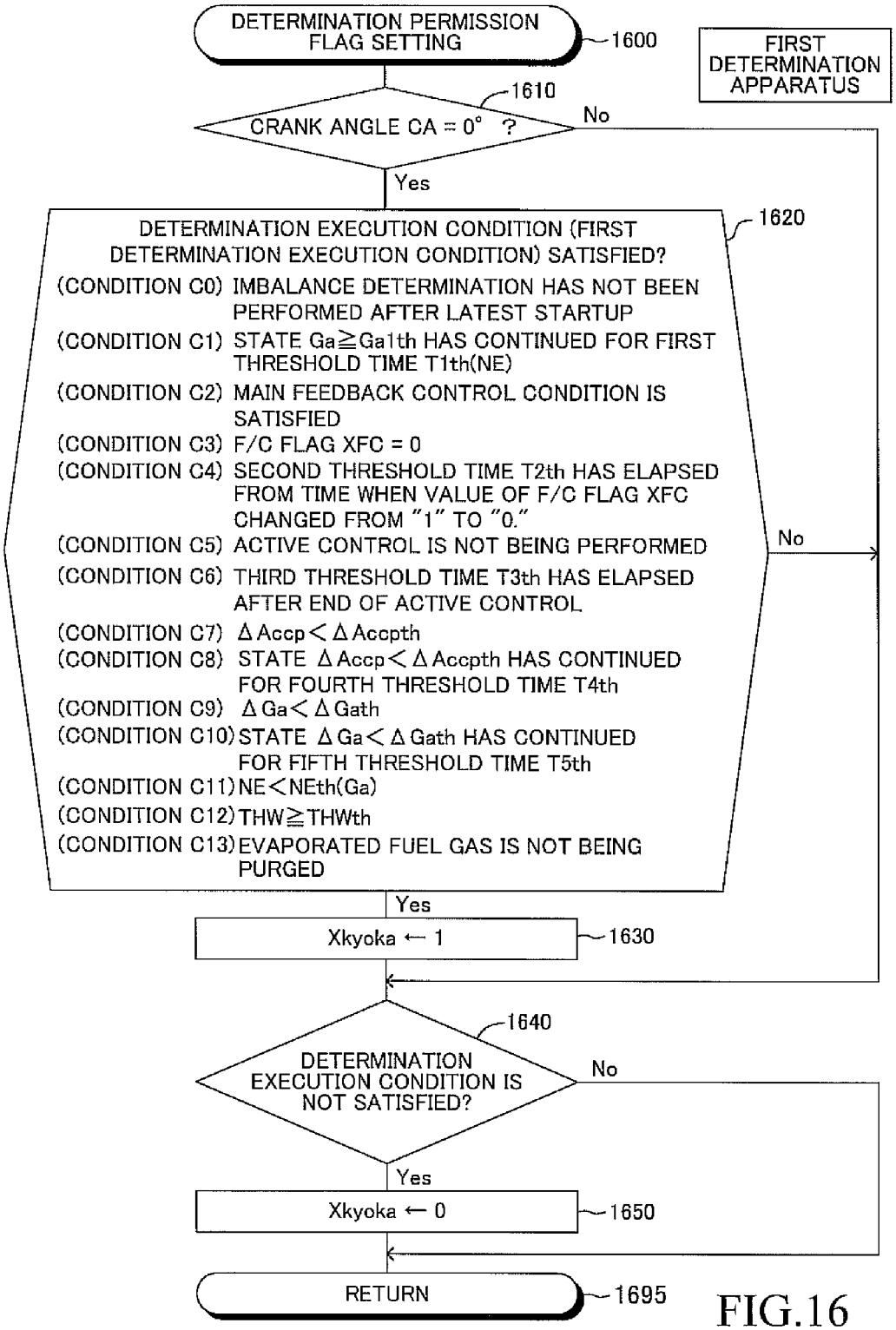
FIG. 16 is a flowchart showing another routine executed by the CPU of the first determination apparatus.

More specifically, when the value of the determination permission flag Xkyoka is "1," the CPU 71 performs "imbalance determination parameter obtainment and inter-cylinder air-fuel-ratio imbalance determination." When the value of the determination permission flag Xkyoka is "0" (not "1"), the CPU 71 prohibits (stops) the "imbalance determination parameter obtainment and the inter-cylinder air-fuel-ratio imbalance determination." The CPU 71 sets this determination permission flag Xkyoka by executing a "determination permission flag setting routine" shown in the flowchart of FIG. 16. Note that the value of the determination permission flag Xkyoka is set to "0" in the above-mentioned initial routine.

Assume that the value of the determination permission flag Xkyoka is set to "1." In this case, the CPU 71 makes a "Yes" determination in step 1505, and then proceeds to step 1510 to set the value of the oxygen concentration sensor FB control flag XO2FB to "1." This allows the CPU 71 to determine "No" in step 1410 of FIG. 14 and then proceed to step 1455. Accordingly, if the value of the oxygen concentration sensor FB control flag XO2FB is changed from "0" to "1" at this point in time, the "concentration-cell-type feedback control" starts when the second feedback threshold time T2*fbth* lapses thereafter.

Next, the CPU 71 proceeds to step 1515 shown in FIG. 15 to determine whether or not the period during which the value of the oxygen concentration sensor FB control flag XO2FB is held at "1" (duration T3) is equal to or longer than a third feedback threshold time T3*fbth*.

The third feedback threshold time T3*fbth* is set to a time which is equal to or longer than the second feedback threshold time T2*fbth*. In other words, when the duration T3 has become equal to or longer than the third feedback threshold time T3*fbth*, the concentration-cell-type feedback control has been performed to a sufficient degree. Consequently, the concentration-cell-type output value VO2 allows the CPU to obtain a "concentration-cell-type parameter which is a highly accurate imbalance determination parameter." Note that step 1515 may be omitted. In such a case, the CPU 71 proceeds from step 1510 to step 1520 directly.

If the duration T3 is shorter than the third feedback threshold time T3*fbth*, the CPU 71 makes a "No" determination in step 1515, and then proceeds to step 1595 to terminate the present routine temporarily.

On the other hand, if the duration T3 is equal to or longer than the third feedback threshold time T3*fbth* when the CPU 71 performs the processing of step 1515, the CPU 71 makes a "Yes" determination in the same step 1515 and then proceeds to step 1520. Subsequently, in step 1520, the CPU 71 stores the "Sa(n) which is a concentration-cell-type output value VO2 retained in the RAM 73 at the present point in time" as a previous output value Sa(n−1). That is, the previous output value Sa(n−1) is a value obtained through AD conversion of the concentration-cell-type output value VO2 which was retained 4 ms (sampling time ts) before the present point in time. Note that the initial value of the value Sa(n) is set to a value corresponding to the value obtained through AD conversion of the stoichiometric air-fuel ratio equivalent value Vst.

Next, the CPU 71 proceeds to step 1525 to obtain a "concentration-cell-type output value VO2 which is the output value of the air-fuel-ratio sensor 67 at the preset point in time" through AD conversion, and stores the obtained value as a present output value Sa(n).

Next, the CPU 71 proceeds to step 1530 to update the following data:

(A) primary data AFD1 for an air-fuel-ratio fluctuation index quantity AFD;

(B) the cumulative value SAFD1 of the absolute value |AFD1| of the primary data AFD1; and (C) an accumulation counter Cn which indicates the number of times the absolute value |AFD1| of the primary data AFD1 is cumulatively added to the cumulative value SAFD1.

The methods for updating the above data will be specifically described below.

Note that the primary data AFD1 for the air-fuel-ratio fluctuation index quantity AFD is source data for obtaining a concentration-cell-type parameter X1, which is the above-mentioned air-fuel-ratio fluctuation index quantity AFD. In the present embodiment, the air-fuel-ratio fluctuation index quantity AFD is a value corresponding to the differentiated value dVO2/dt of the concentration-cell-type output value VO2. More specifically, the air-fuel-ratio fluctuation index quantity AFD is a value obtained by averaging, over a plurality of unit combustion cycle periods, the averages which were calculated in the plurality of unit combustion cycle periods and each of which represents the average of the absolute values of a plurality of differentiated values dVO2/dt obtained in the corresponding unit combustion cycle period. Therefore, the primary data AFD1 of the air-fuel-ratio fluctuation index quantity AFD is the differentiated value dVO2/dt of the concentration-cell-type output value VO2.

The air-fuel-ratio fluctuation index quantity AFD may be any of various imbalance determination parameters. Accordingly, for example, when a concentration-cell-type parameter, which serves as an imbalance determination parameter, is a value corresponding to the "second order time differentiated value $d^2(VO2)/dt^2$ of the concentration-cell-type output value VO2," the primary data AFD1 of the air-fuel-ratio fluctuation index quantity AFD is the "second order differentiated value $d^2(VO2)/dt^2$."

(A) Updating of the primary data AFD1 of the air-fuel-ratio fluctuation index quantity AFD.

The differentiated value dVO2/dt can be obtained as an amount of change in the concentration-cell-type output value VO2 during the period corresponding to the sampling interval is (i.e., an output change rate AVO2). The CPU 71 obtains this output change rate AVO2 (namely, the differentiated value dVO2/dt) by subtracting the previous output value Sa(n−1) from the present output value Sa(n). That is, in step 1530, the CPU 71 obtains the "present primary data AFD1(*n*) of the air-fuel-ratio fluctuation index quantity AFD" from the following expression (8):

$$AFD1(n)=Sa(n)-Sa(n-1) \tag{8}$$

(B) Updating of the cumulative value SAFD1 of the "absolute value |AFD1| of the primary data AFD1."

The CPU 71 obtains the present cumulative value SAFD1(*n*) from the expression (9) given below. That is, upon proceeding to step 1530, the CPU 71 updates the cumulative value SAFD1 by adding the "absolute value |AFD1(*n*)| of the present primary data AFD1(*n*) calculated as mentioned above" to the previous cumulative value SAFD1(*n*−1).

$$SAFD1(n)=SAFD1(n-1)+|AFD1(n)| \tag{9}$$

Figure 4:
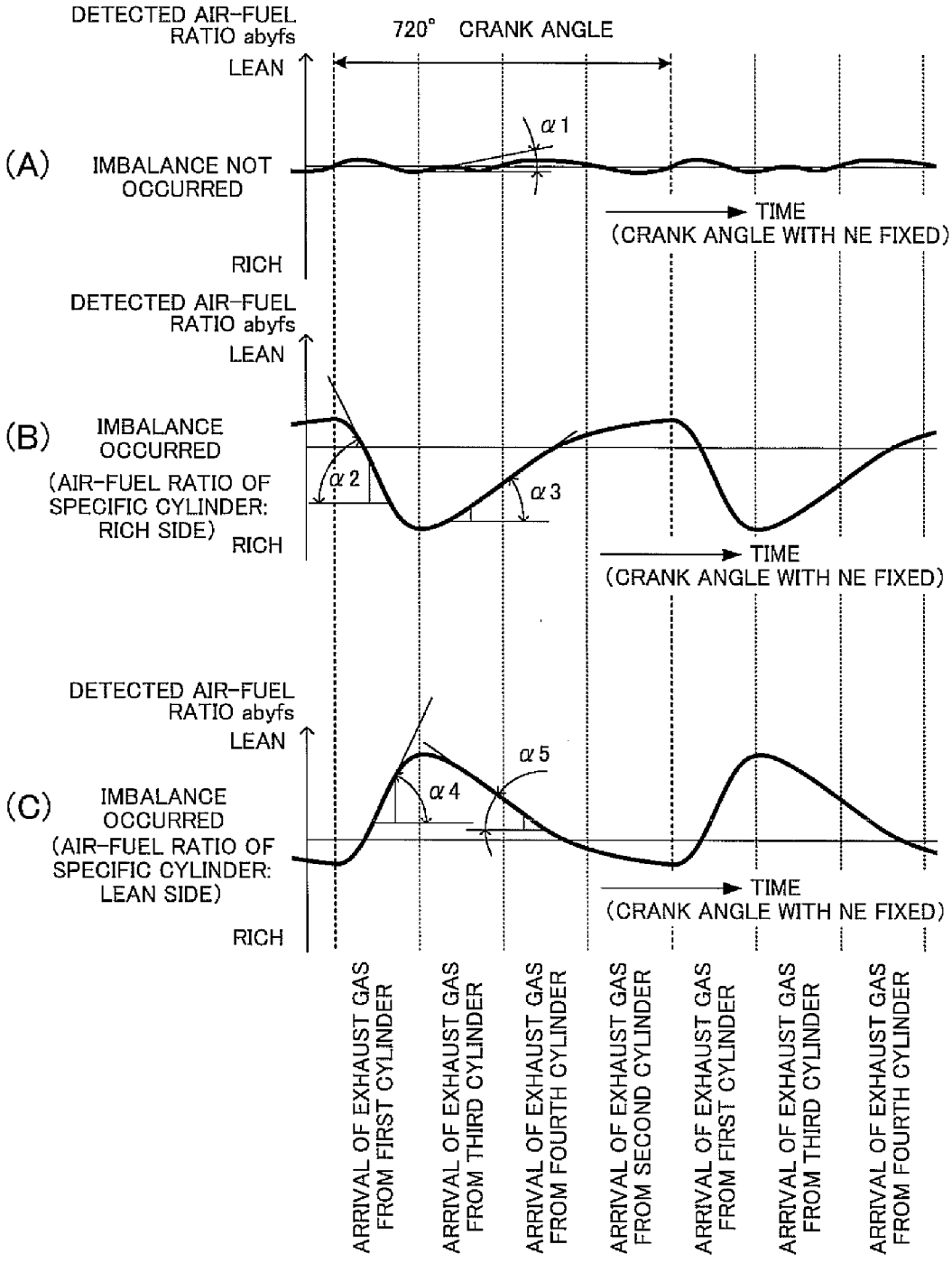
FIG. 4 is a time chart showing changes in the detected air-fuel ratio obtained on the basis of the output value of the air-fuel-ratio sensor, wherein section (A) shows the detected air-fuel ratio in a case where an inter-cylinder air-fuel-ratio imbalance state has not been occurring, and each of sections (B) and (C) shows the detected air-fuel ratio in the case where an inter-cylinder air-fuel-ratio imbalance state has been occurring.

The reason why the "absolute value |AFD1(*n*)| of the present primary data AFD1(*n*)" is added to the previous cumulative value SAFD1(*n*−1) is because the differentiated value dVO2/dt can be either a positive or negative value as can be understood from sections (B) and (C) of FIG. 4. Note that the cumulative value SAFD1(*n*) and the cumulative value SAFD1(*n*−1) are set to "0" in the aforementioned initial routine.

(C) Updating of the accumulation counter Cn.

The CPU 71 increases the value of the counter Cn by an increment of "1." The value of this counter Cn is set to "0" in the above-mentioned initial routine, and also set to "0" in step 1580 described later. Accordingly, the value of the counter Cn indicates the number of absolute values "|AFD1(*n*)| of the primary data" which have been cumulatively added to the cumulative value SAFD1.

Next, the CPU 71 proceeds to step 1535 to determine whether or not the crank angle CA (absolute crank angle CA) is 720° in relation to the top dead center of the compression stroke of the reference cylinder (the first cylinder in the present embodiment). If the absolute crank angle CA is smaller than 720°, the CPU 71 makes a "No" determination in step 1535 and proceeds to step 1595 directly to terminate the present routine temporarily.

Note that step 1535 is a step for determining the minimum unit period (a unit combustion cycle period in the present embodiment) during which the average of absolute values |AFD1(*n*)| of the primary data AFD1(*n*) is obtained. In the present embodiment, the 720° crank angle corresponds to the minimum unit period. Of course, the minimum unit period may be less than the 720° crank angle; however, it is desirably equal to or longer than double the sampling interval ts. That is, the minimum unit period is desirably determined so that a plurality of pieces of the primary data AFD1(*n*) can be obtained within the minimum unit period.

On the other hand, if the absolute crank angle CA is 720° when the CPU 71 performs the processing of step 1535, the CPU 71 makes a "Yes" determination in the same step 1535, and then proceeds to step 1540 to perform the following processing:

(D) Calculation of the average AveAFD of the absolute values |AFD1| of the primary data AFD1;

(E) Calculation of the cumulative value Save of the averages AveAFD; and (F) Increment of the accumulation counter Cs.

Hereinafter, there will be specifically described the methods for updating the above values.

(D) Calculation of the average AveAFD of the absolute values |AFD1| of the primary data AFD1. The CPU 71 obtains the "present average AveAFD(n) (=SAFD1(*n*)/Cn)" of the absolute values |AFD1| of the primary data AFD1 by dividing the cumulative value SAFD1(*n*) by the value of the counter Cn. After this, it is recommended that the CPU 71 set the cumulative value SAFD1(*n*) to "0."

(E) Calculation of the cumulative value Save of the average AveAFD.

The CPU 71 obtains the present cumulative value Save(n) from the expression (10) given below. That is, upon proceeding to step 1540, the CPU 71 updates the cumulative value Save(n) by adding the present average AveAFD(n) obtained as mentioned above to the previous cumulative value Save(n−1). The cumulative value Save(n) is set to "0" in the above-mentioned initial routine.

$$Save(n)=Save(n-1)+AveAFD(n) \tag{10}$$

(F) Increment of the accumulation counter Cs.

The CPU 71 increases the value of the counter Cs by an increment of "1" through use of the expression (11) given below. Cs(n) is the value of the counter Cs after updating, and Cs(n−1) is the value of the counter Cs before updating. The value of the counter Cs is set to "0" in the above-mentioned initial routine. Therefore, the value of the counter Cs indicates the number of the "averages AveAFD" which have been added to the cumulative value Save.

$$Cs(n)=Cs(n-1)+1 \quad (11)$$

Next, the CPU 71 proceeds to step 1545 to determine whether or not the value of the counter Cs is equal to or greater then the threshold Csth. At this time, if the value of the counter Cs is less than the threshold Csth, the CPU 71 makes a "No" determination in the same step 1545, and then proceeds to step 1595 directly to terminate the present routine temporarily. Note that the threshold Csth is a natural number, and is desirably equal to or greater than 2.

On the other hand, if the value of the counter Cs is equal to or greater than the threshold Csth when the CPU 71 performs the processing of step 1545, the CPU 71 makes a "Yes" determination in the same step 1545, and then proceeds to step 1550 to obtain the "concentration-cell-type parameter X1" which is the "air-fuel-ratio fluctuation index quantity AFD used as an imbalance determination parameter."

More specifically, the CPU 71 obtains the concentration-cell-type parameter X1 by dividing the cumulative value Save(n) by the value (=Csth) of the counter Cs in accordance with the following expression (12):

$$X1=\mathrm{Save}(n)/Csth \quad (12)$$

This concentration-cell-type parameter X1 is a value obtained by averaging, over a plurality of unit combustion cycle periods (the number of which corresponds to the value of the Csth), the averages AveAFD which were calculated in the plurality of unit combustion cycle periods and each of which represents the average of the absolute values |AFD1| (=|dVO2/dt|) of the primary data AFD1 for the air-fuel-ratio fluctuation index quantities AFD in the corresponding unit combustion cycle period. Accordingly, the concentration-cell-type parameter X1 is an imbalance determination parameter which increases with the difference in air-fuel ratio between cylinders.

Subsequently, the CPU 71 proceeds to step 1555 to determine whether or not the absolute value of the concentration-cell-type parameter X1 is greater than a "concentration-cell-type-corresponding imbalance determination threshold X1th (first imbalance determination threshold).

The concentration-cell-type-corresponding imbalance determination threshold X1th is set such that, when the value of the concentration-cell-type parameter X1 is greater than the concentration-cell-type-corresponding imbalance determination threshold X1th, emissions exceed the permissible level. Furthermore, the concentration-cell-type-corresponding imbalance determination threshold X1th is desirably set so that it increases with the intake air flow rate Ga. This is because the flow velocity of the exhaust gas flowing in the spaces inside the protective covers (67*b* and 67*c*) increases with the intake air flow rate Ga, and consequently the concentration-cell-type parameter X1 increases with the intake air flow rate Ga even when the degree of inter-cylinder imbalance of air-fuel ratio does not change.

At this time, if the absolute value of the concentration-cell-type parameter X1 is greater than the concentration-cell-type-corresponding imbalance determination threshold X1th, the CPU 71 makes a "Yes" determination in step 1555, and then proceeds to step 1560 to set the value of the imbalance occurrence flag XINB to "1." That is, the CPU 71 determines that an inter-cylinder air-fuel-ratio imbalance state has occurred. Furthermore, the CPU 71 may turn on a warning lamp which is not shown in FIG. 7. Note that the value of the imbalance occurrence flag XINB is stored in the backup RAM 74. Next, the CPU 71 proceeds to step 1570.

In contrast, if the value of the concentration-cell-type parameter X1 is equal to or less than the concentration-cell-type-corresponding imbalance determination threshold X1th when the CPU 71 performs the processing of step 1555, the CPU 71 makes a "No" determination in step 1555, and then proceeds to step 1565 to set the value of the imbalance occurrence flag XINB to "2." That is, the CPU 71 memorizes the "fact that it has determined that an inter-cylinder air-fuel-ratio imbalance state has not occurred according to the result of the inter-cylinder air-fuel-ratio imbalance determination." Next, the CPU 71 proceeds to step 1570. Note that step 1565 may be omitted.

In step 1570, the CPU 71 sets the value of the oxygen concentration sensor FB control flag XO2FB to "0." Thus, there is realized the "voltage applied state in which the voltage Vp is applied" between the "exhaust-gas-side electrode layer 672 and the atmosphere-side electrode layer 673" (see steps 1710 and 1730 in FIG. 17 which will be described later), and the wide range feedback control is resumed (remember the case where a "Yes" determination is made in step 1410 in FIG. 14 as described above). Subsequently, the CPU 71 proceeds to step 1595 to terminate the present routine temporarily.

On the other hand, if the value of the determination permission flag Xkyoka is not "1" when the CPU 71 proceeds to step 1505, the CPU 71 makes a "No" determination in the same step 1505 and then proceeds to step 1580. Subsequently, the CPU 71 sets (clears) the above-mentioned values (e.g., AFD1, SAFD1, Cn, oxygen concentration sensor FB control flag XO2FB, etc.) to "0," stores a value corresponding to the initial value Vst as the present output value Sa(n), and then proceeds to step 1595 to terminate the present routine temporarily. In the above-described manner, the inter-cylinder air-fuel-ratio imbalance determination using the concentration-cell-type parameter X1 is performed.

<Setting of the Determination Permission Flag Xkyoka>

Next, there will be described processing for executing an "imbalance determination permission flag setting routine." As described previously, the CPU 71 permits or prohibits the "obtainment of an imbalance determination parameter and the execution of the inter-cylinder air-fuel-ratio imbalance determination" on the basis of the value of the determination permission flag Xkyoka. (See step 1505 in FIG. 15.)

The CPU 71 sets the determination permission flag Xkyoka by executing the "determination permission flag setting routine" shown in the flowchart of FIG. 16 each time the predetermined time (4 ms) elapses.

When the predetermined timing is reached, the CPU 71 starts processing from step 1600 shown in FIG. 16 and proceeds to step 1610 to determine whether or not the absolute crank angle CA is a 0° crank angle (=720° crank angle).

If the absolute crank angle CA is not 0° when the CPU 71 performs the processing of step 1610, the CPU 71 makes a "No" determination in the same step 1610 and then proceeds to step 1640 directly.

In contrast, if the absolute crank angle CA is a 0° crank angle when the CPU 71 performs the processing of step 1610, the CPU 71 makes a "Yes" determination in the same step 1610, and then proceeds to step 1620 to determine whether or not a determination execution condition (the first determination execution condition (the concentration-cell-type parameter obtaining condition in the present embodiment)) is satisfied.

The determination execution condition is satisfied when all of the conditions (conditions C0 to C13) described below are satisfied. That is, the determination execution condition is not satisfied when at least one of the conditions (conditions C0 to C13) described below is not satisfied. Note that the determination execution condition may consist of any conditions among the conditions C0 to C13 as long as they include conditions C0 and C3. Each of the conditions C1 to C13 ensures that the current operation state of the engine 10 is a certain operation state in which the "concentration-cell-type parameter and the limiting-current-type parameter" indicating the degree of the inter-cylinder air-fuel-ratio imbalance state with a satisfactory degree of accuracy can be obtained.

(Condition C0) The inter-cylinder air-fuel-ratio imbalance determination has never been performed since the engine 10 was started most recently. This condition C0 is also referred to as the imbalance determination execution request condition. The condition C0 may be replaced with a condition that "the cumulative value of the operation time of the engine 10 or the cumulative value of the intake flow rate Ga" cumulatively calculated after the previous imbalance determination is equal to or greater than a prescribed value.

(Condition C1) A state in which the intake air flow rate Ga (the intake air flow rate Ga measured by the air flow meter 61) is greater than a first threshold air flow rate Ga1*th* has continued for a first feedback threshold time T1*fbth* or longer. That is, the intake air flow rate Ga is greater than the first threshold air flow rate Ga1*th*, and furthermore the time which has elapsed since the intake air flow rate Ga became greater than the first threshold air flow rate Ga1*th* is equal to or longer than the first threshold time T1*th*.

(Condition C2) The main feedback control condition is satisfied.

(Condition C3) Fuel cut control is not being performed. That is, the value of the F/C flag XFC is "0."

(Condition C4) A second threshold time T2*th* has elapsed since the fuel cut control ended.

(Condition C5) Active control is not being performed.

(Condition C6) A third threshold time T3*th* has elapsed since the active control ended.

(Condition C7) The amount of change ΔAccp per unit time in the operation amount Accp of the accelerator pedal 81 (hereinafter also referred to as the "acceleration change amount ΔAccp") which is detected by the accelerator opening sensor 69 is less than the threshold acceleration change amount ΔAccpth (in other words, the acceleration change amount ΔAccp is not equal to or greater than the threshold acceleration change amount ΔAccpth). The acceleration change amount ΔAccp is also referred to as the "accelerating operation change amount."

(Condition C8) A state in which the acceleration change amount ΔAccp is less than the threshold acceleration change amount (threshold acceleration operation change amount) ΔAccpth has continued for a fourth threshold time T4*th* or longer.

(Condition C9) The amount of change ΔGa per unit time in the intake air flow Ga (hereinafter also referred to as an "intake air flow rate change amount ΔGa") is less than a threshold flow rate change amount ΔGath (in other words, the intake air flow rate change amount ΔGa is not equal to or greater than the threshold flow rate change amount ΔGath).

(Condition C10) A state in which the intake air flow rate change amount ΔGa is less than the threshold flow rate change amount ΔGath has continued for a fifth threshold time T5*th* or longer.

(Condition C11) The engine rotational speed NE is less than a "threshold rotational speed NEth which increases with the intake air flow rate Ga."

(Condition C12) The cooling water temperature THW is equal to or higher than a threshold cooling water temperature THWth.

(Condition C13) Evaporated fuel gas is not being purged.

If the determination execution condition is not satisfied when the CPU 71 performs the processing of step 1620, the CPU 71 makes a "No" determination in the same step 1620, and then proceeds to step 1640 directly.

In contrast, if the determination execution condition is satisfied when the CPU 71 performs the processing of step 1620, the CPU 71 makes a "Yes" determination in the same step 1620, and then proceeds to step 1630 to set the value of the determination permission flag Xkyoka to "1." Subsequently, the CPU 71 proceeds to step 1640.

In step 1640, the CPU 71 determines whether or not the above-mentioned determination execution condition is not satisfied. That is, the CPU 71 determines whether or not any one of the above-mentioned "conditions C0 to C13" is not satisfied.

Next, if the determination execution condition is not satisfied, the CPU 71 proceeds from step 1640 to step 1650 to set the value of the determination permission flag Xkyoka to "0," and then proceeds to step 1695 to terminate the present routine temporarily. In contrast, if the determination execution condition is satisfied when the CPU 71 performs the processing of step 1640, the CPU 71 proceeds from step 1640 directly to step 1695 to terminate the present routine temporarily.

As mentioned above, the determination permission flag Xkyoka is set to "1" if the determination execution condition is satisfied when the absolute crank angle becomes 0°, and it is set to "0" when the determination execution condition becomes unsatisfied.

<Air-Fuel-Ratio Sensor Applied Voltage Control>

Next, there will be described processing for performing "air-fuel-ratio sensor applied voltage control." The CPU 71 is designed to execute an "applied voltage control routine" shown in FIG. 17 each time 4 ms (4 milliseconds) elapses.

Accordingly, when the predetermined timing is reached, the CPU 71 starts processing from step 1700, and then proceeds to step 1710 to determine whether or not the value of the oxygen concentration sensor FB control flag XO2FB is "1."

At this time, if the value of the oxygen concentration sensor FB control flag XO2FB is "1," the CPU 71 makes a "Yes" determination in step 1710, and then proceeds to step 1720 to send an instruction for opening the changeover switch 678 to the changeover switch 678. Thus, a voltage application stopped state is achieved. Next, the CPU 71 proceeds to step 1795 to terminate the present routine temporarily.

On the other hand, if the value of the oxygen concentration sensor FB control flag XO2FB is "0" when the CPU 71 performs the processing of step 1710, the CPU 71 makes a "No" determination in the same step 1710, and then proceeds to step 1730 to send an instruction for closing the changeover switch 678 to the changeover switch 678. Thus, a voltage applied state is achieved. Next, the CPU 71 proceeds to step 1795 to terminate the present routine temporarily.

As mentioned above, the first determination apparatus is applied to the multicylinder internal combustion engine 10 which has a plurality of cylinders. The first determination apparatus has the air-fuel-ratio sensor 67 which functions as the limiting-current-type wide range air-fuel-ratio sensor in the voltage applied state and functions as the concentration-cell-type oxygen concentration sensor in the voltage application stopped state. Moreover, the first determination apparatus has voltage application means (see the power supply 677, the changeover switch 678, the routine shown in FIG. 17, etc.) which realizes the above-mentioned voltage applied state and the above-mentioned voltage application stopped state.

In addition, the first determination apparatus has wide range feedback control means.

Figure 13:
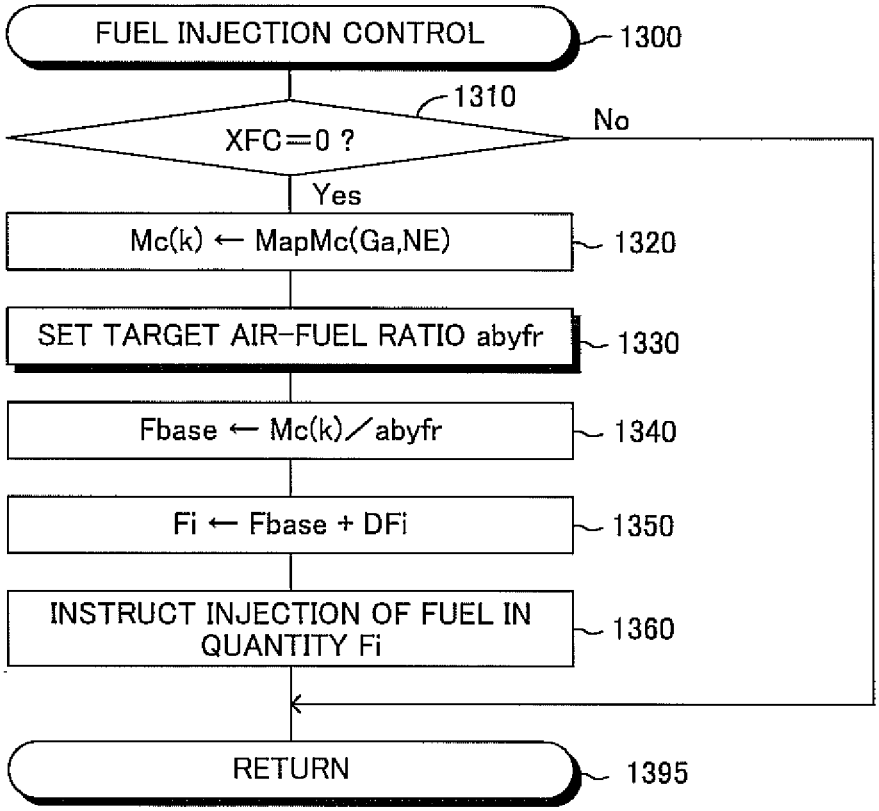
FIG. 13 is a flowchart showing a routine executed by the CPU of an inter-cylinder air-fuel-ratio imbalance determination apparatus (first determination apparatus) according to a first embodiment of the present invention.

The wide range feedback control means:

(1) sends an instruction for realizing the above-mentioned voltage applied state to the above-mentioned voltage application means (steps 1710 and 1730 in FIG. 17), (2) calculates the above-mentioned limiting-current-type output value Vabyfs (step 1415 in FIG. 14), and (3) adjusts the quantities (instructed fuel injection quantities Fi) of the fuel injected from the plurality of fuel injection valves 39, on the basis of the value (DFc) which corresponds to the difference between the air-fuel ratio abyfsc represented by the obtained limiting-current-type output value Vabyfs and the target air-fuel ratio abyfr set to the stoichiometric air-fuel ratio, such that the air-fuel ratio abyfsc represented by the limiting-current-type output value Vabyfs coincides with the target air-fuel ratio abyfr (steps 1425 to 1450 in FIG. 14 and step 1350 in FIG. 13).

In addition, the first determination apparatus has imbalance determination parameter obtaining means.

The imbalance determination parameter obtaining means:

(1) sends an instruction for realizing the above-mentioned voltage application stopped state to the above-mentioned voltage application means in stead of the instruction for realizing the above-mentioned voltage applied state (steps 1710 and 1720 in FIG. 17), (2) obtains the above-mentioned concentration-cell-type output value VO2 (step 1525 in FIG. 15), and (3) obtains, based on the obtained concentration-cell-type output value VO2, an imbalance determination parameter (concentration-cell-type parameter X1) whose absolute value increases with the difference between the cylinder-by-cylinder air-fuel ratios, which are the air-fuel ratios of the air-fuel mixtures supplied to the above-mentioned at least two or more of the cylinders (steps 1520 to 1550 in FIG. 15).

In addition, the first determination apparatus has imbalance determination means which determines that there has occurred an inter-cylinder air-fuel-ratio imbalance state in which the above-mentioned difference between the cylinder-by-cylinder air-fuel ratios is greater than the allowable value, when the absolute value of the obtained concentration-cell-type parameter X1 is greater than the predetermined concentration-cell-type-corresponding imbalance determination threshold X1th (steps 1555 to 1565 in FIG. 15).

By virtue of this configuration, the "concentration-cell-type parameter X1 which represents the degree of inter-cylinder air-fuel-ratio imbalance with a satisfactory degree of accuracy" can be obtained as the imbalance determination parameter, and the imbalance determination is performed on the basis of the obtained concentration-cell-type parameter X1. Accordingly, the first determination apparatus can perform accurate imbalance determination.

In addition, the first determination apparatus can perform the wide range feedback control using the "air-fuel-ratio sensor 67 which is used to obtain the concentration-cell-type parameter X1" in a period other than the period during which the concentration-cell-type parameter X1 is obtained. Hence, emissions can be reduced and there is no need to provide a "separate concentration-cell-type oxygen concentration sensor" in the exhaust merging portion HK in addition to the air-fuel-ratio sensor 67. Accordingly, the system price can be reduced.

In addition, the above-mentioned imbalance determination parameter obtaining means:

(1) continuously sends an instruction for realizing the above-mentioned voltage application stopped state to the above-mentioned voltage application means (steps 1710 and 1720 in FIG. 17), when a predetermined condition for obtaining the above-mentioned concentration-cell-type parameter is satisfied (that is, the value of the determination permission flag Xkyoka is set to "1" in steps 1620 and 1630 in FIG. 16 as a result of fulfillment of the determination execution condition, whereby the value of the oxygen concentration sensor FB control flag XO2FB is set to "1" in steps 1505 and 1510 in FIG. 15);

(2) obtains the above-mentioned concentration-cell-type output value VO2 and the above-mentioned concentration-cell-type parameter (steps 1520 to 1550 in FIG. 15); and (3) includes the concentration-cell-type feedback control means for performing the concentration-cell-type feedback control to adjust the quantities of the fuel injected from the plurality of fuel injection valves such that the obtained concentration-cell-type output value VO2 coincides with the target value Vst which corresponds to the stoichiometric air-fuel ratio (steps 1410 and 1455 to 1475 in FIG. 14 and steps 1350, etc. in FIG. 13).

Accordingly, in the period during which the imbalance determination parameter (concentration-cell-type parameter X1) is obtained, the concentration-cell-type feedback control can be performed. As a consequence, even in the period during which the imbalance determination parameter is obtained, significant increase of emissions can be prevented. Furthermore, when the inter-cylinder air-fuel-ratio imbalance state has occurred, the air-fuel ratio of exhaust gas can be rendered fluctuating in the vicinity of the stoichiometric air-fuel ratio. Therefore, the concentration-cell-type parameter X1 can indicate the degree of inter-cylinder air-fuel-ratio imbalance with a more satisfactory degree of accuracy. Moreover, since the changeover switch 678 need not be frequently operated in the period during which the concentration-cell-type parameter X1 is obtained, various problems caused by such a frequent operation of the changeover switch 678 (e.g., increase in computation load of the CPU 71, and noise superimposed on the concentration-cell-type output value VO2 and the limiting-current-type output value Vabyfs) can be prevented.

Second Embodiment

Next, there will be described a determination apparatus according to a second embodiment of the present invention (hereinafter simply referred to as the "second determination apparatus).

When the imbalance determination is performed, the first determination apparatus stops the wide range feedback control, obtains the concentration-cell-type output value VO2 while continuously causing the air-fuel-ratio sensor 67 to function as the concentration-cell-type oxygen concentration sensor, and performs "obtainment of the concentration-cell-type parameter, the imbalance determination, and the concentration-cell-type feedback control" on the basis of the obtained concentration-cell-type output value VO2.

In contrast, the second determination apparatus obtains the limiting-current-type output value Vabyfs, while performing the wide range feedback control, and performs the "obtainment of a limiting-current-type parameter used as the imbalance determination parameter and the imbalance determination using the obtained limiting-current-type parameter" on the basis of the obtained limiting-current-type output value Vabyfs. Furthermore, only when it is assumed that the limiting-current-type parameter cannot sufficiently reflect the degree of the inter-cylinder air-fuel-ratio imbalance state (for example, when the engine 10 enters a "certain operation state in which responsiveness of the air-fuel-ratio sensor 67 functioning as the limiting-current-type wide range air-fuel-ratio sensor is too low to obtain an accurate limiting-current-type parameter"), the second determination apparatus causes the air-fuel-ratio sensor 67 to continuously function as the concentration-cell-type oxygen concentration sensor, and performs the "obtainment of the concentration-cell-type parameter, the imbalance determination using the obtained concentration-cell-type parameter, and the concentration-cell-type feedback control," which are similar to those performed by the first determination apparatus.

As mentioned above, if it is determined that an "accurate imbalance determination parameter" can be obtained under the wide range feedback control when obtaining the imbalance determination parameter, the second determination apparatus obtains the imbalance determination parameter and performs the imbalance determination under the wide range feedback control without switching the air-fuel ratio feedback control from the "wide range feedback control" to the "concentration-cell-type feedback control."

(Actual Operation)

Figure 18:
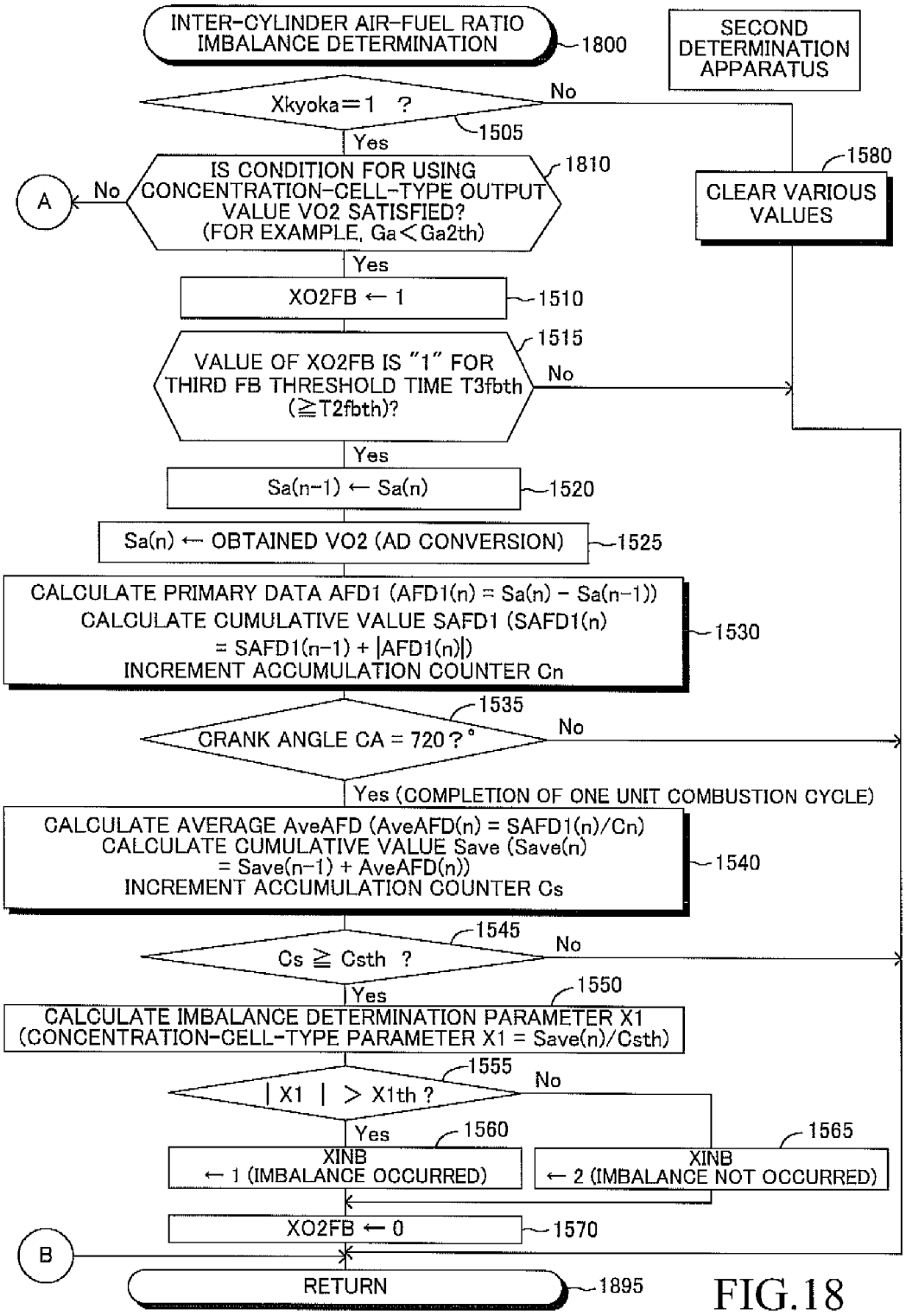
FIG. 18 is a flowchart showing a routine executed by the CPU of an inter-cylinder air-fuel-ratio imbalance determination apparatus (second determination apparatus) according to a second embodiment of the present invention.
Figure 19:
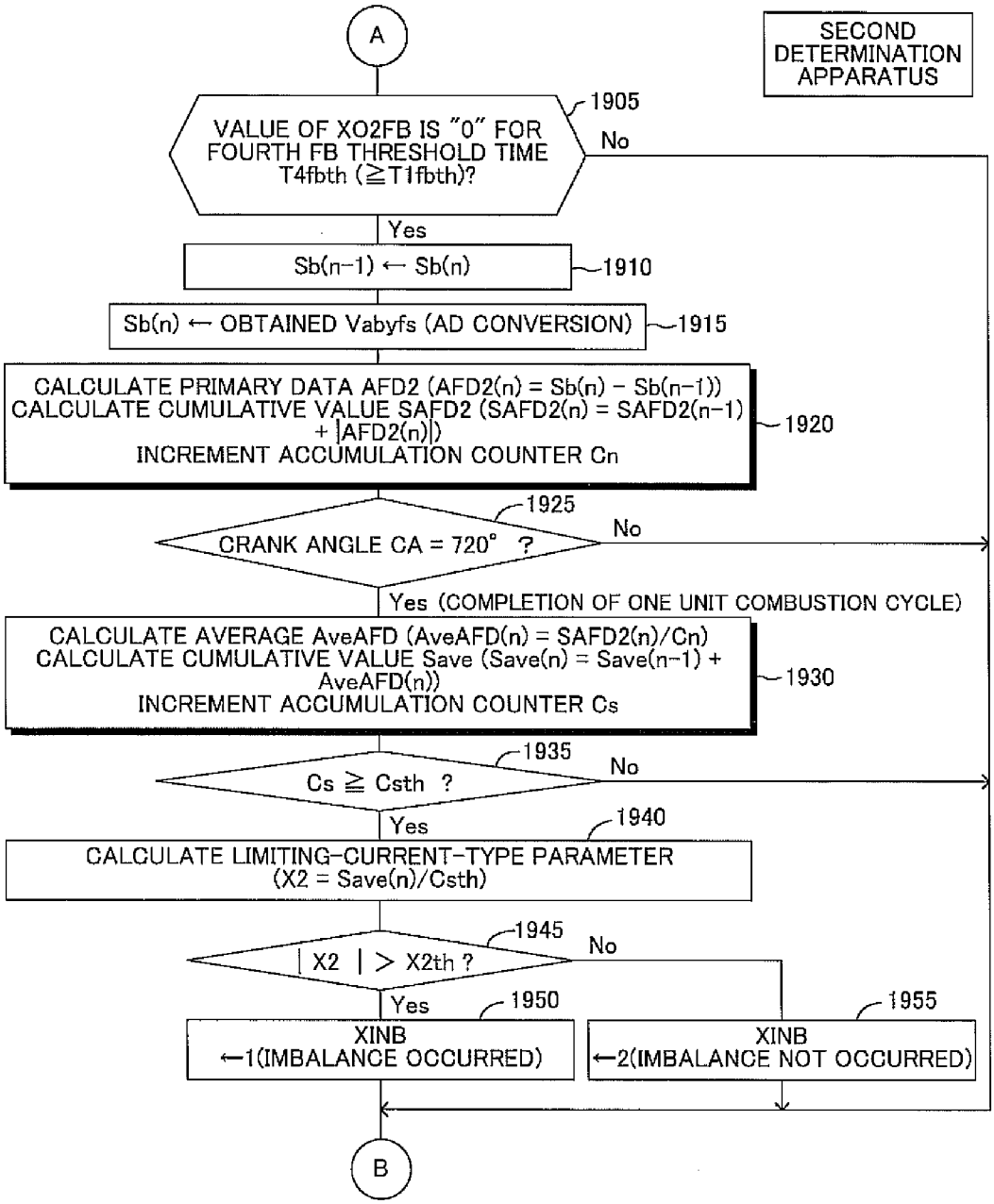
FIG. 19 is a flowchart showing another routine executed by the CPU of the second determination apparatus.

Specifically, the only difference of the second determination apparatus from the first determination apparatus is that its CPU 71 executes the "inter-cylinder air-fuel-ratio imbalance determination routine" shown in FIG. 18 and FIG. 19, instead of the routine shown in FIG. 15, each time a predetermined time (4 ms=sampling interval ts) elapses. Therefore, actual operation will be described focusing on this difference. Notably, steps for performing the same processings as those of the steps having already been described in the present specification will be denoted by the same step numbers as those assigned to the already described steps.

The only difference between the routines shown in FIG. 18 and FIG. 15 is that the routine shown in FIG. 18 has step 1810 between steps 1505 and 1510. Hence, hereafter there will be described only the processing of step 1810.

If the value of the determination permission flag Xkyoka is "1," the CPU 71 makes a "Yes" determination in step 1505 which follows step 1800 of FIG. 18, and then proceeds to step 1810 to determine whether or not a "concentration-cell-type output value use condition" is satisfied.

The concentration-cell-type output value use condition is satisfied when at least one of the conditions D1 to D3 described below is satisfied. That is, the CPU 71 determines whether or not the current operation state is the "certain operation state in which a concentration-cell-type parameter is required to be obtained."

(Condition D1) The intake air flow rate Ga is less than a second threshold air flow rate Ga2*th*. Note that the second threshold air flow rate Ga2*th* is greater than the first threshold air flow rate Ga1*th* used for the above-mentioned condition C1.

(Condition D2) A load KL is lower than a second threshold load KL2*th*. Note that the second threshold load KL2*th* is lower than the first threshold load KL1*th* used for the above-mentioned main feedback control condition A2.

The above-mentioned conditions D1 and D2 define a state in which "the responsiveness of the air-fuel-ratio sensor 67 functioning as the limiting-current-type wide range air-fuel-ratio sensor" is not high enough to "obtain an imbalance determination parameter (limiting-current-type parameter X2) having a satisfactory degree of accuracy through use of the limiting-current-type output value Vabyfs." That is, when the condition D1 or the condition D2 is satisfied, the engine 10 is operated in the certain operation state in which the air-fuel-ratio sensor 67 functioning as the limiting-current-type wide range air-fuel-ratio sensor cannot have a responsiveness equal to or higher than a predetermined threshold level. Notably, only either of the conditions D1 and D2 may be used for the determination performed in step 1810.

(Condition D3) The limiting-current-type parameter X2 which is based on the limiting-current-type output value Vabyfs obtained under the wide range feedback control is less than the limiting-current-type-corresponding imbalance determination threshold X2th. Preferably, the condition D3 is satisfied when the limiting-current-type parameter X2 is less than an upper-side threshold which is smaller than the limiting-current-type-corresponding imbalance determination threshold X2th, and furthermore is greater than a lower-side threshold which is greater than 0 but is smaller than the upper-side threshold. This lower-side threshold is set such that, when the limiting-current-type parameter X2 is less than the lower-side threshold, the CPU 71 can clearly determine that the inter-cylinder air-fuel-ratio imbalance state has not occurred. Note that the condition D3 may be omitted from the conditions for performing the determination in step 1810. Furthermore, only this condition D3 may be adopted in step 1810.

If the CPU 71 determines, in step 1810, that the above-mentioned "concentration-cell-type output value use condition" is satisfied, it proceeds from step 1810 to step 1510 and steps subsequent thereto. Accordingly, the value of the oxygen concentration sensor FB control flag XO2FB is set to "1" in step 1510, and, as a result of performance of the routine shown in FIG. 17, the voltage application stopped state, in which the voltage application to the air-fuel-ratio sensor 67 is stopped, is realized. Furthermore, since steps 1515 to 1570 shown in FIG. 18 are executed, the concentration-cell-type parameter X1 is obtained on the basis of the concentration-cell-type output value VO2, and the imbalance determination is performed on the basis of the obtained concentration-cell-type parameter X1. In addition, steps 1465 to 1475 shown in FIG. 14 are executed, whereby the air-fuel ratio feedback control is switched from the wide range feedback control to the concentration-cell-type feedback control.

In contrast, if the concentration-cell-type output value use condition is not satisfied when the CPU 71 performs the processing of step 1810, the CPU 71 makes a "No" determination in the same step 1810, and then proceeds from the step 1810 to step 1905 shown in FIG. 19 (see the circled letter "A" in FIG. 18 and FIG. 19).

Upon proceeding to step 1905 shown in FIG. 19, the CPU 71 determines whether or not the period during which the value of the oxygen concentration sensor FB control flag XO2FB is held at "0" (duration T4) is equal to or longer than a fourth feedback threshold time T4*fbth*. The fourth threshold time T4*fbth* is set to a time longer than the first feedback threshold time T1*fbth*. In other words, when the duration T4 becomes the fourth feedback threshold time T4*fbth* or longer, the wide range feedback control has been performed continuously for a period of time sufficient for obtaining a "highly accurate imbalance determination parameter (limiting-current-type parameter) X2 on the basis of the limiting-current-type output value Vabyfs." Note that step 1905 may be omitted. In such a case, the CPU 71 proceeds from step 1810 shown in FIG. 18 directly to step 1910 shown in FIG. 19.

If the duration T4 is not equal to or longer than the fourth feedback threshold time T4*fbth* when the CPU 71 performs the processing of step 1905, the CPU 71 proceeds from step 1905 shown in FIG. 19 directly to step 1895 shown in FIG. 18 to terminate the present routine temporarily (see the circled letter "B" in FIG. 18 and FIG. 19).

On the other hand, if the duration T4 is equal to or longer than the fourth feedback threshold time T4*fbth* when the CPU 71 performs the processing of step 1905 shown in FIG. 19, the CPU 71 makes a "Yes" determination in the same step 1905, and then proceeds to step 1910. Next, as described below, the CPU 71 obtains the limiting-current-type parameter X2 on the basis of the limiting-current-type output value Vabyfs, and then compares the obtained limiting-current-type parameter X2 with the limiting-current-type-corresponding imbalance determination threshold X2th to perform the imbalance determination.

In step 1910, the same processing as that of step 1520 of FIG. 15 is performed. That is, the CPU 71 stores an "Sb(n) which is the limiting-current-type output value Vabyfs retained in the RAM 73 at the present point in time" as a previous output value Sb(n−1). That is, the previous output value Sb(n−1) is a value obtained through AD conversion of the limiting-current-type output value Vabyfs which was retained at a point 4 ms (sampling time ts) before the present point in time. Note that the initial value of the value Sb(n) is set to a value which corresponds to the value obtained through AD conversion of the stoichiometric air-fuel ratio equivalent value Vstoich.

Next, the CPU 71 proceeds to step 1915 to obtain the "limiting-current-type output value Vabyfs which is an output value of the air-fuel-ratio sensor 67 at the present point in time" through AD conversion, and stores the obtained value as the present output value Sb(n).

Next, the CPU 71 proceeds to 1920 to perform the processing which is similar to that of step 1530 of FIG. 15. That is, in step 1920, the CPU 71 updates the following data:

(G) the primary data AFD2 for the air-fuel-ratio fluctuation index quantity AFD;

(H) the cumulative value SAFD2 of the absolute value |AFD2| of the primary data AFD2; and (I) the accumulation counter Cn which indicates the number of times the absolute value |AFD2| of the primary data AFD2 is cumulatively added to the cumulative value SAFD2.

The methods for updating the above data will be specifically described below.

Note that the primary data AFD2 for the air-fuel-ratio fluctuation index quantity AFD is the source data for obtaining the limiting-current-type parameter X2, which is the above-mentioned air-fuel-ratio fluctuation index quantity AFD. In the present embodiment, the limiting-current-type parameter X2 is a value corresponding to the differentiated value d(Vabyfs)/dt of the limiting-current-type output value Vabyfs. Therefore, the primary data AFD2 is the differentiated value d(Vabyfs)/dt. Notably, the air-fuel-ratio fluctuation index quantity AFD may be any of various imbalance determination parameters. Accordingly, for example, when the limiting-current-type parameter X2 is a value corresponding to a "second order time differentiated value $d^2$(Vabyfs)/$dt^2$) of the limiting-current-type output value Vabyfs," the primary data AFD2 for the air-fuel-ratio fluctuation index quantity AFD is the "second order differentiated value $d^2$(Vabyfs)/$dt^2$."

(G) Updating of the primary data AFD2 for the air-fuel-ratio fluctuation index quantity AFD.

The differentiated value d(Vabyfs)/dt can be obtained as an amount of change in the limiting-current-type output value Vabyfs during the sampling interval is (i.e., an output change rate ΔVabyfs). The CPU 71 obtains this output change rate ΔVabyfs (namely, the differentiated value d(Vabyfs)/dt) by subtracting the previous output value Sb(n−1) from the present output value Sb(n). That is, in step 1920, the CPU 71 obtains a "present primary data AFD2(*n*) for the air-fuel-ratio fluctuation index quantity" from the following expression (13):

$$AFD2(n)=Sb(n)-Sb(n-1) \tag{13}$$

(H) Updating of the cumulative value SAFD2 of the "absolute value |AFD2| of the primary data AFD2."

The CPU 71 obtains the present cumulative value SAFD2(*n*) from the expression (14) given below. That is, in step 1920, the CPU 71 updates the cumulative value SAFD2 by adding the "absolute value |AFD2(*n*)| of the present primary data AFD2(*n*) calculated as mentioned above" to the previous cumulative value SAFD2(*n*−1).

$$SAFD2(n)=SAFD2(n-1)+|AFD2(n)| \tag{14}$$

The reason why the "absolute value |AFD2(*n*)| of the present primary data AFD2(*n*)" is added to the previous cumulative value SAFD2(*n*−1) is because the differentiated value d(Vabyfs)/dt can be either a positive or negative value as can be understood from sections (B) and (C) of FIG. 4. Note that the cumulative value SAFD2(*n*) and the cumulative value SAFD2(*n*−1) are also set to "0" in the above-mentioned initial routine.

(I) Updating of the accumulation counter Cn.

The CPU 71 increases the value of the counter Cn by an increment of "1." The value of the counter Cn indicates the number of "absolute values |AFD2(*n*)| of the primary data" which have been cumulatively added to the cumulative value SAFD2.

Next, the CPU 71 executes steps 1925 to 1940 to compute the "limiting-current-type parameter X2 used as an imbalance determination parameter." In steps 1925 to 1940, the same processing as that of steps 1535 to 1550 shown in FIG. 15 is performed.

That is, as a result of performance of the processing of steps 1925 and 1930, an "average AveAFD(n)(=SAFD2(*n*)/Cn) of the absolute values of the primary data AFD2" within the unit combustion cycle period is computed each time the unit combustion cycle period elapses (each time the crank angle increases by 720°), the obtained average AveAFD is added to the cumulative value Save, and the accumulation counter Cs is increased by an increment of "1."

Next, when the value of the counter Cs becomes equal to or greater than the threshold Csth, the CPU 71 proceeds from step 1935 to step 1940 to divide the cumulative value Save (n) by the value (=Csth) of the Counter Cs so as to obtain an imbalance determination parameter (limiting-current-type parameter X2).

This limiting-current-type parameter X2 is a value obtained by averaging, over a plurality of unit combustion cycle periods (the number of which corresponds to the value of the Csth), the averages AveAFD which were calculated in the plurality of unit combustion cycle periods and each of which represents the average of the absolute values |AFD2| (=|d(Vabyfs)/dt|) of the primary data AFD2 for the air-fuel-ratio fluctuation index quantities AFD in the corresponding unit combustion cycle period. Accordingly, the limiting-current-type parameter X2 is an imbalance determination parameter which increases with the difference between the cylinder-by-cylinder air-fuel ratios. Note that the limiting-current-type parameter obtained in this step 1940 is used to determine whether or not the above-mentioned condition D3 is satisfied.

Subsequently, the CPU 71 proceeds to step 1945 to determine whether or not the absolute value of the limiting-current-type parameter X2 is greater than the "limiting-current-type-corresponding imbalance determination threshold X2th (second imbalance determination threshold)." The limiting-current-type-corresponding imbalance determination threshold X2th is set such that, when the limiting-current-type parameter X2 is greater than the limiting-current-type-corresponding imbalance determination threshold X2th, the amount of emissions exceeds the permissible level. Furthermore, the limiting-current-type-corresponding imbalance determination threshold X2th is desirably set such that it increases with the intake air flow rate Ga just like the concentration-cell-type-corresponding imbalance determination threshold X1th.

Subsequently, if the absolute value of the limiting-current-type parameter X2 is greater than the limiting-current-type-corresponding imbalance determination threshold X2th, the CPU 71 makes a "Yes" determination in step 1945, and then proceeds to step 1950 to set the value of the imbalance occurrence flag XINB to "1." At this time, the CPU 71 may turn on an unillustrated warning lamp. Next, the CPU 71 proceeds to step 1895 of FIG. 18 to terminate the present routine temporarily (see the circled letter "B" in FIG. 18 and FIG. 19).

In contrast, if the limiting-current-type parameter X2 is equal to or less than the limiting-current-type-corresponding imbalance determination threshold X2th when the CPU 71 performs the processing of step 1945, the CPU 71 makes a "No" determination in step 1945, and then proceeds to step 1955 to set the value of the imbalance occurrence flag XINB to "2." That is, the CPU 71 memorizes the "fact that it has determined, through the inter-cylinder air-fuel-ratio imbalance determination, that the inter-cylinder air-fuel-ratio imbalance state has not occurred." Next, the CPU 71 proceeds to step 1895 shown in FIG. 18 to terminate the present routine temporarily (see the circled letter "B" in FIG. 18 and FIG. 19). Note that step 1955 may be omitted. In such a case, the CPU 71 proceeds from step 1945 directly to step 1895 shown in FIG. 18 to terminate the present routine temporarily.

As mentioned above, the imbalance determination parameter obtaining means of the second determination apparatus:

(1) obtains the above-mentioned limiting-current-type output value Vabyfs when the instruction for realizing the above-mentioned voltage applied state is sent to the above-mentioned voltage application means (step 1915 in FIG. 19);

(2) obtains the limiting-current-type parameter X2 on the basis of the obtained limiting-current-type output value Vabyfs (steps 1910 to 1940 in FIG. 19); and (3) obtains the above-mentioned concentration-cell-type output value VO2 and the above-mentioned concentration-cell-type parameter X1 (steps 1520 to 1550 in FIG. 18) by sending the instruction for realizing the above-mentioned voltage application stopped state to the above-mentioned voltage application means instead of the above-mentioned instruction for realizing the above-mentioned voltage applied state (step 1510 in FIG. 18 and steps 1710 and 1720 in FIG. 17) when the engine 10 enters a certain operation state in which the responsiveness of the air-fuel-ratio sensor 67 functioning as the limiting-current-type wide range air-fuel-ratio sensor is below the predetermined threshold level (remember conditions D1 and D2 and the case where the "Yes" determination is made in step 1810 in FIG. 18), and (4) includes the concentration-cell-type feedback control means for performing the control (concentration-cell-type feedback control) adapted to adjust the quantities (instructed fuel injection quantities Fi) of the fuel injected from the plurality of fuel injection valves 39 such that the obtained concentration-cell-type output value VO2 coincides with the target value Vst which corresponds to the stoichiometric air-fuel ratio (steps 1410 and 1455 to 1475 in FIG. 14 and step 1350 in FIG. 13).

Furthermore, the wide range feedback control means of the second determination apparatus is configured so as to stop the above-mentioned wide range feedback control when the above-mentioned concentration-cell-type feedback control is performed (see the case where a "No" determination is made in step 1410 of FIG. 14, whereby steps 1415 to 1450 of FIG. 14 are not executed).

Furthermore, the imbalance determination means of the second determination apparatus is configured such that the CPU 71 determines that the above-mentioned inter-cylinder air-fuel-ratio imbalance state has occurred, when the absolute value of the obtained limiting-current-type parameter X2 is greater than the predetermined limiting-current-type-corresponding imbalance determination threshold X2th (steps 1945 to 1955 in FIG. 19).

Hence, the "obtainment of the concentration-cell-type output value VO2 and the concentration-cell-type parameter X1 and the concentration-cell-type feedback control" are not performed in the case where the responsiveness of the air-fuel-ratio sensor 67 functioning as the limiting-current-type wide range air-fuel-ratio sensor is sufficiently high, and accurate inter-cylinder air-fuel-ratio imbalance determination can be performed through use of the limiting-current-type parameter X2 obtained on the basis of the limiting-current-type output value Vabyfs. As a result, the CPU 71 can perform the inter-cylinder air-fuel-ratio imbalance determination, while frequently performing the wide range feedback control which can maintain the amount of emissions at a more proper level, as compared with the concentration-cell-type feedback control.

In addition, when the engine enters the predetermined operation state in which the air-fuel-ratio sensor 67 functioning as the limiting-current-type wide range air-fuel-ratio sensor has a responsiveness equal to or higher than the predetermined threshold level, the voltage application stopped state is realized, the concentration-cell-type output value VO2 is obtained, and "obtainment of the concentration-cell-type parameter X1, the imbalance determination based on the concentration-cell-type parameter X1, and the concentration-cell-type feedback control" are performed on the basis of the obtained concentration-cell-type output value VO2. Accordingly, the imbalance determination can be executed more accurately.

Furthermore, even in the period during which the concentration-cell-type output value VO2 is obtained to obtain the concentration-cell-type parameter, the air-fuel ratio of the engine can be controlled under the concentration-cell-type feedback control. Consequently, the determination apparatus can continue the voltage application stopped state, while executing the air-fuel ratio feedback control for the engine.

Furthermore, the imbalance determination parameter obtaining means of the second determination apparatus is configured so as to obtain the above-mentioned concentration-cell-type output value VO2 and the above-mentioned concentration-cell-type parameter (steps 1520 to 1550 in FIG. 18) by sending the instruction for realizing the above-mentioned voltage application stopped state to the above-mentioned voltage application means instead of the instruction for realizing the above-mentioned voltage applied state (step 1510 in FIG. 18 and steps 1710 and 1720 in FIG. 17) when the absolute value of the obtained limiting-current-type parameter X2 is less than the limiting-current-type-corresponding imbalance determination threshold X2th (see the condition D3).

If it is determined that "the inter-cylinder air-fuel-ratio imbalance state has occurred" as a result of the imbalance determination performed on the basis of the limiting-current-type parameter X2, there is no need to perform the inter-cylinder air-fuel-ratio imbalance determination through use of the concentration-cell-type parameter X1. Accordingly, the above-mentioned embodiment can reduce the frequency of execution of the concentration-cell-type feedback control. As a result, the inter-cylinder air-fuel-ratio imbalance determination can be performed accurately by obtaining the concentration-cell-type parameter X1 as needed, while preventing the amount of emissions from increasing.

Third Embodiment

Next, there will be described a determination apparatus according to a third embodiment of the present invention (hereinafter referred to simply as a "third determination apparatus").

The third determination apparatus obtains a concentration-cell-type output value VO2 and the concentration-cell-type parameter X1 based on the obtained concentration-cell-type output value VO2 by using the air-fuel-ratio sensor 67 as the "limiting-current-type wide range air-fuel-ratio sensor and the concentration-cell-type oxygen concentration sensor" alternately, performs the imbalance determination on the basis of the obtained concentration-cell-type parameter X1, and performs the wide range feedback control continuously by obtaining the limiting-current-type output value Vabyfs even in the period during which the concentration-cell-type parameter X1 is obtained.

Figure 20:
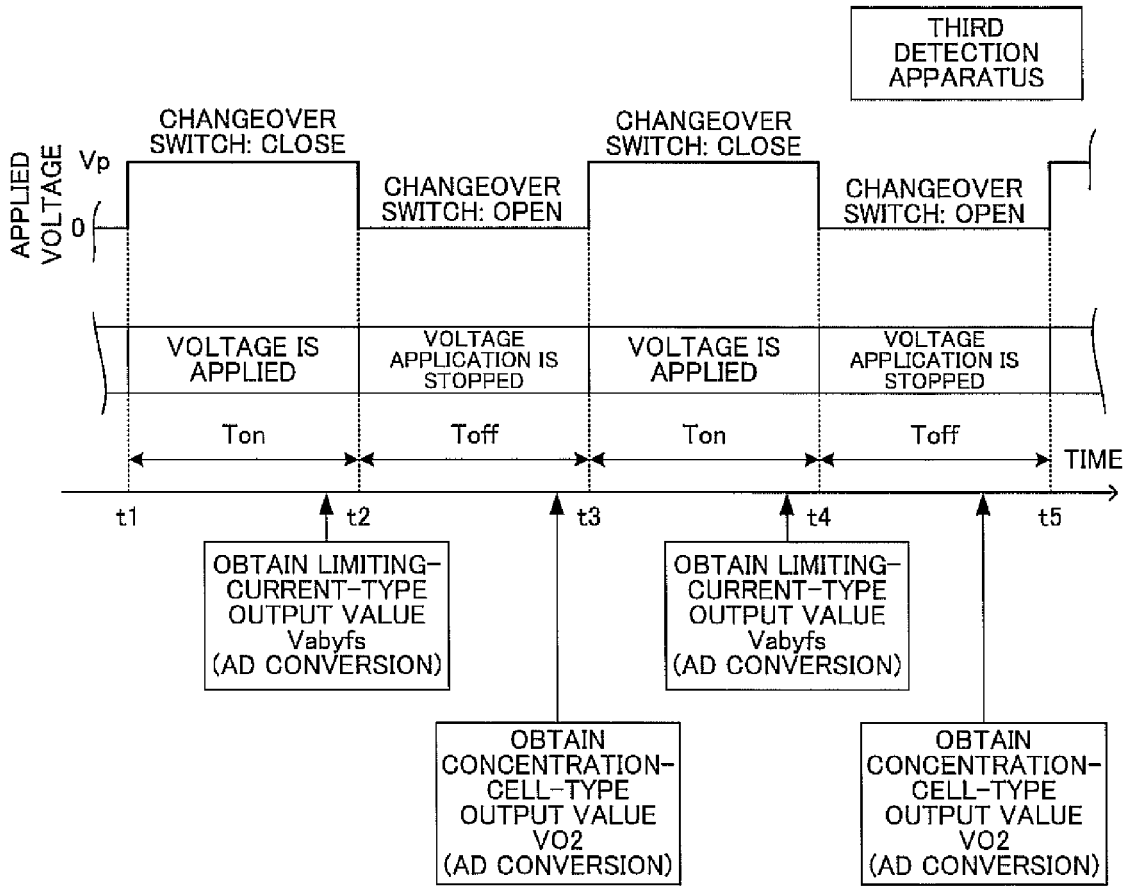
FIG. 20 is a time chart for describing operation of an inter-cylinder air-fuel-ratio imbalance determination apparatus (third determination apparatus) according to a third embodiment of the present invention.

More specifically, as shown in the timing chart of FIG. 20, the third determination apparatus repeatedly opens and closes the changeover switch 678 at short intervals. That is, the third determination apparatus repeats a cycle in which "it closes the changeover switch 678 for a time Ton (e.g., 4 ms) to realize the voltage applied state, and subsequently it opens the changeover switch 678 for a time Toff (e.g., 4 ms) to realize the voltage application stopped state." That is, in the example shown in FIG. 20, the voltage applied state is realized in the period from t1 to t2, the voltage application stopped state is realized in the period from t2 to t3, the voltage applied state is realized in the period from t3 to t4, and the voltage application stopped state is realized in the period from t4 to t5. After that, the voltage applied state and the voltage application stopped state are repeatedly realized in the same manner.

Moreover, in periods (e.g., in the period from t1 to t2 and the period from t3 to t4) during which the air-fuel-ratio sensor 67 functions as the limiting-current-type wide range air-fuel-ratio sensor as a result of realization of the voltage applied state, the third determination apparatus obtains the limiting-current-type output value Vabyfs (through AD conversion), and then performs the wide range feedback control through use of the obtained limiting-current-type output value Vabyfsin.

In addition, in periods (e.g., in the period from t2 to t3 and the period from t4 to t5) during which the air-fuel-ratio sensor 67 functions as the concentration-cell-type oxygen concentration sensor as a result of realization of the voltage application stopped state, the third determination apparatus obtains the concentration-cell-type output value VO2 (through AD conversion), obtains the concentration-cell-type parameter X1 through use of the obtained concentration-cell-type output value VO2, and then performs the imbalance determination through use of the obtained concentration-cell-type parameter X1.

(Actual Operation)

The CPU 71 of the third determination apparatus executes the routines shown in FIG. 13, FIG. 16 and FIG. 21 to FIG. 23. The routines shown in FIG. 13 and FIG. 16 have already been described. Therefore, there will be described actual operation of the third determination apparatus focusing on the routines shown in FIG. 21 and FIG. 23.

Figure 21:
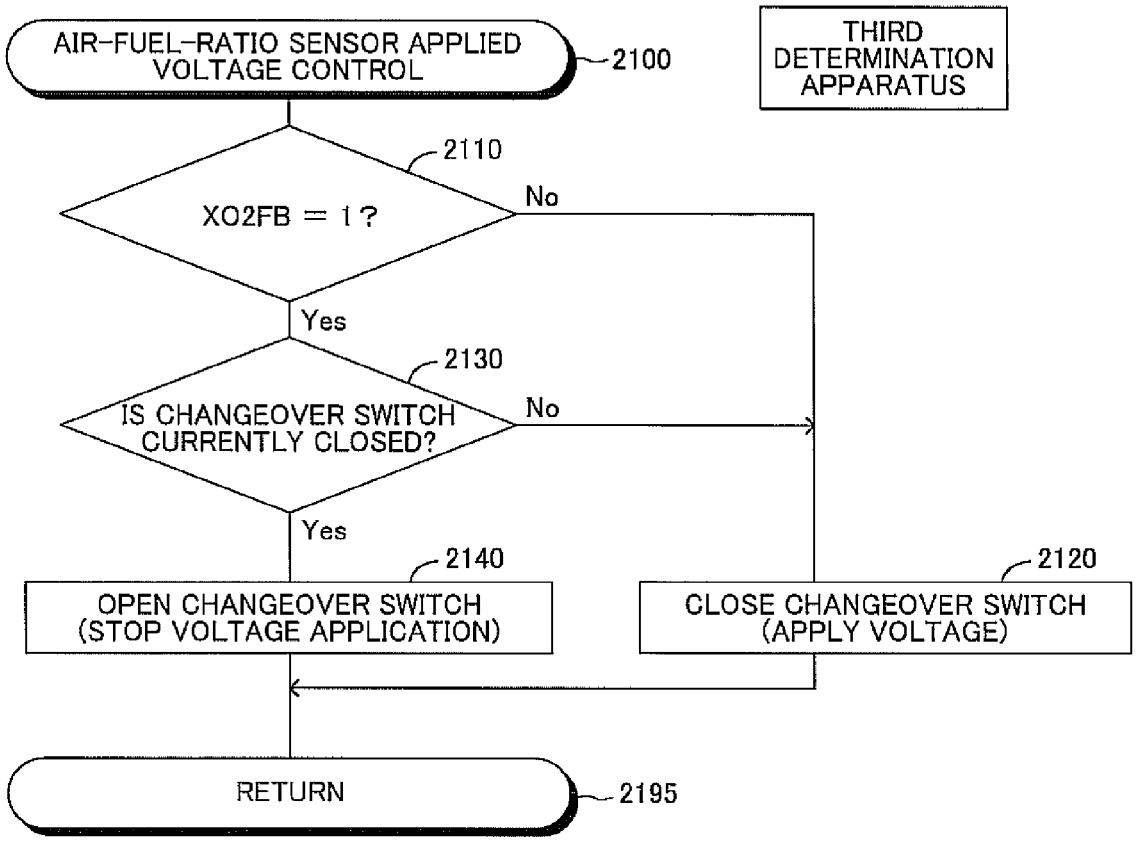
FIG. 21 is a flowchart showing another routine executed by the CPU of the third determination apparatus.

The CPU 71 of the third determination apparatus is designed to execute an "air-fuel-ratio sensor applied voltage control routine" shown in FIG. 21 each time the predetermined time (4 ms) elapses.

Accordingly, when the predetermined timing is reached, the CPU 71 starts processing from step 2100, and proceeds to step 2110 to determine whether or not the value of the oxygen concentration sensor FB control flag XO2FB is "1."

At this time, if the value of the oxygen concentration sensor FB control flag XO2FB is "0," the CPU 71 proceeds to step 2120 to send the "instruction for closing the changeover switch 678" to the changeover switch 678. Thus, the voltage applied state is realized. Subsequently, the CPU 71 proceeds to step 2195 to terminate the present routine temporarily. This routine is repeatedly executed as long as the value of the oxygen concentration sensor FB control flag XO2FB is "0." Therefore, when the value of the oxygen concentration sensor FB control flag XO2FB is "0," the voltage applied state is realized continuously, and consequently the air-fuel-ratio sensor 67 functions only as the limiting-current-type wide range air-fuel-ratio sensor.

In contrast, if the value of the oxygen concentration sensor FB control flag XO2FB is "1" when the CPU 71 performs the processing of step 2110, the CPU 71 proceeds to step 2130 to determine "whether or not the changeover switch 578 is closed at the present point in time." At this time, if the changeover switch 678 is closed, the CPU 71 proceeds from step 2130 to step 2140 to send the "instruction for opening the changeover switch 678" to the changeover switch 678. Thus, the voltage application stopped state is achieved, and consequently the air-fuel-ratio sensor 67 functions as the concentration-cell-type oxygen concentration sensor. Next, the CPU 71 proceeds to step 2195 to terminate the present routine temporarily.

If the CPU 71 again performs the processing of step 2130 after lapse of the predetermined time in the above-mentioned state, the CPU 71 proceeds from step 2130 to step 2120 because the changeover switch 678 is open, and then sends the "instruction for closing the changeover switch 678" to the changeover switch 678. Thus, the voltage applied state is achieved, and consequently the air-fuel-ratio sensor 67 functions as the limiting-current-type wide range air-fuel-ratio sensor. Next, the CPU 71 proceeds to step 2195 to terminate the present routine temporarily.

As a result, if the value of the oxygen concentration sensor FB control flag XO2FB is "1," the changeover switch opens and closes alternately each time the predetermined time (4 ms, Ton, Toff) elapses. Accordingly, the air-fuel-ratio sensor 67 alternately enters the state in which it functions as the concentration-cell-type oxygen concentration sensor and the state in which it functions as the limiting-current-type wide range air-fuel-ratio sensor each time the predetermined time elapses.

<Computation of a Main Feedback Quantity>

Figure 22:
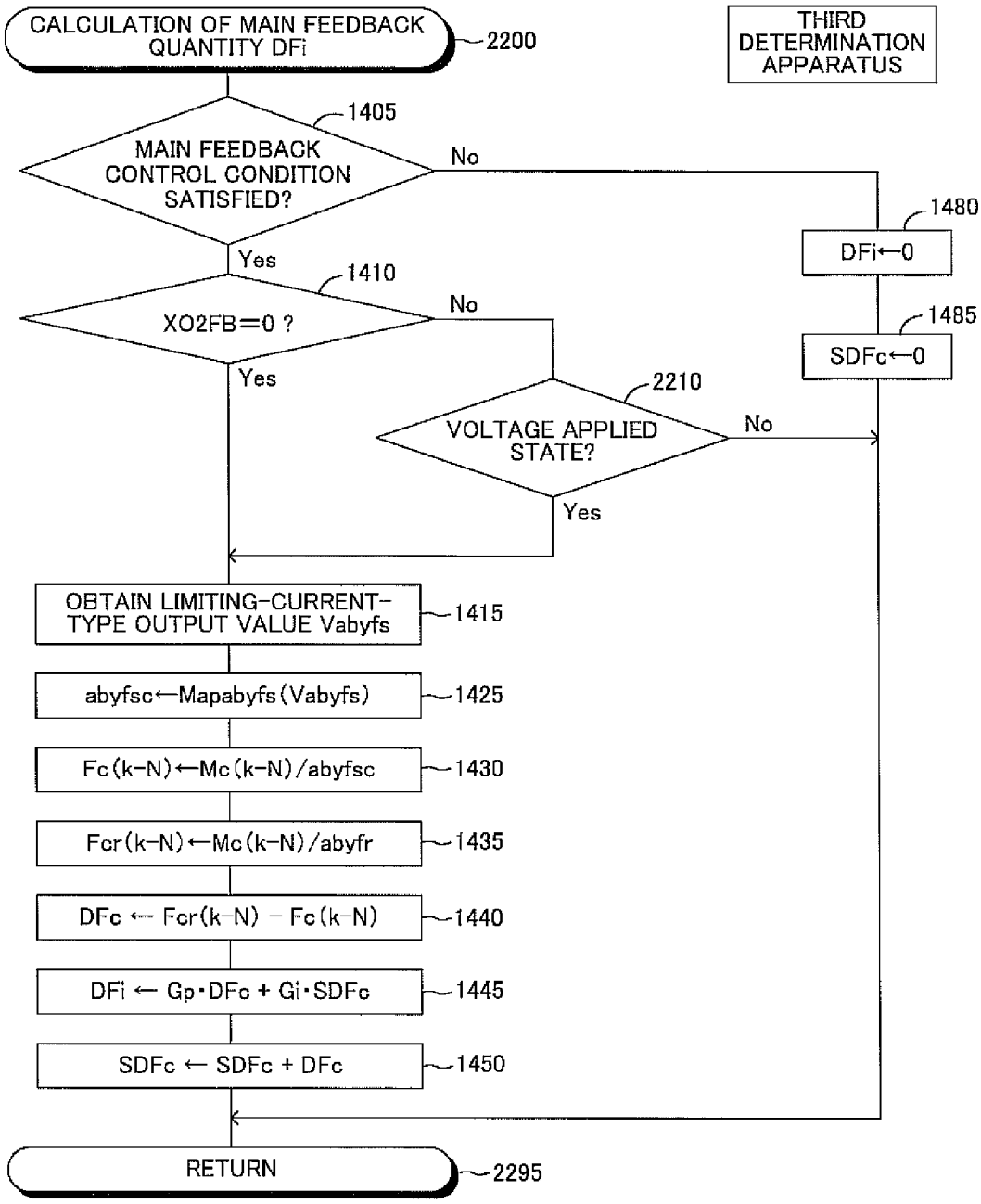
FIG. 22 is a flowchart showing another routine executed by the CPU of the third determination apparatus.

The CPU 71 repeatedly executes a "main feedback quantity computation routine" shown in the flowchart of FIG. 22 each time the predetermined time (4 ms) elapses. Accordingly, when the predetermined timing is reached, the CPU 71 starts processing from step 2200, and then proceeds to step 1405 to determine whether or not the "above-mentioned main feedback control condition" is satisfied. If the main feedback control condition is not satisfied, the CPU 71 performs the above-mentioned processing of steps 1480 and 1485, and then proceeds to step 2295 to terminate the present routine temporarily.

In contrast, if the main feedback control condition is satisfied, the CPU 71 proceeds from step 1405 to step 1410 to determine whether or not the value of the oxygen concentration sensor FB control flag XO2FB is "0."

At this time, if the value of the oxygen concentration sensor FB control flag XO2FB is "0," the CPU 71 makes a "Yes" determination in step 1410 and then performs the above-mentioned processing of steps 1415 to 1450. As mentioned above, when the value of the oxygen concentration sensor FB control flag XO2FB is "0," the voltage applied state is realized continuously. As a result, the air-fuel-ratio sensor 67 functions as the limiting-current-type wide range air-fuel-ratio sensor. Accordingly, as a result of performance of the processing of steps 1415 to 1450, the wide range feedback control can be performed on the basis of the limiting-current-type output value Vabyfs.

In contrast, if the value of the oxygen concentration sensor FB control flag XO2FB is "1," the CPU 71 makes a "No" determination in step 1410, and then proceeds to step 2210 to determine whether or not the voltage applied state is realized (the changeover switch 678 is closed) at the present point in time.

As mentioned previously, when the value of the oxygen concentration sensor FB control flag XO2FB is "1," the air-fuel-ratio sensor 67 functions as the limiting-current-type wide range air-fuel-ratio sensor in a certain period of time, and functions as the concentration-cell-type oxygen concentration sensor in a different period of time following the certain period of time. The limiting-current-type output value Vabyfs required for the wide range feedback control can be obtained when the air-fuel-ratio sensor 67 is functioning as the limiting-current-type wide range air-fuel-ratio sensor; however, it cannot be obtained when the air-fuel-ratio sensor 67 is functioning as the concentration-cell-type oxygen concentration sensor. In other words, if the voltage applied state is realized at the present point in time, the limiting-current-type output value Vabyfs can be obtained, and as a result the wide range feedback control can be performed.

Accordingly, if the voltage applied state is realized when the CPU 71 performs the processing of step 2210, the CPU 71 makes a "Yes" determination in the same step 2210, and then proceeds to steps 1415 to 1450 to compute the main feedback quantity DFi on the basis of the limiting-current-type output value Vabyfs to perform the wide range feedback control. In contrast, if the voltage applied state is not realized when the CPU 71 performs the processing of step 2210, the CPU 71 makes a "No" determination in step 2210, and then proceeds directly to step 2295 to terminate the present routine temporarily.

<Inter-Cylinder Air-Fuel-Ratio Imbalance Determination>

Figure 23:
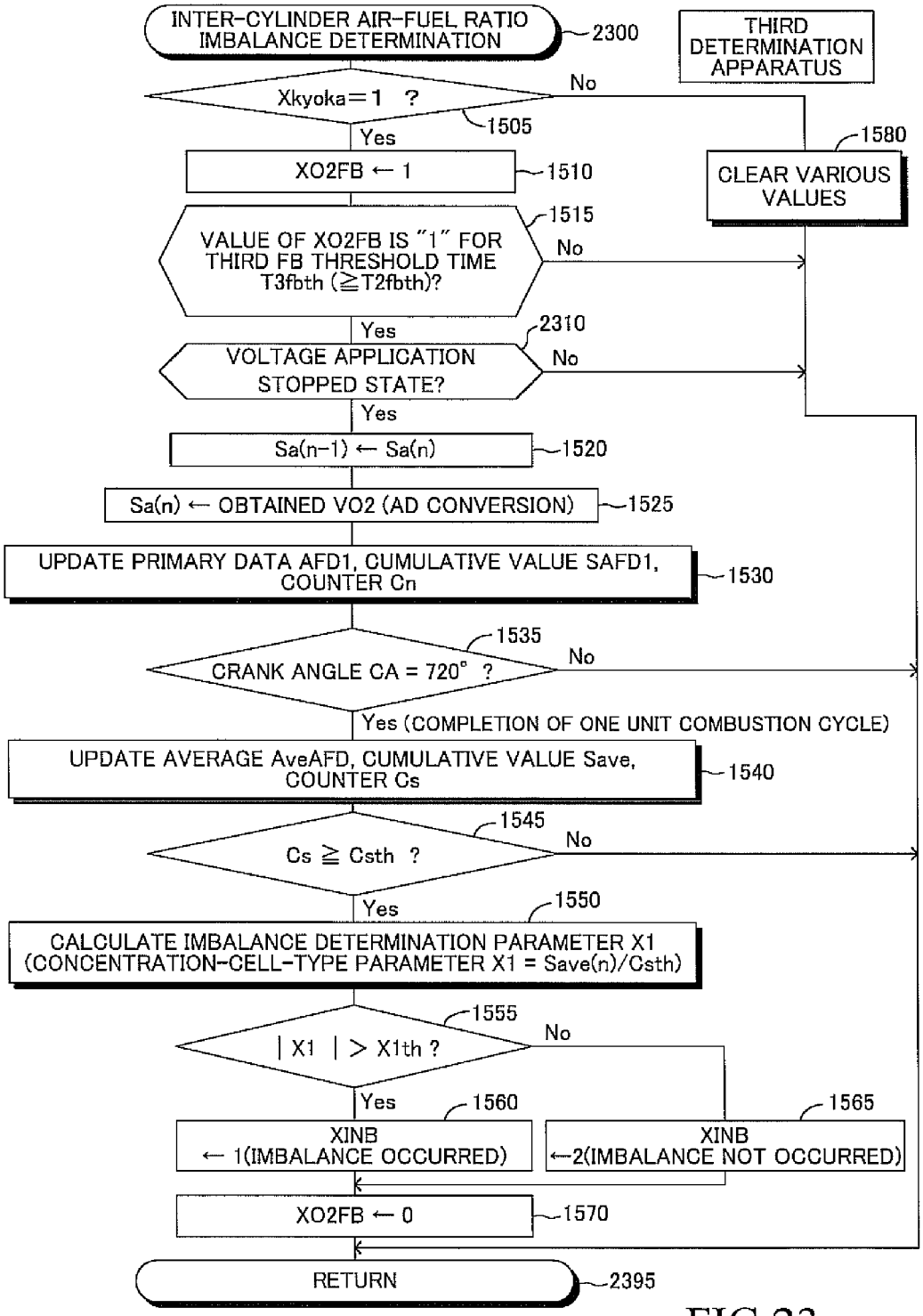
FIG. 23 is a flowchart showing another routine executed by the CPU of the third determination apparatus.

The CPU 71 repeatedly executes an "inter-cylinder air-fuel-ratio imbalance determination routine" shown in the flowchart of FIG. 23 each time the predetermined time (4 ms) elapses. The only difference between this routine and the routine shown in FIG. 15 is that this routine has step 2310 between the steps 1515 and 1520 of the routine shown in FIG. 15. Accordingly, hereafter there will be described only the processing of step 2310.

When the determination execution condition is satisfied, the value of the determination permission flag Xkyoka is set to "1" as a result of performance of the processing of step 1630 in FIG. 16. At this time, the CPU 71 proceeds from step 1505 to step 1510 of FIG. 23 to set the value of the oxygen concentration sensor FB control flag XO2FB to "1." Consequently, as mentioned previously, the voltage applied state and the voltage application stopped state are realized alternately. The air-fuel-ratio sensor 67 functions as the limiting-current-type wide range air-fuel-ratio sensor in a certain period of time, and functions as the concentration-cell-type oxygen concentration sensor in a different period of time following the certain period of time. The concentration-cell-type output value VO2 required for obtaining the concentration-cell-type parameter X1 can be obtained when the air-fuel-ratio sensor 67 is functioning as the concentration-cell-type oxygen concentration sensor; however, it cannot be obtained when the air-fuel-ratio sensor 67 is functioning as the limiting-current-type wide range air-fuel-ratio sensor.

Therefore, upon proceeding to step 2310, the CPU 71 determines whether or not the voltage application stopped state is realized at the present point in time. Subsequently, when the state at the present point in time is the voltage application stopped state, the CPU 71 makes a "Yes" determination in the same step 2310, and then performs the processing of steps 1520 to 1550. As a result, the concentration-cell-type output value VO2 is obtained in step 1525, and the concentration-cell-type parameter X1 is calculated on the basis of the obtained concentration-cell-type output value VO2. Subsequently, upon computing the concentration-cell-type parameter X1, the CPU 71 performs the imbalance determination through use of the obtained concentration-cell-type parameter X1 in steps 1555 to 1565.

In contrast, if the voltage application stopped state is not realized when the CPU 71 performs the processing of step 2310, the CPU 71 makes a "No" determination in the same step 2310, and then proceeds directly to step 2395 to terminate the present routine temporarily. As a result, even in the case where the value of the oxygen concentration sensor FB control flag XO2FB is "1," the CPU 71 does not obtain the concentration-cell-type parameter on the basis of the output value of the air-fuel-ratio sensor 67 if the current state is not the voltage application stopped state (i.e., the air-fuel-ratio sensor 67 is not functioning as the concentration-cell-type oxygen concentration sensor).

As mentioned above, the imbalance determination parameter obtaining means of the third determination apparatus:

(1) sends the instruction for realizing the above-mentioned voltage application stopped state to the above-mentioned voltage application means (remember the case where a "Yes" determination is made in step 2110 in FIG. 21 and the processing of steps 2130 and 2140 performed when the "Yes" determination is made in step 2110) when the condition for obtaining the concentration-cell-type parameter X1 is satisfied (that is, the value of the determination permission flag Xkyoka is set to "1" in steps 1620 and 1630 in FIG. 16 as a result of fulfillment of the determination execution conditions and thereby the value of the oxygen concentration sensor FB control flag XO2FB is set to "1" in steps 1505 and 1510 in FIG. 23); and (2) is configured so as to obtain the above-mentioned concentration-cell-type output value VO2 and the concentration-cell-type parameter X1 when the above-mentioned instruction for realizing the voltage application stopped state is sent to the above-mentioned voltage application means (remember the case where a "Yes" determination is made in step 2310 in FIG. 23 and the processing of steps 1520 to 1550 in FIG. 23).

Furthermore, the wide range feedback control means of the third determination apparatus:

(1) is configured such that, when the above-mentioned concentration-cell-type parameter obtaining condition is satisfied, the wide range feedback control means periodically sends the instruction for realizing the above-mentioned voltage applied state to the above-mentioned voltage application means in such a manner that the above-mentioned instruction for realizing the voltage applied state does not overlap (in terms of time) with the above-mentioned instruction sent by the above-mentioned imbalance determination parameter obtaining means so as to realize the voltage application stopped state (remember the case where a "Yes" determination is made in step 2110 of FIG. 21, whereby the processing of steps 2310 and 2120 are performed), and (2) is configured so as to obtain the limiting-current-type output value Vabyfs used for performing the wide range feedback control, when the above-mentioned instruction for realizing the voltage applied state is sent to the above-mentioned voltage application means (remember the case where a "Yes" determination is made in step 2210 and the processing of step 1415 in FIG. 22).

Thus, the third determination apparatus can continue the wide range feedback control based on the limiting-current-type output value Vabyfs while obtaining the concentration-cell-type parameter X1 on the basis of the concentration-cell-type output value VO2 and executing the inter-cylinder air-fuel-ratio imbalance determination on the basis of the concentration-cell-type parameter X1. Consequently, the third determination apparatus can perform the inter-cylinder air-fuel-ratio imbalance determination accurately while maintaining the amount of emissions at a proper level.

Next, there will be described the conditions which are commonly used by individual determination apparatuses in step 1620 shown in FIG. 16.

(Reason for employing the condition C1) If the intake air flow rate Ga is smaller than the first threshold air flow rate Ga1*th* or a state in which the intake air flow rate Ga is greater than the first threshold air flow rate Ga1*th* does not continue for the first feedback threshold time T1*th* or longer; namely, the condition C1 is not satisfied, the speed of the exhaust gas flowing in the vicinity of the outer protective cover 67*b* of the air-fuel-ratio sensor 67 is very low. In this case, the responsiveness of the air-fuel-ratio sensor 67 is poor not only when the air-fuel-ratio sensor 67 functions as the limiting-current-type wide range air-fuel-ratio sensor but also when it functions as the concentration-cell-type oxygen concentration sensor. Consequently, an accurate imbalance determination parameter cannot be obtained.

(Reason for employing the condition C2) If the main feedback control condition is not satisfied, the "air-fuel ratio of exhaust gas" may fluctuate due to a factor other than inter-cylinder air-fuel-ratio imbalance. Therefore, if the condition C2 is not satisfied, there is a possibility that an accurate imbalance determination parameter cannot be obtained.

(Reason for employing the condition C3) Since fuel is not injected while the fuel cut control is being performed, the air-fuel ratio of exhaust gas does not change any longer with the "difference between the air-fuel ratio of the imbalanced cylinder and the air-fuel ratio of the balanced cylinders (degree of the inter-cylinder air-fuel-ratio imbalance state)." Therefore, if the condition C3 is not satisfied, an accurate imbalance determination parameter cannot be obtained.

(Reason for employing the condition C4) When the second threshold time T2*th* has not elapsed since termination of the fuel cut control; i.e., immediately after termination of the fuel cut control, the air-fuel ratio of the engine is liable to fluctuate due to various factors, such as start of adhesion of a large quantity of injected fuel to the intake ports 31 and the intake valves 32. Therefore, if the condition C4 is not satisfied, an accurate imbalance determination parameter cannot be obtained.

(Reason for employing the condition C5) Since the air-fuel ratio of the engine is forcibly changed under the active control, the air-fuel ratio of exhaust gas is liable to fluctuate during the active control. Therefore, if the condition C5 is not satisfied, an accurate imbalance determination parameter cannot be obtained.

(Reason for employing the condition C6) When the third threshold time T3*th* has not elapsed since termination of the active control; i.e., immediately after termination of the active control, the air-fuel ratio of exhaust gas fluctuates due to the influence of the active control. Therefore, if the condition C6 is not satisfied, an accurate imbalance determination parameter cannot be obtained.

Notably, the active control refers to "control for setting the upstream-side target air-fuel ratio abyfr to an air-fuel ratio other than the stoichiometric air-fuel ratio" when a predetermined condition (active control condition) is satisfied. The active control is performed, for example, when failure determination for the upstream catalyst 53 is performed or when failure determination for the air-fuel-ratio sensor 67 is performed. That is, the active control includes control performed, for example, for the purpose of failure determination for engine control parts (parts related to exhaust purification). Such a control forcedly changes the upstream-side target air-fuel ratio abyfr to an air-fuel ratio different from the stoichiometric air-fuel ratio, to thereby forcedly deviates the air-fuel ratio of the air-fuel mixture supplied to the engine 10 (air-fuel ratio of the engine) from the stoichiometric air-fuel ratio (a typical example of such a control is a control for periodically and forcedly switching the air-fuel ratio of the engine between an air-fuel ratio which is on the rich side in relation to the stoichiometric air-fuel ratio and an air-fuel ratio which is on the lean side in relation to the stoichiometric air-fuel ratio).

When the failure determination for the upstream catalyst 53 is performed, the active control (catalytic conversion OBD active control) is performed, for example, to periodically set the upstream-side target air-fuel ratio abyfr to an air-fuel ratio (rich air-fuel ratio) which is on the rich side in relation to the stoichiometric air-fuel ratio and to an air-fuel ratio (lean air-fuel ratio) which is on the lean side in relation to the stoichiometric air-fuel ratio so as to obtain a maximum oxygen storage capacity Cmax of the upstream-side catalyst 53. If the maximum oxygen storage capacity Cmax is less than a threshold maximum oxygen storage capacity Cmaxth, the upstream catalyst 53 is determined to have degraded.

The active control performed in the above-described situations is well-known control disclosed in, for example, Japanese Patent Application Laid-open Nos. 2009-191665, 2009-127597, 2009-127595, 2009-097474, 2007-056723, 2004-028029, 2004-176615, etc.

Notably, it could be said that "the first determination apparatus (and other determination apparatuses) has stoichiometric air-fuel ratio setting means for setting (controlling) the air-fuel ratio of the air-fuel mixture supplied to the engine 10 to the stoichiometric air-fuel ratio (by setting the upstream-side target air-fuel ratio abyfr to the stoichiometric air-fuel ratio) when the active control condition is not satisfied."

(Reason for employing the condition C7) When the acceleration change amount ΔAccp is equal to or greater than the threshold acceleration change amount ΔAccpth; i.e., relatively sudden accelerating or decelerating operation is performed, the "intake air flow rate (namely, the in-cylinder intake air quantity)" and the "quantity of fuel adhered to the intake passage forming components such as the intake ports 31 and the intake valves 32" change suddenly. As a result, the air-fuel ratio of the engine fluctuates, which causes the air-fuel ratio of the exhaust gas to fluctuate. Therefore, if the condition C7 is not satisfied, an accurate imbalance determination parameter cannot be obtained.

(Reason for employing the condition C8) If the state in which the acceleration change amount ΔAccp is less than the threshold acceleration change amount (threshold accelerating operation change amount) ΔAccpth does not continue for the fourth threshold time T4*th* or longer, the influence of accelerating or decelerating operation remains, and consequently the air-fuel ratio of exhaust gas fluctuates. Accordingly, if the condition C8 is not satisfied, an accurate imbalance determination parameter cannot be obtained.

(Reason for employing the condition C9) If the intake air flow rate change amount ΔGa is equal to or greater than the threshold flow rate change amount ΔGath, the air-fuel ratio of exhaust gas changes for the same reason as that in case where the acceleration change amount ΔAccp is equal to or greater than the threshold accelerator change amount ΔAccpth. Accordingly, if the condition C9 is not satisfied, an accurate imbalance determination parameter cannot be obtained.

(Reason for employing the condition C10) If the state in which the intake air flow rate change amount ΔGa is less than the threshold flow rate change amount ΔGath does not continue for the fifth threshold time T5*th* or longer, the influence of accelerating or decelerating operation remains, and consequently the air-fuel ratio of exhaust gas fluctuates. Accordingly, if the condition C10 is not satisfied, an imbalance determination parameter cannot be obtained.

(Reason for employing the condition C11) If the engine rotational speed NE is equal to or greater than the "threshold rotational speed NEth which increases with the intake air flow rate Ga," the unit combustion cycle period becomes shorter. As a result, the cycle of fluctuation in the air-fuel ratio of exhaust gas becomes shorter and consequently the "output value Vabyfs or VO2" of the air-fuel-ratio sensor 67 cannot satisfactorily follow the change in the air-fuel ratio of the exhaust gas. Accordingly, if the condition C11 is not satisfied, an accurate imbalance determination parameter cannot be obtained.

(Reason for employing the condition C12) If the cooling water temperature THW is lower than the threshold cooling water temperature THWth, the temperatures of the intake passage forming components are low and consequently a large quantity of fuel adheres to the intake passage forming components. In this case, the fuel injected from the fuel injection valve 39 of the imbalanced cylinder which injects fuel in a quantity greater than the instructed fuel injection quantity adheres to the intake passage forming components in a larger quantity, as compared with the fuel injected from the fuel injection valves 39 of the balanced cylinders. As a result, the difference between the air-fuel ratio of the imbalanced cylinder and the air-fuel ratio of the balanced cylinders decreases. Accordingly, if the condition C12 is not satisfied, an accurate imbalance determination parameter cannot be obtained.

(Reason for employing the condition C13) When evaporated fuel gas is being purged, it is evenly distributed to the respective cylinders and consequently the difference between the air-fuel ratio of the imbalanced cylinder and the air-fuel ratio of the balanced cylinders differs from that in case where evaporated fuel gas is not being purged. Accordingly, if the condition C13 is not satisfied, an accurate imbalance determination parameter cannot be obtained.

As mentioned above, the determination apparatuses according to the present invention obtain the concentration-cell-type parameter X1 on the basis of the concentration-cell-type output value VO2 by switching the function of the air-fuel-ratio sensor 67, and perform the imbalance determination on the basis of the obtained concentration-cell-type parameter X1. Hence, the imbalance determination can be performed accurately.

The present invention is not limited to the above-described embodiments, and may be modified in various manners without departing from the scope of the present invention. For example, since the concentration-cell-type parameter X1 of each of the above-mentioned embodiments is a positive value, the absolute value of the concentration-cell-type parameter X1 need not be computed in step 1555. However, if the concentration-cell-type parameter X1 is a parameter which assumes a negative value, in step 1555, the CPU compares the absolute value of the concentration-cell-type parameter X1 with the concentration-cell-type-corresponding imbalance determination threshold X1th. Alternately, if the concentration-cell-type parameter X1 is a parameter which assumes a negative value, in step 1555, the CPU compares this concentration-cell-type parameter X1 with the "concentration-cell-type imbalance determination threshold X1th with its sign inverted" and, if the concentration-cell-type parameter X1 is less than the concentration-cell-type imbalance determination threshold X1th, the absolute value of the concentration-cell-type parameter X1 is determined to be greater than the concentration-cell-type imbalance determination threshold X1th.

Similarly, since the limiting-current-type parameter X2 of each of the above-mentioned embodiments is a positive value, the absolute value of the limiting-current-type parameter X2 need not be computed in step 1945. However, if the limiting-current-type parameter X2 is a parameter which assumes a negative value, in step 1945, the CPU compares the absolute value of limiting-current-type parameter X2 with the limiting-current-type-corresponding imbalance determination threshold X2th. Alternately, if the limiting-current-type parameter X2 is a parameter which assumes a negative value, in step 1945, the CPU compares this limiting-current-type parameter X2 with the "limiting-current-type-corresponding imbalance determination threshold X2th with its sign inverted" and, if the limiting-current-type parameter X2 is less than the limiting-current-type-corresponding imbalance determination threshold X2th, the absolute value of the limiting-current-type parameter X2 is determined to be greater than the limiting-current-type-corresponding imbalance determination threshold X2th.

Figure 24:
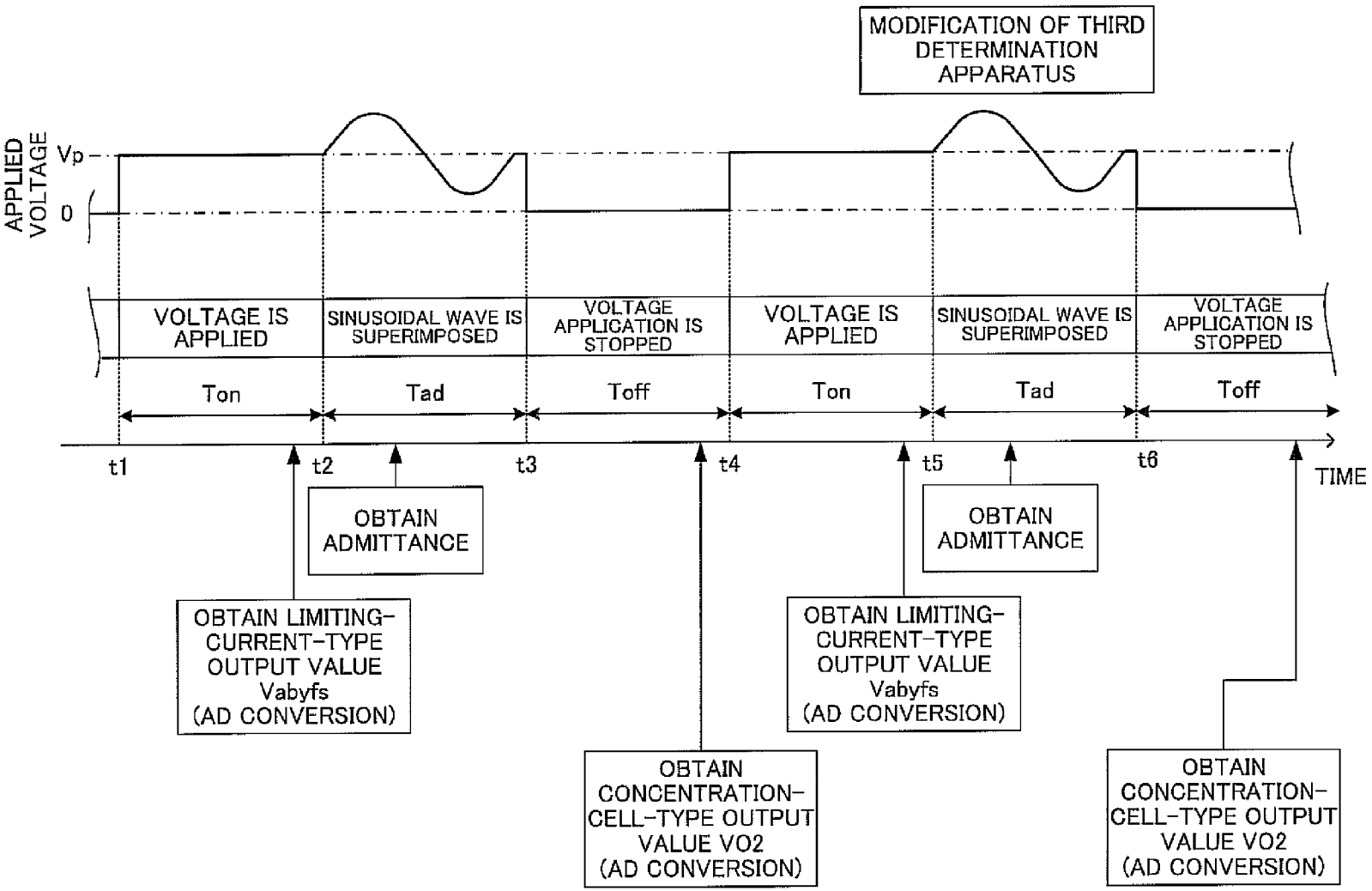
FIG. 24 is a time chart for describing operation of an inter-cylinder air-fuel-ratio imbalance determination apparatus according to a modification of the third embodiment of the present invention.

Furthermore, in a "period during which the instruction for realizing the voltage application stopped state (the instruction for opening the changeover switch 678) is sent to the changeover switch 678" or in a "period during which the instruction for realizing the voltage applied state (the instruction for closing the changeover switch 678) is sent to the changeover switch 678," a voltage having a rectangular waveform or a sinusoidal waveform may be applied, in a time-shared manner, between the "exhaust-gas-side electrode layer 672 and the atmosphere-side electrode layer 673" so as to obtain the admittance of the air-fuel-ratio detection element 67*a* for estimation of the temperature of the air-fuel-ratio detection element 67*a*. For example, the time chart of FIG. 24 shows an example in which an instruction for obtaining such admittance is sent to the changeover switch 678 in the period during which the third determination apparatus obtains an imbalance determination parameter.

Moreover, the wide range feedback control is not limited to that used in the above-described embodiments. For example, the wide range feedback control may be such that, when the difference (abyfr-abyfsc) between the target air-fuel ratio abyfr and the air-fuel ratio abyfsc represented by the output value Vabyfs is positive, the wide range feedback control sets a negative main feedback quantity DFi whose absolute value increases with the difference |abyfr-abyfsc|. Similarly, the wide range feedback control may be such that, when the difference (abyfr-abyfsc) between the target air-fuel ratio abyfr and the air-fuel ratio abyfsc represented by the output value Vabyfs is negative, the wide range feedback control sets a positive main feedback quantity DFi whose absolute value increases with the difference |abyfr-abyfsc|.

The invention claimed is:

1. An inter-cylinder air-fuel-ratio imbalance determination apparatus applied to a multi-cylinder internal combustion engine having a plurality of cylinders, comprising:

an air-fuel-ratio sensor disposed in an exhaust merging region of an exhaust passage of said engine into which exhaust gases discharged from at least two or more of a plurality of said cylinders merge or disposed at a location downstream of said exhaust merging region, said air-fuel-ratio sensor including an air-fuel-ratio detection element having a solid electrolyte layer, an exhaust-gas-side electrode layer formed on one surface of said solid electrolyte layer, a diffusion resistance layer which covers said exhaust-gas-side electrode layer and which said exhaust gases reaches, and an atmosphere-side electrode layer formed on the other surface of said solid electrolyte layer and exposed to an atmosphere chamber, wherein, when a voltage is applied between said exhaust-gas-side electrode layer and said atmosphere-side electrode layer, said air-fuel-ratio sensor functions as a limiting-current-type wide range air-fuel-ratio sensor and outputs a value corresponding to a limiting current flowing through said air-fuel-ratio detection element as a limiting-current-type output value Vabyfs, and, when no voltage is applied between said exhaust-gas-side electrode layer and said atmosphere-side electrode layer, said air-fuel-ratio sensor functions as a concentration-cell-type oxygen concentration sensor and outputs an electromotive force generated by said air-fuel-ratio detection element as a concentration-cell-type output value VO2;

a plurality of fuel injection valves disposed in such a manner that they correspond to said at least two or more of said cylinders, each fuel injection valve injecting fuel to be contained in an air-fuel mixture supplied to a combustion chamber of said corresponding cylinder;

voltage application means for realizing, in accordance with an instruction, either one of a voltage applied state in which said voltage is applied between said exhaust-gas-side electrode layer and said atmosphere-side electrode layer and a voltage application stopped state in which an application of said voltage is stopped;

wide range feedback control means for sending to said voltage application means an instruction for realizing said voltage applied state, obtaining said limiting-current-type output value Vabyfs, and executing wide range feedback control, which is a control for adjusting quantities of fuel injected from a plurality of said fuel injection valves based on a value corresponding to a difference between a target air-fuel ratio abyfr set to a stoichiometric air-fuel ratio and an air-fuel ratio represented by said obtained limiting-current-type output value Vabyfs in such a manner that said air-fuel ratio represented by said limiting-current-type output value Vabyfs coincides with said target air-fuel ratio abyfr;

imbalance determination parameter obtaining means for sending to said voltage application means an instruction for realizing said voltage application stopped state in place of said instruction for realizing said voltage applied state, obtaining said concentration-cell-type output value VO2, and obtains a concentration-cell-type parameter based on said obtained concentration-cell-type output value VO2, said concentration-cell-type parameter being an imbalance determination parameter which is a value changing in accordance with a change amount per unit time of said obtained concentration-cell-type output value VO2 or a value changing in accordance with a change amount per unit time of said change amount per unit time of said obtained concentration-cell-type output value VO2 and whose absolute value increases as a difference between cylinder-by-cylinder air-fuel ratios becomes larger, each of said cylinder-by-cylinder air-fuel ratios being an air-fuel ratio of an air-fuel mixture supplied to each of said at least two or more of said cylinders; and imbalance determination means for determining that an inter-cylinder air-fuel-ratio imbalance state in which said difference between said cylinder-by-cylinder air-fuel ratios is equal to or greater than an allowable value has occurred, when an absolute value of said obtained concentration-cell-type parameter is greater than a predetermined concentration-cell-type-corresponding imbalance determination threshold.

2. The inter-cylinder air-fuel-ratio imbalance determination apparatus according to claim 1, wherein said air-fuel-ratio sensor includes a protective cover for accommodating said air-fuel-ratio detection element, said protective cover having an inflow hole through which said exhaust gas flowing through said exhaust passage is introduced into an interior of said protective cover, and an outflow hole through which said exhaust gas introduced into said interior of said protective cover is discharged to said exhaust passage.

3. The inter-cylinder air-fuel-ratio imbalance determination apparatus according to claim 1, wherein said imbalance determination parameter obtaining means is configured so as to obtain said limiting-current-type output value Vabyfs when said instruction for realizing said voltage applied state is sent to said voltage application means, and obtain, based on said obtained limiting-current-type output value Vabyfs, a limiting-current-type parameter which is an imbalance determination parameter whose absolute value increases as said difference between said cylinder-by-cylinder air-fuel ratios becomes larger and which is different from said concentration-cell-type parameter;

said imbalance determination parameter obtaining means is configured in such a manner that, when said engine enters a certain operation state in which said air-fuel-ratio sensor functioning as said limiting-current-type wide range air-fuel-ratio sensor cannot have a responsiveness equal to or higher than a predetermined threshold level, said imbalance determination parameter obtaining means obtains said concentration-cell-type output value VO2 and said concentration-cell-type parameter by sending said instruction for realizing said voltage application stopped state to said voltage application means in place of said instruction for realizing said voltage applied state; and said imbalance determination parameter obtaining means includes concentration-cell-type feedback control means for executing concentration-cell-type feedback control, which is adapted to adjust quantities of said fuel injected from a plurality of said fuel injection valves in such a manner that said obtained concentration-cell-type output value VO2 coincides with a target value Vst corresponding to said stoichiometric air-fuel ratio;

said wide range feedback control means is configured so as to stop said wide range feedback control when said concentration-cell-type feedback control is executed; and said imbalance determination means is configured so as to determine that said inter-cylinder air-fuel-ratio imbalance state has occurred, when said absolute value of said obtained limiting-current-type parameter is greater than a predetermined limiting-current-type-corresponding imbalance determination threshold.

4. The inter-cylinder air-fuel-ratio imbalance determination apparatus according to claim 3, wherein said certain operation state is an operation state in which an intake air flow rate, which is a quantity of air taken into said engine per unit time, is equal to or less than a predetermined threshold air flow rate.

5. The inter-cylinder air-fuel-ratio imbalance determination apparatus according to claim 3, wherein said certain operation state is an operation state in which a load of said engine, which is a value corresponding to a quantity of air taken by a single cylinder of said engine in each intake stroke, is equal to or lower than a predetermined threshold load.

6. The inter-cylinder air-fuel-ratio imbalance determination apparatus according to claim 1, wherein said imbalance determination parameter obtaining means is configured to obtain said limiting-current-type output value Vabyfs when an instruction for realizing said voltage applied state is sent to said voltage application means, and obtain, based on said obtained limiting-current-type output value Vabyfs, a limiting-current-type parameter which is an imbalance determination parameter whose absolute value increases as said difference between said cylinder-by-cylinder air-fuel ratios becomes larger and which is different from said concentration-cell-type parameter;

said imbalance determination parameter obtaining means is configured in such a manner that, when said absolute value of said obtained limiting-current-type parameter is smaller than a predetermined limiting-current-type-corresponding imbalance determination threshold, said imbalance determination parameter obtaining means obtains said concentration-cell-type output value VO2 and said concentration-cell-type parameter by sending said instruction for realizing said voltage application stopped state to said voltage application means in place of said instruction for realizing said voltage applied state;

said imbalance determination parameter obtaining means includes concentration-cell-type feedback control means for executing concentration-cell-type feedback control, which is adapted to adjust quantities of said fuel injected from a plurality of said fuel injection valves in such a manner that said obtained concentration-cell-type output value VO2 coincides with a target value Vst corresponding to said stoichiometric air-fuel ratio;

said wide range feedback control means is configured so as to stop said wide range feedback control when said concentration-cell-type feedback control is executed; and said imbalance determination means is configured so as to determine that said inter-cylinder air-fuel-ratio imbalance state has occurred when said absolute value of said obtained limiting-current-type parameter is greater than said limiting-current-type-corresponding imbalance determination threshold.

7. The inter-cylinder air-fuel-ratio imbalance determination apparatus according to claim 1, wherein said imbalance determination parameter obtaining means is configured to periodically send said instruction for realizing said voltage application stopped state to said voltage application means, when a predetermined concentration-cell-type parameter obtaining condition for obtaining said concentration-cell-type parameter is satisfied, and obtain said concentration-cell-type output value VO2 and said concentration-cell-type parameter when said instruction for realizing said voltage application stopped state is sent to said voltage application means; and said wide range feedback control means is configured in such a manner that, when said concentration-cell-type parameter obtaining condition is satisfied, said wide range feedback control means periodically sends aid instruction for realizing said voltage applied state to said voltage application means such that that instruction does not overlap, in terms of time, with said instruction for realizing said voltage application stopped state sent from said imbalance determination parameter obtaining means, and obtains said limiting-current-type output value Vabyfs when said instruction for realizing said voltage applied state is sent to said voltage application means.

8. The inter-cylinder air-fuel-ratio imbalance determination apparatus according to claim 1, wherein said imbalance determination parameter obtaining means is configured in such a manner that, when a predetermined concentration-cell-type parameter obtaining condition for obtaining said concentration-cell-type parameter is satisfied, said imbalance determination parameter obtaining means continuously sends said instruction for realizing said voltage application stopped state to said voltage application means, and obtains said concentration-cell-type output value VO2 and said concentration-cell-type parameter;

said imbalance determination parameter obtaining means includes concentration-cell-type feedback control means for executing concentration-cell-type feedback control, which is adapted to adjust quantities of said fuel injected from a plurality of said fuel injection valves such that said obtained concentration-cell-type output value VO2 coincides with a target value Vst corresponding to said stoichiometric air-fuel ratio; and said wide range feedback control means is configured to stop said wide range feedback control when said concentration-cell-type feedback control is executed.

9. The inter-cylinder air-fuel-ratio imbalance determination apparatus according to claim 2, wherein said imbalance determination parameter obtaining means is configured so as to obtain said limiting-current-type output value Vabyfs when said instruction for realizing said voltage applied state is sent to said voltage application means, and obtain, based on said obtained limiting-current-type output value Vabyfs, a limiting-current-type parameter which is an imbalance determination parameter whose absolute value increases as said difference between said cylinder-by-cylinder air-fuel ratios becomes larger and which is different from said concentration-cell-type parameter;

said imbalance determination parameter obtaining means is configured in such a manner that, when said engine enters a certain operation state in which said air-fuel-ratio sensor functioning as said limiting-current-type wide range air-fuel-ratio sensor cannot have a responsiveness equal to or higher than a predetermined threshold level, said imbalance determination parameter obtaining means obtains said concentration-cell-type output value VO2 and said concentration-cell-type parameter by sending said instruction for realizing said voltage application stopped state to said voltage application means in place of said instruction for realizing said voltage applied state; and said imbalance determination parameter obtaining means includes concentration-cell-type feedback control means for executing concentration-cell-type feedback control, which is adapted to adjust quantities of said fuel injected from a plurality of said fuel injection valves in such a manner that said obtained concentration-cell-type output value VO2 coincides with a target value Vst corresponding to said stoichiometric air-fuel ratio;

said wide range feedback control means is configured so as to stop said wide range feedback control when said concentration-cell-type feedback control is executed; and said imbalance determination means is configured so as to determine that said inter-cylinder air-fuel-ratio imbalance state has occurred, when said absolute value of said obtained limiting-current-type parameter is greater than a predetermined limiting-current-type-corresponding imbalance determination threshold.

10. The inter-cylinder air-fuel-ratio imbalance determination apparatus according to claim 9, wherein said certain operation state is an operation state in which an intake air flow rate, which is a quantity of air taken into said engine per unit time, is equal to or less than a predetermined threshold air flow rate.

11. The inter-cylinder air-fuel-ratio imbalance determination apparatus according to claim 9, wherein said certain operation state is an operation state in which a load of said engine, which is a value corresponding to a quantity of air taken by a single cylinder of said engine in each intake stroke, is equal to or lower than a predetermined threshold load.

12. The inter-cylinder air-fuel-ratio imbalance determination apparatus according to claim 2, wherein said imbalance determination parameter obtaining means is configured to obtain said limiting-current-type output value Vabyfs when an instruction for realizing said voltage applied state is sent to said voltage application means, and obtain, based on said obtained limiting-current-type output value Vabyfs, a limiting-current-type parameter which is an imbalance determination parameter whose absolute value increases as said difference between said cylinder-by-cylinder air-fuel ratios becomes larger and which is different from said concentration-cell-type parameter;

said imbalance determination parameter obtaining means is configured in such a manner that, when said absolute value of said obtained limiting-current-type parameter is smaller than a predetermined limiting-current-type-corresponding imbalance determination threshold, said imbalance determination parameter obtaining means obtains said concentration-cell-type output value VO2 and said concentration-cell-type parameter by sending said instruction for realizing said voltage application stopped state to said voltage application means in place of said instruction for realizing said voltage applied state;

said imbalance determination parameter obtaining means includes concentration-cell-type feedback control means for executing concentration-cell-type feedback control, which is adapted to adjust quantities of said fuel injected from a plurality of said fuel injection valves in such a manner that said obtained concentration-cell-type output value VO2 coincides with a target value Vst corresponding to said stoichiometric air-fuel ratio;

said wide range feedback control means is configured so as to stop said wide range feedback control when said concentration-cell-type feedback control is executed; and said imbalance determination means is configured so as to determine that said inter-cylinder air-fuel-ratio imbalance state has occurred when said absolute value of said obtained limiting-current-type parameter is greater than said limiting-current-type-corresponding imbalance determination threshold.

13. The inter-cylinder air-fuel-ratio imbalance determination apparatus according to claim 2, wherein said imbalance determination parameter obtaining means is configured to periodically send said instruction for realizing said voltage application stopped state to said voltage application means, when a predetermined concentration-cell-type parameter obtaining condition for obtaining said concentration-cell-type parameter is satisfied, and obtain said concentration-cell-type output value VO2 and said concentration-cell-type parameter when said instruction for realizing said voltage application stopped state is sent to said voltage application means; and said wide range feedback control means is configured in such a manner that, when said concentration-cell-type parameter obtaining condition is satisfied, said wide range feedback control means periodically sends aid instruction for realizing said voltage applied state to said voltage application means such that that instruction does not overlap, in terms of time, with said instruction for realizing said voltage application stopped state sent from said imbalance determination parameter obtaining means, and obtains said limiting-current-type output value Vabyfs when said instruction for realizing said voltage applied state is sent to said voltage application means.

14. The inter-cylinder air-fuel-ratio imbalance determination apparatus according to claim 2, wherein said imbalance determination parameter obtaining means is configured in such a manner that, when a predetermined concentration-cell-type parameter obtaining condition for obtaining said concentration-cell-type parameter is satisfied, said imbalance determination parameter obtaining means continuously sends said instruction for realizing said voltage application stopped state to said voltage application means, and obtains said concentration-cell-type output value VO2 and said concentration-cell-type parameter;

said imbalance determination parameter obtaining means includes concentration-cell-type feedback control means for executing concentration-cell-type feedback control, which is adapted to adjust quantities of said fuel injected from a plurality of said fuel injection valves such that said obtained concentration-cell-type output value VO2 coincides with a target value Vst corresponding to said stoichiometric air-fuel ratio; and said wide range feedback control means is configured to stop said wide range feedback control when said concentration-cell-type feedback control is executed.

* * * * *